US007581930B2

(12) United States Patent
Aggarwala et al.

(10) Patent No.: US 7,581,930 B2
(45) Date of Patent: Sep. 1, 2009

(54) HIGH LIFT TRANSONIC TURBINE BLADE

(75) Inventors: Andrew S. Aggarwala, East Hartford, CT (US); Richard E. Gacek, South Windsor, CT (US); Joseph B. Staubach, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 448 days.

(21) Appl. No.: 11/504,980

(22) Filed: Aug. 16, 2006

(65) Prior Publication Data

US 2009/0162204 A1 Jun. 25, 2009

(51) Int. Cl.
*F01D 5/14* (2006.01)

(52) U.S. Cl. ..... 416/193 A; 416/243

(58) Field of Classification Search ..... None
See application file for complete search history.

(56) References Cited

U.S. PATENT DOCUMENTS 5,980,209 A * 11/1999 Barry et al. ..... 416/223 A
6,358,012 B1 3/2002 Staubach
6,398,489 B1 * 6/2002 Burdgick et al. ..... 415/115
6,450,770 B1 * 9/2002 Wang et al. ..... 416/223 A
6,461,109 B1 * 10/2002 Wedlake et al. ..... 416/223 R
6,461,110 B1 * 10/2002 By et al. ..... 416/223 A
6,474,948 B1 * 11/2002 Pirolla et al. ..... 416/243
6,503,054 B1 * 1/2003 Bielek et al. ..... 415/191
6,503,059 B1 * 1/2003 Frost et al. ..... 416/223 A
6,558,122 B1 * 5/2003 Xu et al. ..... 416/223 A
6,579,066 B1 6/2003 Saito et al.
6,669,445 B2 12/2003 Staubach et al.
6,685,434 B1 * 2/2004 Humanchuk et al. .... 416/223 A
6,715,990 B1 * 4/2004 Arness et al. ..... 416/223 A
6,722,852 B1 * 4/2004 Wedlake et al. ..... 416/223 A
6,722,853 B1 * 4/2004 Humanchuk et al. .... 416/223 A
6,736,599 B1 * 5/2004 Jacks et al. ..... 415/191
6,739,838 B1 * 5/2004 Bielek et al. ..... 416/223 A
6,739,839 B1 * 5/2004 Brown et al. ..... 416/223 A
6,769,878 B1 * 8/2004 Parker et al. ..... 416/243
6,769,879 B1 * 8/2004 Cleveland et al. ..... 416/243
6,779,977 B2 * 8/2004 Lagrange et al. ..... 416/223 A
6,779,980 B1 * 8/2004 Brittingham et al. ..... 416/243
6,808,368 B1 * 10/2004 Tomberg et al. ..... 416/223 A
6,832,897 B2 * 12/2004 Urban ..... 416/223 A
6,854,961 B2 * 2/2005 Zhang et al. ..... 416/223 A
6,857,855 B1 * 2/2005 Snook et al. ..... 416/223 A
6,866,477 B2 * 3/2005 Arness et al. ..... 415/191
6,881,038 B1 * 4/2005 Beddard et al. ..... 416/243
6,884,038 B2 * 4/2005 Hyde et al. ..... 416/223 A
6,887,041 B2 * 5/2005 Coke et al. ..... 415/191

(Continued)

*Primary Examiner*—Richard Edgar
(74) *Attorney, Agent, or Firm*—Kinney & Lange, P.A.

(57) ABSTRACT

A turbine blade system including a blade airfoil having an airfoil shape with the blade airfoil having a nominal profile substantially in accordance with normalized Cartesian coordinate values Z set forth in a table 1 below and which values are dimensionless values that are convertible to corresponding absolute distance values that define nominal airfoil profile sections and which, when joined smoothly with adjacent ones thereof, form a complete nominal airfoil shape that is substantially matched by the airfoil shape of the blade airfoil. This blade airfoil can be supported on a ring platform having a support surface with a support surface shape in the vicinity of the location at which that blade airfoil is supported thereon formed in a similar manner.

11 Claims, 6 Drawing Sheets

U.S. PATENT DOCUMENTS

| | | | | |
|---|---|---|---|---|
| 6,910,868 | B2 * | 6/2005 | Hyde et al. | 416/223 R |
| 6,932,577 | B2 * | 8/2005 | Strohl et al. | 416/223 A |
| 7,001,147 | B1 * | 2/2006 | Phillips et al. | 415/191 |
| 7,186,090 | B2 * | 3/2007 | Tomberg et al. | 416/223 A |
| 7,306,436 | B2 * | 12/2007 | Girgis et al. | 416/223 A |
| 7,329,092 | B2 * | 2/2008 | Keener et al. | 415/191 |
| 7,329,093 | B2 * | 2/2008 | Vandeputte et al. | 415/191 |
| 7,351,038 | B2 * | 4/2008 | Girgis et al. | 416/223 A |
| 7,354,249 | B2 * | 4/2008 | Girgis et al. | 416/223 A |
| 7,367,779 | B2 * | 5/2008 | Girgis et al. | 416/223 A |
| 7,384,243 | B2 * | 6/2008 | Noshi | 416/223 A |
| 7,396,211 | B2 * | 7/2008 | Tomberg et al. | 416/223 A |
| 7,402,026 | B2 * | 7/2008 | Girgis et al. | 416/223 A |
| 2003/0017052 | A1 * | 1/2003 | Frost et al. | 416/223 A |
| 2003/0021680 | A1 * | 1/2003 | Bielek et al. | 415/191 |
| 2004/0057833 | A1 * | 3/2004 | Arness et al. | 416/243 |
| 2004/0115058 | A1 * | 6/2004 | Lagrange et al. | 416/223 A |
| 2004/0175271 | A1 * | 9/2004 | Coke et al. | 416/223 A |
| 2004/0223849 | A1 * | 11/2004 | Urban | 416/223 A |
| 2004/0241002 | A1 * | 12/2004 | Zhang et al. | 416/223 A |
| 2005/0013695 | A1 * | 1/2005 | Hyde et al. | 416/243 |
| 2005/0019160 | A1 * | 1/2005 | Hyde et al. | 415/213.1 |
| 2005/0025618 | A1 * | 2/2005 | Arness et al. | 415/191 |
| 2005/0031453 | A1 * | 2/2005 | Snook et al. | 416/223 A |
| 2005/0079061 | A1 * | 4/2005 | Beddard et al. | 416/243 |
| 2005/0111978 | A1 * | 5/2005 | Strohl et al. | 416/97 R |
| 2006/0024159 | A1 * | 2/2006 | Phillips et al. | 415/191 |
| 2006/0073014 | A1 * | 4/2006 | Tomberg et al. | 416/96 R |
| 2007/0048143 | A1 * | 3/2007 | Noshi | 416/223 R |
| 2007/0154316 | A1 * | 7/2007 | Clarke | 416/223 R |
| 2007/0154318 | A1 * | 7/2007 | Saltman et al. | 416/241 R |
| 2007/0177980 | A1 * | 8/2007 | Keener et al. | 416/223 R |
| 2007/0177981 | A1 * | 8/2007 | Vandeputte et al. | 416/223 R |
| 2007/0183895 | A1 * | 8/2007 | Sheffield | 416/223 R |
| 2007/0183896 | A1 * | 8/2007 | Jay et al. | 416/223 R |
| 2007/0183897 | A1 * | 8/2007 | Sadler et al. | 416/223 R |
| 2007/0183898 | A1 * | 8/2007 | Hurst et al. | 416/223 R |
| 2007/0207035 | A1 * | 9/2007 | Girgis et al. | 416/223 A |
| 2007/0207036 | A1 * | 9/2007 | Girgis et al. | 416/223 A |
| 2007/0207037 | A1 * | 9/2007 | Girgis et al. | 416/223 A |
| 2007/0207038 | A1 * | 9/2007 | Girgis et al. | 416/223 A |
| 2007/0231147 | A1 * | 10/2007 | Tomberg et al. | 416/223 R |
| 2007/0286718 | A1 * | 12/2007 | Stampfli et al. | 415/191 |
| 2008/0044287 | A1 * | 2/2008 | Girgis et al. | |
| 2008/0044288 | A1 * | 2/2008 | Novori et al. | 416/223 R |
| 2008/0056893 | A1 * | 3/2008 | Marini et al. | 415/191 |
| 2008/0056894 | A1 * | 3/2008 | Tsifourdaris et al. | 415/191 |
| 2008/0056896 | A1 * | 3/2008 | Trindade et al. | 415/208.1 |
| 2008/0056901 | A1 * | 3/2008 | Mah et al. | 416/223 R |
| 2008/0056902 | A1 * | 3/2008 | Ravanis et al. | 416/223 R |
| 2008/0056903 | A1 * | 3/2008 | Girgis et al. | 416/223 R |
| 2008/0063530 | A1 * | 3/2008 | Papple et al. | 416/223 A |
| 2008/0063531 | A1 * | 3/2008 | Sreekanth et al. | 416/223 A |
| 2008/0101925 | A1 * | 5/2008 | Humanchuk et al. | 415/208.1 |
| 2008/0101940 | A1 * | 5/2008 | LaMaster et al. | 416/223 R |
| 2008/0101941 | A1 * | 5/2008 | LaMaster et al. | 416/223 R |
| 2008/0101942 | A1 * | 5/2008 | McGowan et al. | 416/223 R |
| 2008/0101943 | A1 * | 5/2008 | Columbus et al. | 416/223 R |
| 2008/0101944 | A1 * | 5/2008 | Spracher et al. | 416/223 R |
| 2008/0101945 | A1 * | 5/2008 | Tomberg et al. | 416/223 R |
| 2008/0101946 | A1 * | 5/2008 | Duong et al. | 416/223 R |
| 2008/0101947 | A1 * | 5/2008 | Shrum et al. | 416/223 R |
| 2008/0101948 | A1 * | 5/2008 | Latimer et al. | 416/223 R |
| 2008/0101949 | A1 * | 5/2008 | Spracher et al. | 416/223 R |
| 2008/0101950 | A1 * | 5/2008 | Noshi et al. | 416/223 R |
| 2008/0101951 | A1 * | 5/2008 | Hudson et al. | 416/223 R |
| 2008/0101952 | A1 * | 5/2008 | Duong et al. | 416/223 R |
| 2008/0101953 | A1 * | 5/2008 | Huskins et al. | 416/223 R |
| 2008/0101954 | A1 * | 5/2008 | Latimer et al. | 416/223 R |
| 2008/0101955 | A1 * | 5/2008 | McGowan et al. | 416/223 R |
| 2008/0101956 | A1 * | 5/2008 | Douchkin et al. | 416/223 R |
| 2008/0101957 | A1 * | 5/2008 | Columbus et al. | 416/223 R |
| 2008/0101958 | A1 * | 5/2008 | Latimer et al. | 416/223 R |
| 2008/0101959 | A1 * | 5/2008 | McRae et al. | 416/223 R |
| 2008/0273970 | A1 * | 11/2008 | Sleiman et al. | 415/208.1 |

* cited by examiner

HIGH LIFT TRANSONIC TURBINE BLADE

BACKGROUND OF THE INVENTION

The present invention relates to turbine blades for turbomachinery such as gas turbine engines and, more particularly, to improved geometrical shapes for such blades and the platform from which they extend.

Turbine blades are mounted circumferentially on an inner diameter platform about a turbine shaft to allow rotation thereof in streams of working medium fluids to extract energy and work therefrom as those fluids flow around and past such blades through the flow passages between them. Such flows can be transonic in accelerating from below the speed of sound coming into the blade region to being above the speed of sound in the exit region. In these situations inefficiencies due to shock wave losses are important.

Blade airfoil surface profiles and the geometry of the airfoil and the platform on which the blade is mounted become very important in achieving high efficiencies. In addition, a blade design to be suitable must minimize the penalties imposed on the engine system by the weight and cost of the blades, and need for cooling air therein, a goal sought through reducing the number of blades provided about the platform circumference for each blade stage used. However, the remaining blades must then extract more work, the lift or loading of the blade, from the fluid streams passing thereby which tends to reduce blade efficiency. A high lift blade will have a Zweifel lift coefficient (the ratio of the actual load to the ideal load) that is greater than 1.1. Thus, there is a desire for a blade that achieves high efficiency during transonic operation while having a large lift loading.

BRIEF SUMMARY OF THE INVENTION

The present invention provides a turbine blade system including a blade airfoil having an airfoil shape with the blade airfoil having a nominal profile substantially in accordance with normalized Cartesian coordinate values of X, Y and Z set forth in Table 1 below and which values are dimensionless values that are convertible to corresponding absolute distance values through manipulating them in accord with corresponding normalization equations. The X and Y absolute distance values, when connected by smooth continuing arcs, define nominal airfoil profile sections at each Z absolute distance value, and these nominal airfoil profile sections, when joined smoothly with adjacent ones thereof, form a complete nominal airfoil shape that is substantially matched by the airfoil shape of the blade airfoil. This blade airfoil can be supported on a ring platform having a support surface with a support surface shape in the vicinity of the location at which that blade airfoil is supported thereon such that the support surface smoothly joins with the airfoil shape of that blade airfoil, the support surface having a nominal profile substantially in accordance with normalized Cartesian coordinate values of X, Y and Z set forth in Table 4 below and which values are dimensionless values that are convertible to corresponding absolute distance values through manipulating them in accord with corresponding normalization equations, and wherein X and Y absolute distance values at various Z absolute distance values, when connected by smooth continuing arcs, form a nominal support surface shape substantially matched by the support surface shape of the support surface.

DETAILED DESCRIPTION

Figure 1:
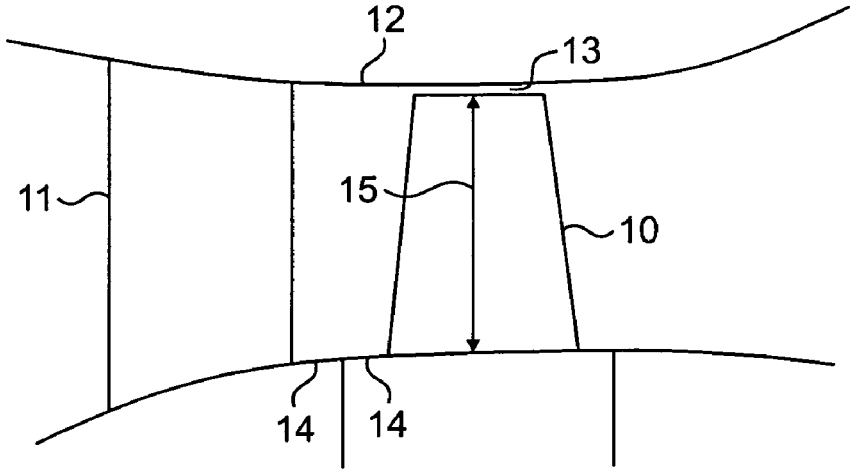
FIG. 1 provides a diagrammatic side view of a blade mounted on a rotatable platform adjacent a fluid guide vane.

FIG. 1 shows the relationship of a blade, 10, mounted on a rotatable platform extending about an unseen turbine shaft adjacent a fluid guide vane, 11. Above them is shown the edge of the engine wall limiting the outer extent of the fluid flow path past blade 10 and vane 11, that is, forming the outer diameter, 12, of this fluid flow passage containing blade 10 and vane 11. Rotatable blade 10 has a gap, 13, between the tip of that blade and outer diameter 12 but vane 11 is fixed to the structure providing this fluid flow passageway outer diameter as well as to the structure supporting it from below. That vane supporting structure and the platform on which blade 10 is mounted together limit the inner extent of the fluid flow path past blade 10 and vane 11, that is, forming the inner diameter, 12, of this fluid flow passage containing blade 10 and vane 11. Blade 10 is shown having an outward extent from the platform on which it is mounted to its tip designated as its span, 15.

Figure 2:
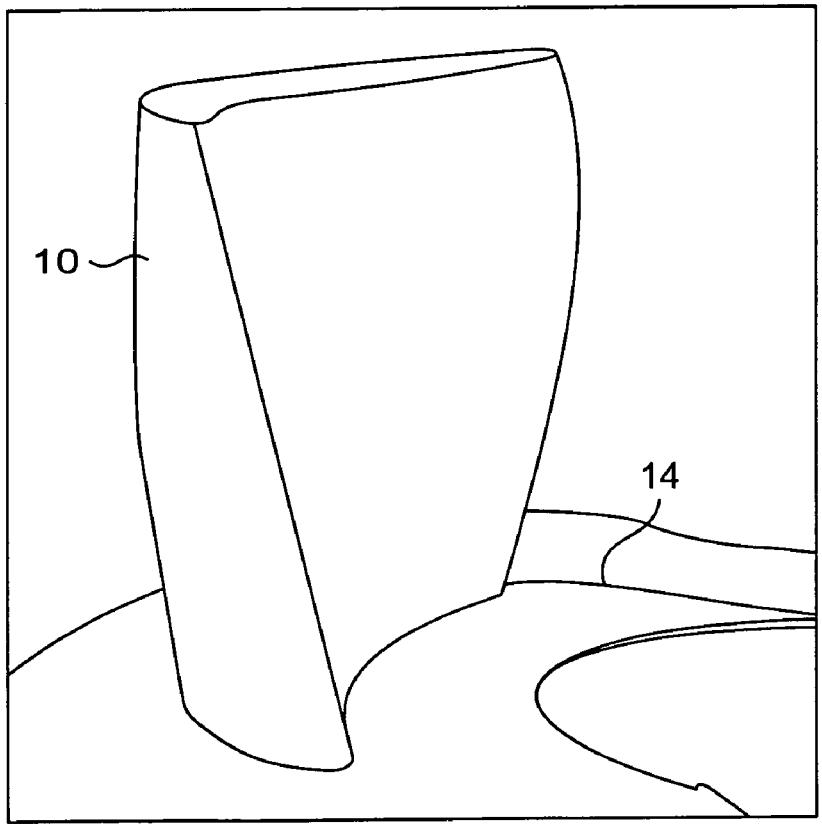
FIG. 2 shows a pictorial perspective view of the turbine blade embodying the present invention.
Figure 3:
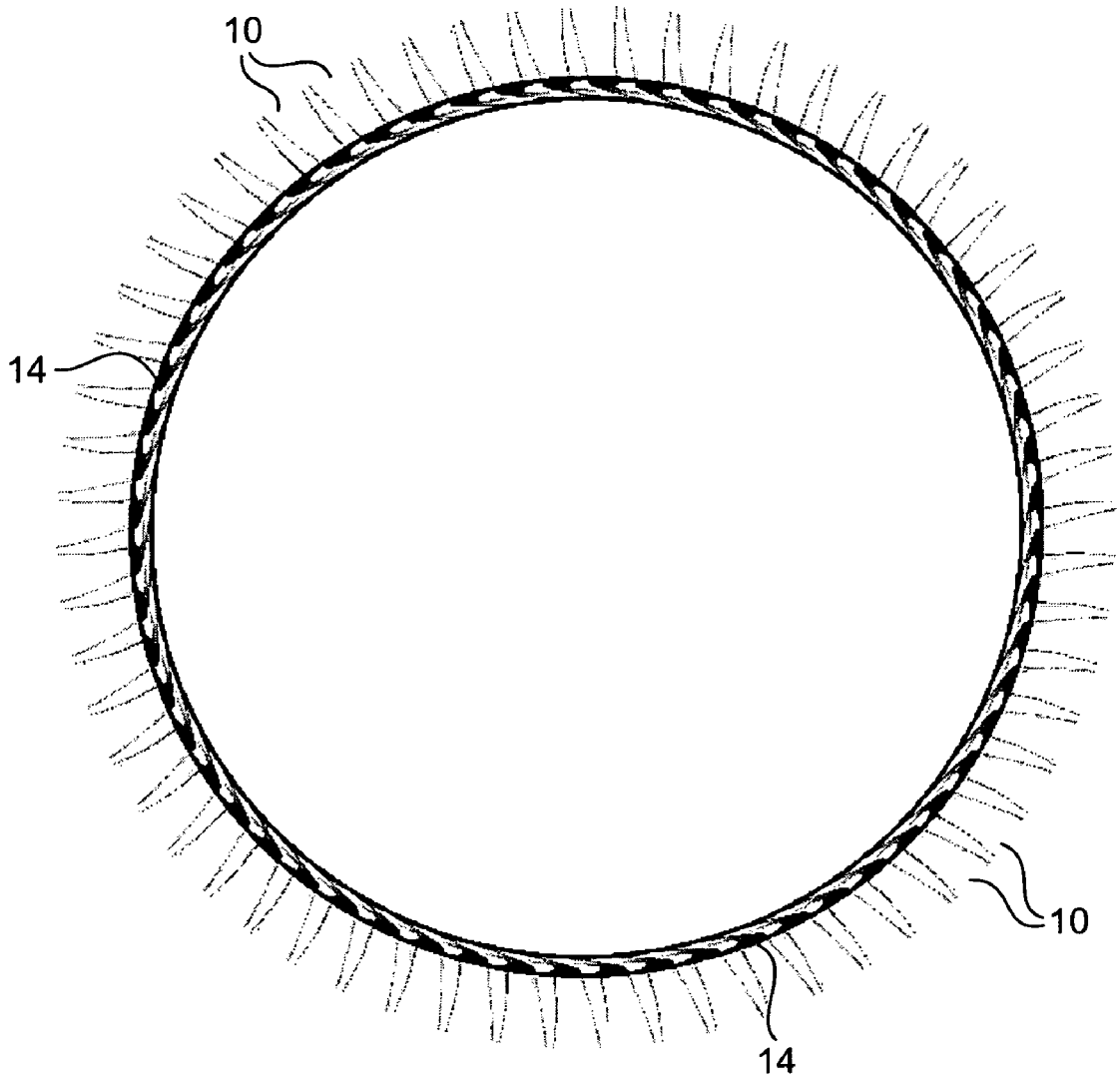
FIG. 3 shows a side pictorial view of a platform ring stage having blades like that of FIG. 2 mounted thereon as an embodiment of the present invention.

Blade 10 and the inner diameter 12 surface of the platform on which blade 10 is mounted of the present invention are shown in the pictorial perspective view of FIG. 2, and a plurality of blades 10 so mounted are shown in FIG. 3 circumferentially positioned about the rotatable ring platform supporting them on which the inner diameter surface 14 of the fluid passageway is indicated. Sixty such blades are so provided on the ring platform example shown in FIG. 3. In addition to what is shown in FIGS. 2 and 3, blades 10 can be positioned through being selectively rotated about a radial axis extending outward from the engine centerline from what is shown by up to about ±10°.

Figure 4:
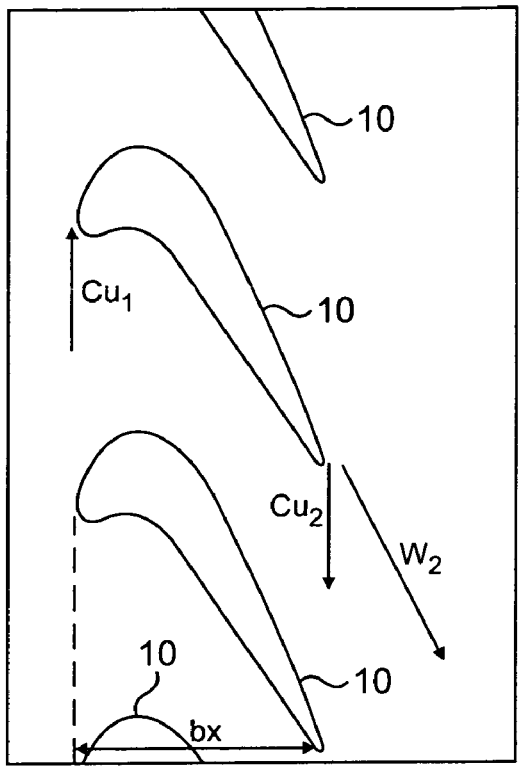
FIG. 4 shows a diagrammatic top view of a portion of FIG. 3 marked with certain variables.

FIG. 4 shows a diagrammatic top view of a portion of the platform ring in FIG. 3 with certain variables marked thereon used in calculating the Zweifel lift coefficient for blades 10. The Zweifel lift coefficient is defined as the ratio of the actual load and the ideal load, and is given by:

$$\text{Zweifel}=[(1/g)*\dot{m}*\Delta Cu]/[0.5*\rho*W_2\hat{}2*bx*h]$$

where:

g=acceleration due to gravity of 32.2 ft/s$^2$ $\dot{m}$=mass flow (lbm/s)

$\Delta Cu=Cu_2-Cu_1$=change in tangential velocity across the blade (ft/s)

ρ=density (lbm-s$^2$/ft$^4$)

$W_2$=exit relative velocity (ft/s)

bx=axial chord (ft)

h=span (ft)

Figure 5:
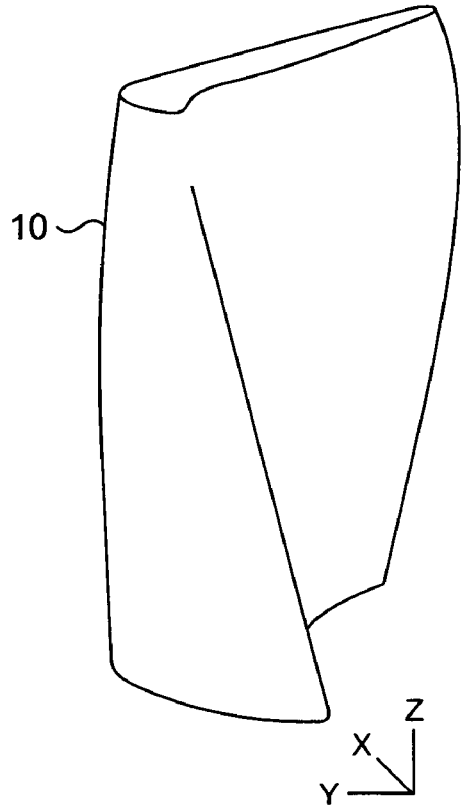
FIG. 5 shows a perspective diagram of the blade of FIG. 2 that is shown with corresponding three-dimensional coordinate axes.
Figure 6:
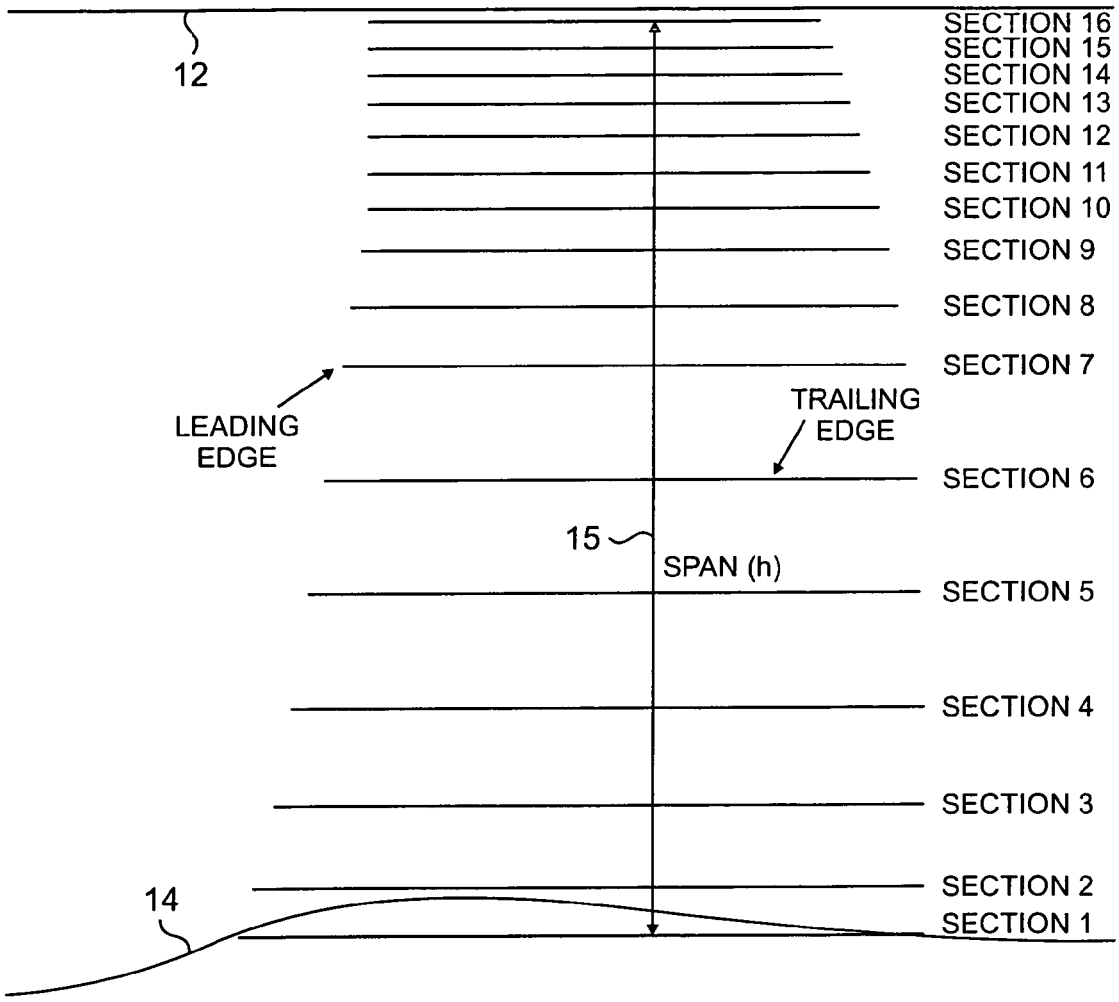
FIG. 6 shows a diagrammatic side view of the blade of FIG. 2 marked with a plurality of sectioning lines arrayed along with a corresponding one of the coordinate dimensional axis from FIG. 5.
Figure 7:
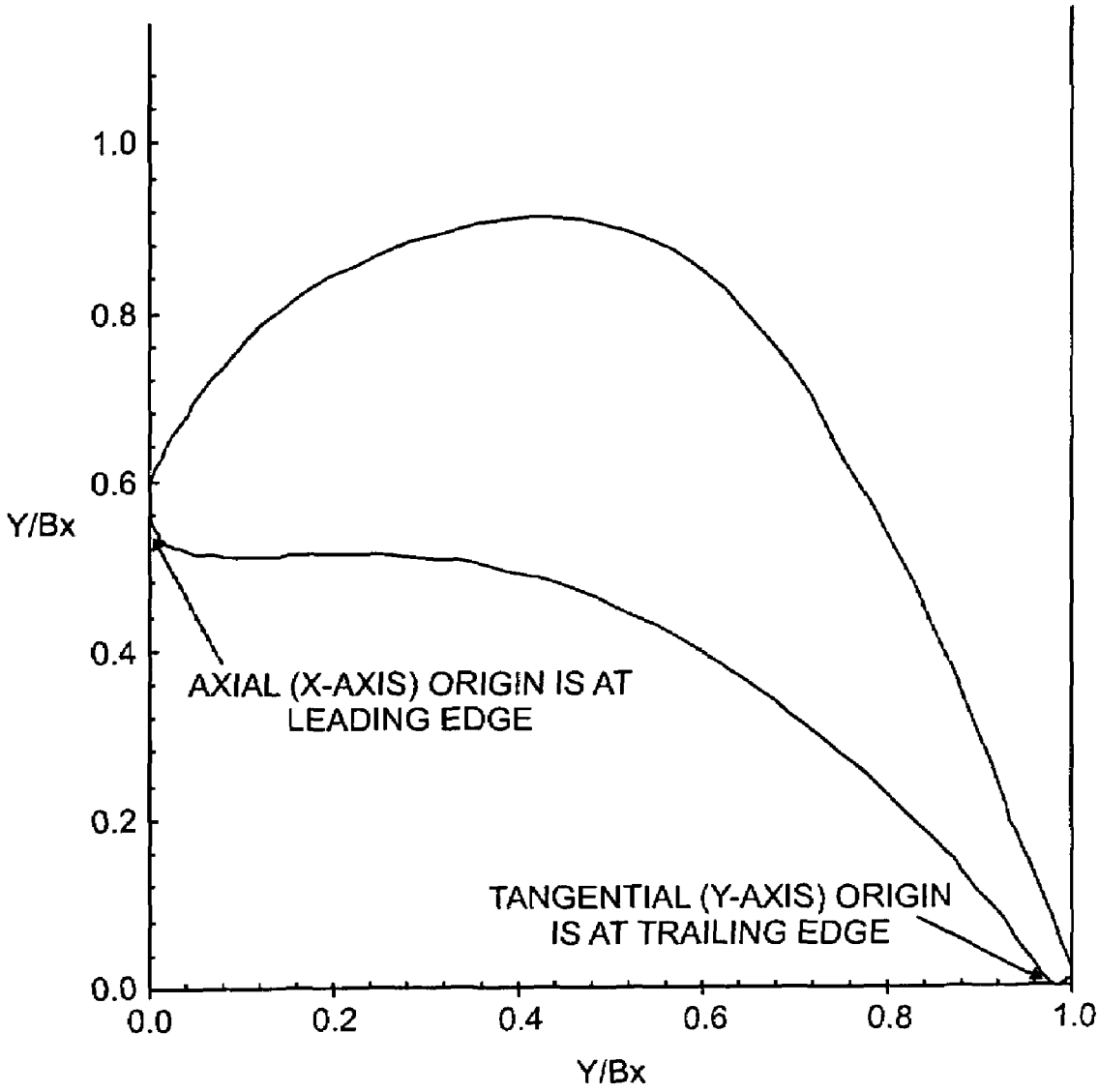
FIG. 7 shows a typical blade cross section view of the blade of FIG. 2 for a section of that blade designated in FIG. 6 that is shown with two of the corresponding two dimensional coordinates axes from FIG. 5.

A perspective diagram of the blade of FIG. 2 is shown in FIG. 5 with the three dimensional coordinates, X, Y and Z, of a Cartesian coordinate system shown that will be used in providing a description of the geometry of the blade, and surface of the platform supporting that blade, that is, a description of the shapes involved. The shape of blade 10 of the present invention can be specified using an outwardly stacked, or radially stacked, series of cross section portions of that blade, stacked along its span 15 extending outward from the ring center as indicated in FIG. 6, with the radial axis extending perpendicular to the engine centerline (and so the platform ring centerline) being designated the Z axis shown in FIG. 5. The remaining two axes in this coordinate system, the X and the Y axes, are used to specify the shape of a stack section in a cross section plane as indicated in FIG. 7 with the X axis being in the axial direction extending parallel to the engine centerline and with the Y axis being in the tangential direction that is tangential to the ring platform and parallel to a direction of blade rotation at a point. The radially stacked sections so specified are to be smoothly joined together in providing a complete surface for a blade 10. The inner diameter 14 surface of the flow passageway between the blades is also contoured as specified here and smoothly joined with each corresponding one of blades 10.

Some definitions of terms used in the description include the leading edge as blade or airfoil point farthest toward the forward direction of the engine and the trailing edge as blade or airfoil point farthest toward the rearward from the forward direction of the engine. The axial chord of a blade or airfoil is the axial distance between the leading and trailing edges thereof. The pitch is the tangential distance between adjacent blades or airfoils mounted on the platform ring. The root, or inner diameter (ID) section of the blade or airfoil is the section thereof closest to the engine centerline, and the tip, or outer diameter (OD) section is the section thereof farthest form the engine centerline. The root radius is the radial distance from the engine centerline to the root section.

In addition, there are some normalization parameters used in normalization equations given below for use in converting normalized blade or airfoil surface coordinates for sections of the blade given in the tables below to absolute blade or airfoil coordinates to selectively scale such blades to the various sizes suited for various sized corresponding turbine engines. The blade root axial chord normalization parameter represented as $Bx_{root}$ has a normalization parameter value of 1.155630 in. The blade span (form the ID section to the OD section) represented as h, as above, has a normalization parameter value of 1.905000 in. The blade root pitch represented as $Pitch_{root}$ has a normalization parameter value of 1.081550 in., as determined through the platform ring radius and the number of blades selected to be mounted thereon, and the blade root radius represented as $R_{root}$ has a normalization parameter value of 10.328000 in.

Figure 8:
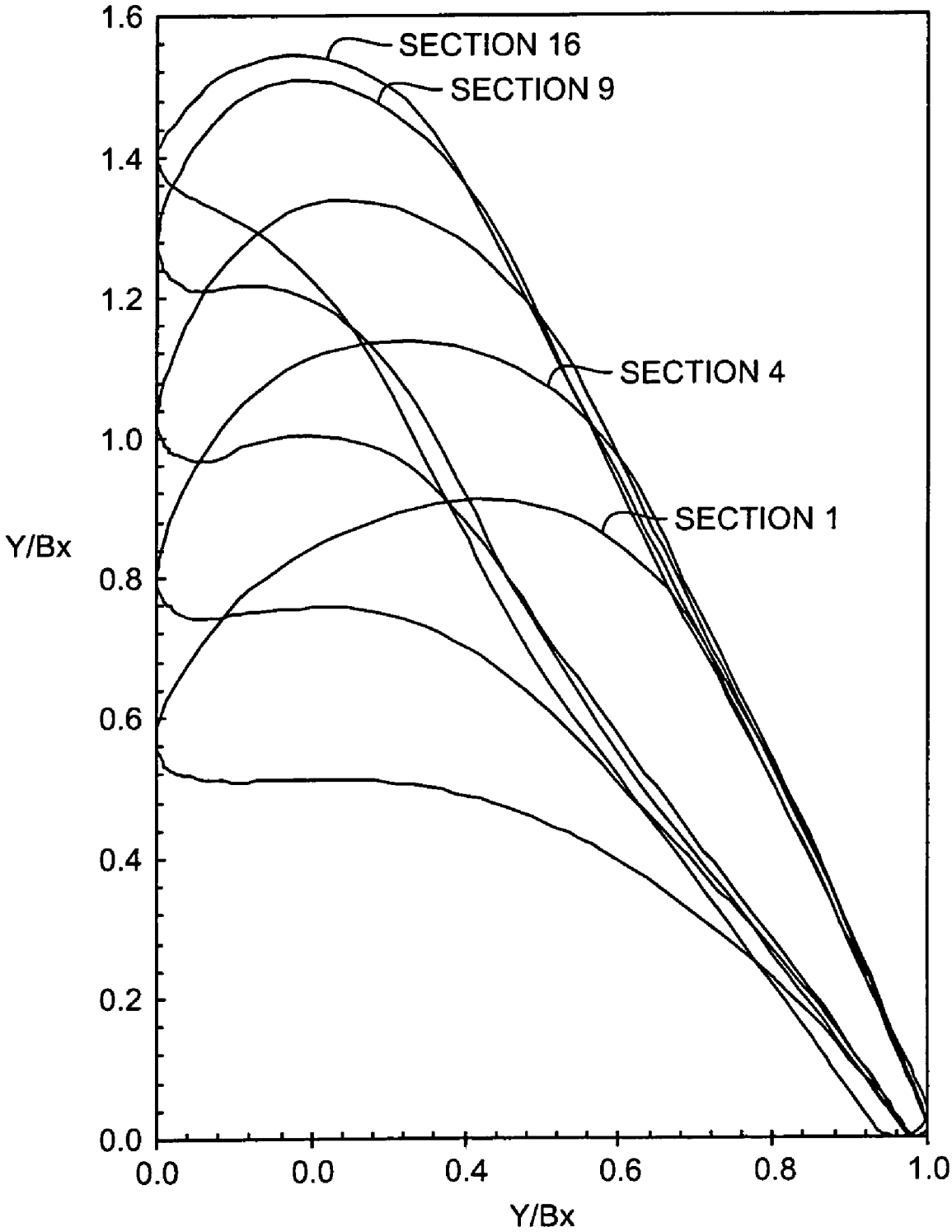
FIG. 8 shows a plurality of blade cross section views of the blade of FIG. 2 for sections of that blade designated in FIG. 6 as the sections selected ascend from the blade mounting platform.

Table 1, Airfoil Surface (Normalized), tabulates the normalized section cold, uncoated airfoil surface coordinates for the 16 airfoil sections indicated in FIG. 6 that describe the three dimensional shape of blade or airfoil 10 with a surface profile tolerance of ±0.0500 in. including coating and manufacturing variability. Each of these sections is normalized by its own axial chord (Bx). The coordinates are arranged such that they start at the leading edge, traverse clockwise around the airfoil on the convex surface to the trailing edge, and then continue on the concave surface of the section back to the leading edge. The span fraction z/h ranges from the root section of 0.0 to the tip (or outer diameter) section of 1.0. These coordinates can be translated to absolute coordinates using the root axial chord ($BX_{root}$) along with the values in Table 2, Axial Chord Distribution, and Table 3, Radial Stacking Distribution, set out below. FIG. 8 shows a plurality of blade cross section views from the Table 1 defined sections 1, 4, 6, 9 and 16.

TABLE 1

| Airfoil Surface (Normalized) | | |
|---|---|---|
| X/Bx | Y/Bx | Span Fraction |
| | Section 1 | |
| 0.000000 | 0.570139 | 0.000000 |
| 0.000597 | 0.586044 | 0.000000 |
| 0.004664 | 0.605055 | 0.000000 |
| 0.012824 | 0.626541 | 0.000000 |
| 0.024497 | 0.650347 | 0.000000 |
| 0.039078 | 0.676627 | 0.000000 |
| 0.056956 | 0.705061 | 0.000000 |
| 0.078537 | 0.735270 | 0.000000 |
| 0.104705 | 0.766396 | 0.000000 |
| 0.136333 | 0.797253 | 0.000000 |
| 0.172711 | 0.825342 | 0.000000 |
| 0.215129 | 0.850852 | 0.000000 |
| 0.261537 | 0.872650 | 0.000000 |
| 0.309693 | 0.890233 | 0.000000 |
| 0.360911 | 0.903992 | 0.000000 |
| 0.413471 | 0.911044 | 0.000000 |
| 0.466456 | 0.908820 | 0.000000 |
| 0.517761 | 0.895382 | 0.000000 |
| 0.565025 | 0.871317 | 0.000000 |
| 0.607279 | 0.839274 | 0.000000 |
| 0.644687 | 0.801684 | 0.000000 |
| 0.677431 | 0.759966 | 0.000000 |
| 0.705840 | 0.715177 | 0.000000 |
| 0.730666 | 0.668319 | 0.000000 |
| 0.754714 | 0.621055 | 0.000000 |
| 0.779384 | 0.574102 | 0.000000 |
| 0.803847 | 0.527055 | 0.000000 |
| 0.826908 | 0.479288 | 0.000000 |
| 0.847339 | 0.432275 | 0.000000 |
| 0.866402 | 0.384682 | 0.000000 |
| 0.883951 | 0.338396 | 0.000000 |
| 0.899873 | 0.295285 | 0.000000 |
| 0.915016 | 0.253766 | 0.000000 |
| 0.928853 | 0.215536 | 0.000000 |
| 0.941452 | 0.180611 | 0.000000 |
| 0.952831 | 0.149010 | 0.000000 |
| 0.963007 | 0.120731 | 0.000000 |
| 0.971989 | 0.095783 | 0.000000 |
| 0.979769 | 0.074159 | 0.000000 |
| 0.986354 | 0.055866 | 0.000000 |
| 0.991745 | 0.040895 | 0.000000 |
| 0.995933 | 0.029248 | 0.000000 |
| 0.998927 | 0.020932 | 0.000000 |
| 1.000000 | 0.013940 | 0.000000 |
| 0.998667 | 0.008809 | 0.000000 |
| 0.996824 | 0.005789 | 0.000000 |
| 0.994332 | 0.003288 | 0.000000 |
| 0.992887 | 0.002267 | 0.000000 |
| 0.991338 | 0.001428 | 0.000000 |
| 0.989131 | 0.000597 | 0.000000 |
| 0.986830 | 0.000112 | 0.000000 |
| 0.984476 | 0.000000 | 0.000000 |
| 0.980980 | 0.000511 | 0.000000 |
| 0.990248 | 0.000969 | 0.000000 |
| 0.976679 | 0.002432 | 0.000000 |
| 0.972457 | 0.006525 | 0.000000 |
| 0.968225 | 0.013594 | 0.000000 |
| 0.962722 | 0.022654 | 0.000000 |
| 0.955851 | 0.033627 | 0.000000 |
| 0.947526 | 0.046468 | 0.000000 |
| 0.937644 | 0.061101 | 0.000000 |
| 0.926092 | 0.077438 | 0.000000 |

TABLE 1-continued

| Airfoil Surface (Normalized) | | |
|---|---|---|
| X/Bx | Y/Bx | Span Fraction |
| 0.912853 | 0.095472 | 0.000000 |
| 0.897900 | 0.115158 | 0.000000 |
| 0.881095 | 0.136384 | 0.000000 |
| 0.862421 | 0.159134 | 0.000000 |
| 0.842614 | 0.182472 | 0.000000 |
| 0.820462 | 0.206874 | 0.000000 |
| 0.796708 | 0.231389 | 0.000000 |
| 0.772410 | 0.255367 | 0.000000 |
| 0.746787 | 0.279674 | 0.000000 |
| 0.720430 | 0.303177 | 0.000000 |
| 0.693319 | 0.325805 | 0.000000 |
| 0.665715 | 0.347845 | 0.000000 |
| 0.637531 | 0.369123 | 0.000000 |
| 0.608586 | 0.389363 | 0.000000 |
| 0.578957 | 0.408582 | 0.000000 |
| 0.548688 | 0.426772 | 0.000000 |
| 0.517657 | 0.443628 | 0.000000 |
| 0.485804 | 0.458875 | 0.000000 |
| 0.453138 | 0.472288 | 0.000000 |
| 0.419745 | 0.483788 | 0.000000 |
| 0.385729 | 0.493289 | 0.000000 |
| 0.351211 | 0.500749 | 0.000000 |
| 0.317550 | 0.506451 | 0.000000 |
| 0.283663 | 0.510570 | 0.000000 |
| 0.250772 | 0.512690 | 0.000000 |
| 0.220166 | 0.513019 | 0.000000 |
| 0.190736 | 0.512465 | 0.000000 |
| 0.163686 | 0.511392 | 0.000000 |
| 0.139006 | 0.509904 | 0.000000 |
| 0.116681 | 0.508562 | 0.000000 |
| 0.096675 | 0.508554 | 0.000000 |
| 0.079074 | 0.510016 | 0.000000 |
| 0.063913 | 0.512110 | 0.000000 |
| 0.051141 | 0.514265 | 0.000000 |
| 0.040774 | 0.516428 | 0.000000 |
| 0.032831 | 0.518618 | 0.000000 |
| 0.027318 | 0.520686 | 0.000000 |
| 0.023113 | 0.522814 | 0.000000 |
| 0.020145 | 0.524718 | 0.000000 |
| 0.018267 | 0.526137 | 0.000000 |
| 0.016493 | 0.527686 | 0.000000 |
| 0.015636 | 0.528500 | 0.000000 |
| 0.013629 | 0.530654 | 0.000000 |
| 0.012521 | 0.532030 | 0.000000 |
| 0.010496 | 0.534929 | 0.000000 |
| 0.008705 | 0.537975 | 0.000000 |
| 0.006377 | 0.542734 | 0.000000 |
| 0.003790 | 0.549319 | 0.000000 |
| 0.001506 | 0.557860 | 0.000000 |
| 0.000000 | 0.570139 | 0.000000 |
| | Section 2 | |
| 0.000000 | 0.619250 | 0.053543 |
| 0.000761 | 0.635521 | 0.053543 |
| 0.004495 | 0.655085 | 0.053543 |
| 0.011954 | 0.677408 | 0.053543 |
| 0.022934 | 0.702245 | 0.053543 |
| 0.036861 | 0.729691 | 0.053543 |
| 0.053929 | 0.759563 | 0.053543 |
| 0.074580 | 0.791486 | 0.053543 |
| 0.100266 | 0.824260 | 0.053543 |
| 0.132287 | 0.856254 | 0.053543 |
| 0.169626 | 0.884913 | 0.053543 |
| 0.213185 | 0.910847 | 0.053543 |
| 0.261045 | 0.932436 | 0.053543 |
| 0.311089 | 0.948301 | 0.053543 |
| 0.364496 | 0.958237 | 0.053543 |
| 0.418779 | 0.960078 | 0.053543 |
| 0.472513 | 0.952150 | 0.053543 |
| 0.523487 | 0.933409 | 0.053543 |
| 0.569541 | 0.904618 | 0.053543 |
| 0.609880 | 0.868252 | 0.053543 |
| 0.644803 | 0.826649 | 0.053543 |
| 0.675117 | 0.781585 | 0.053543 |

TABLE 1-continued

| Airfoil Surface (Normalized) | | |
|---|---|---|
| X/Bx | Y/Bx | Span Fraction |
| 0.701944 | 0.734354 | 0.053543 |
| 0.726241 | 0.685778 | 0.053543 |
| 0.750139 | 0.637008 | 0.053543 |
| 0.774604 | 0.588512 | 0.053543 |
| 0.798901 | 0.539936 | 0.053543 |
| 0.822012 | 0.490785 | 0.053543 |
| 0.842761 | 0.442554 | 0.053543 |
| 0.862297 | 0.393819 | 0.053543 |
| 0.880401 | 0.346484 | 0.053543 |
| 0.896876 | 0.302365 | 0.053543 |
| 0.912528 | 0.259903 | 0.053543 |
| 0.926818 | 0.220786 | 0.053543 |
| 0.939807 | 0.185049 | 0.053543 |
| 0.951495 | 0.152700 | 0.053543 |
| 0.961927 | 0.123740 | 0.053543 |
| 0.971102 | 0.098187 | 0.053543 |
| 0.979048 | 0.076031 | 0.053543 |
| 0.985772 | 0.057282 | 0.053543 |
| 0.991276 | 0.041949 | 0.053543 |
| 0.995541 | 0.030013 | 0.053543 |
| 0.998593 | 0.021492 | 0.053543 |
| 1.000000 | 0.014387 | 0.053543 |
| 0.998841 | 0.009078 | 0.053543 |
| 0.997036 | 0.005937 | 0.053543 |
| 0.994523 | 0.003327 | 0.053543 |
| 0.993054 | 0.002274 | 0.053543 |
| 0.991462 | 0.001407 | 0.053543 |
| 0.990356 | 0.000938 | 0.053543 |
| 0.989214 | 0.000566 | 0.053543 |
| 0.986852 | 0.000088 | 0.053543 |
| 0.984445 | 0.000000 | 0.053543 |
| 0.980888 | 0.000602 | 0.053543 |
| 0.976553 | 0.002699 | 0.053543 |
| 0.972447 | 0.007105 | 0.053543 |
| 0.968103 | 0.014325 | 0.053543 |
| 0.962493 | 0.023598 | 0.053543 |
| 0.955538 | 0.034861 | 0.053543 |
| 0.947186 | 0.048098 | 0.053543 |
| 0.937365 | 0.063255 | 0.053543 |
| 0.925986 | 0.080261 | 0.053543 |
| 0.912864 | 0.098992 | 0.053543 |
| 0.897884 | 0.119360 | 0.053543 |
| 0.881073 | 0.141366 | 0.053543 |
| 0.862439 | 0.164999 | 0.053543 |
| 0.842805 | 0.189375 | 0.053543 |
| 0.820968 | 0.215052 | 0.053543 |
| 0.797565 | 0.240951 | 0.053543 |
| 0.773419 | 0.266168 | 0.053543 |
| 0.747750 | 0.291579 | 0.053543 |
| 0.721410 | 0.316283 | 0.053543 |
| 0.694432 | 0.340288 | 0.053543 |
| 0.667144 | 0.363948 | 0.053543 |
| 0.639538 | 0.387245 | 0.053543 |
| 0.611340 | 0.409807 | 0.053543 |
| 0.582575 | 0.431644 | 0.053543 |
| 0.553314 | 0.452818 | 0.053543 |
| 0.523337 | 0.472947 | 0.053543 |
| 0.492360 | 0.491519 | 0.053543 |
| 0.460339 | 0.508224 | 0.053543 |
| 0.427406 | 0.523054 | 0.053543 |
| 0.393589 | 0.535715 | 0.053543 |
| 0.358913 | 0.545820 | 0.053543 |
| 0.324813 | 0.553305 | 0.053543 |
| 0.290314 | 0.558641 | 0.053543 |
| 0.256736 | 0.561658 | 0.053543 |
| 0.225449 | 0.562472 | 0.053543 |
| 0.195357 | 0.561764 | 0.053543 |
| 0.167706 | 0.560339 | 0.053543 |
| 0.142480 | 0.558773 | 0.053543 |
| 0.119626 | 0.557756 | 0.053543 |
| 0.099160 | 0.557862 | 0.053543 |
| 0.081137 | 0.558933 | 0.053543 |
| 0.065529 | 0.560109 | 0.053543 |
| 0.052372 | 0.561622 | 0.053543 |

TABLE 1-continued

| Airfoil Surface (Normalized) | | |
|---|---|---|
| X/Bx | Y/Bx | Span Fraction |
| 0.041763 | 0.563826 | 0.053543 |
| 0.033738 | 0.566383 | 0.053543 |
| 0.028208 | 0.568754 | 0.053543 |
| 0.023969 | 0.571054 | 0.053543 |
| 0.020943 | 0.573019 | 0.053543 |
| 0.019015 | 0.574461 | 0.053543 |
| 0.017174 | 0.576018 | 0.053543 |
| 0.016289 | 0.576823 | 0.053543 |
| 0.014192 | 0.578991 | 0.053543 |
| 0.013016 | 0.580371 | 0.053543 |
| 0.010865 | 0.583282 | 0.053543 |
| 0.008954 | 0.586362 | 0.053543 |
| 0.006459 | 0.591184 | 0.053543 |
| 0.003769 | 0.597908 | 0.053543 |
| 0.001433 | 0.606650 | 0.053543 |
| 0.000000 | 0.619250 | 0.053543 |
| | Section 3 | |
| 0.000000 | 0.702504 | 0.142782 |
| 0.001098 | 0.719381 | 0.142782 |
| 0.004610 | 0.739743 | 0.142782 |
| 0.011279 | 0.763234 | 0.142782 |
| 0.021360 | 0.789543 | 0.142782 |
| 0.034440 | 0.818677 | 0.142782 |
| 0.050522 | 0.850538 | 0.142782 |
| 0.070162 | 0.884759 | 0.142782 |
| 0.095409 | 0.919822 | 0.142782 |
| 0.128047 | 0.953585 | 0.142782 |
| 0.166933 | 0.983141 | 0.142782 |
| 0.212763 | 1.008946 | 0.142782 |
| 0.263577 | 1.028586 | 0.142782 |
| 0.316862 | 1.039956 | 0.142782 |
| 0.373165 | 1.042371 | 0.142782 |
| 0.429029 | 1.034934 | 0.142782 |
| 0.482597 | 1.017426 | 0.142782 |
| 0.531875 | 0.990093 | 0.142782 |
| 0.575152 | 0.953988 | 0.142782 |
| 0.611989 | 0.911342 | 0.142782 |
| 0.642999 | 0.864287 | 0.142782 |
| 0.669874 | 0.814753 | 0.142782 |
| 0.694628 | 0.764122 | 0.142782 |
| 0.718329 | 0.712987 | 0.142782 |
| 0.742113 | 0.661898 | 0.142782 |
| 0.766363 | 0.611028 | 0.142782 |
| 0.790521 | 0.560113 | 0.142782 |
| 0.813875 | 0.508823 | 0.142782 |
| 0.835271 | 0.458722 | 0.142782 |
| 0.855734 | 0.408236 | 0.142782 |
| 0.874852 | 0.359233 | 0.142782 |
| 0.892269 | 0.313605 | 0.142782 |
| 0.908781 | 0.269642 | 0.142782 |
| 0.923801 | 0.229128 | 0.142782 |
| 0.937385 | 0.192089 | 0.142782 |
| 0.949570 | 0.158545 | 0.142782 |
| 0.960400 | 0.128505 | 0.142782 |
| 0.969868 | 0.101958 | 0.142782 |
| 0.978055 | 0.078952 | 0.142782 |
| 0.984971 | 0.059477 | 0.142782 |
| 0.990633 | 0.043551 | 0.142782 |
| 0.995015 | 0.031157 | 0.142782 |
| 0.998143 | 0.022302 | 0.142782 |
| 1.000000 | 0.015011 | 0.142782 |
| 0.999122 | 0.009449 | 0.142782 |
| 0.997375 | 0.006129 | 0.142782 |
| 0.994832 | 0.003357 | 0.142782 |
| 0.993313 | 0.002241 | 0.142782 |
| 0.991667 | 0.001345 | 0.142782 |
| 0.990514 | 0.000851 | 0.142782 |
| 0.989316 | 0.000476 | 0.142782 |
| 0.986846 | 0.000018 | 0.142782 |
| 0.984339 | 0.000000 | 0.142782 |
| 0.980653 | 0.000778 | 0.142782 |
| 0.976271 | 0.003238 | 0.142782 |
| 0.972365 | 0.008141 | 0.142782 |

TABLE 1-continued

| Airfoil Surface (Normalized) | | |
|---|---|---|
| X/Bx | Y/Bx | Span Fraction |
| 0.967837 | 0.015670 | 0.142782 |
| 0.962019 | 0.025357 | 0.142782 |
| 0.954884 | 0.037176 | 0.142782 |
| 0.946395 | 0.051107 | 0.142782 |
| 0.936544 | 0.067161 | 0.142782 |
| 0.925265 | 0.085273 | 0.142782 |
| 0.912193 | 0.105215 | 0.142782 |
| 0.897127 | 0.126849 | 0.142782 |
| 0.880231 | 0.150248 | 0.142782 |
| 0.861552 | 0.175468 | 0.142782 |
| 0.841985 | 0.201584 | 0.142782 |
| 0.820379 | 0.229301 | 0.142782 |
| 0.797281 | 0.257430 | 0.142782 |
| 0.773278 | 0.284800 | 0.142782 |
| 0.747601 | 0.312343 | 0.142782 |
| 0.721357 | 0.339346 | 0.142782 |
| 0.694664 | 0.365902 | 0.142782 |
| 0.667908 | 0.392402 | 0.142782 |
| 0.641206 | 0.418957 | 0.142782 |
| 0.614184 | 0.445174 | 0.142782 |
| 0.586806 | 0.471034 | 0.142782 |
| 0.559226 | 0.496666 | 0.142782 |
| 0.531097 | 0.521693 | 0.142782 |
| 0.501816 | 0.545367 | 0.142782 |
| 0.471263 | 0.567385 | 0.142782 |
| 0.439594 | 0.587748 | 0.142782 |
| 0.406581 | 0.605860 | 0.142782 |
| 0.372067 | 0.620926 | 0.142782 |
| 0.337499 | 0.632324 | 0.142782 |
| 0.302107 | 0.640831 | 0.142782 |
| 0.267392 | 0.646310 | 0.142782 |
| 0.234836 | 0.648588 | 0.142782 |
| 0.203460 | 0.648122 | 0.142782 |
| 0.174654 | 0.646301 | 0.142782 |
| 0.148364 | 0.644380 | 0.142782 |
| 0.124544 | 0.643218 | 0.142782 |
| 0.103212 | 0.642651 | 0.142782 |
| 0.084386 | 0.642423 | 0.142782 |
| 0.068076 | 0.641892 | 0.142782 |
| 0.054282 | 0.642340 | 0.142782 |
| 0.043186 | 0.644472 | 0.142782 |
| 0.034907 | 0.647417 | 0.142782 |
| 0.029263 | 0.650152 | 0.142782 |
| 0.024918 | 0.652677 | 0.142782 |
| 0.021771 | 0.654754 | 0.142782 |
| 0.019759 | 0.656235 | 0.142782 |
| 0.017819 | 0.657836 | 0.142782 |
| 0.016877 | 0.658669 | 0.142782 |
| 0.014664 | 0.660882 | 0.142782 |
| 0.013410 | 0.662282 | 0.142782 |
| 0.011087 | 0.665237 | 0.142782 |
| 0.009029 | 0.668383 | 0.142782 |
| 0.006358 | 0.673341 | 0.142782 |
| 0.003568 | 0.680321 | 0.142782 |
| 0.001235 | 0.689414 | 0.142782 |
| 0.000000 | 0.702504 | 0.142782 |
| | Section 4 | |
| 0.000000 | 0.803080 | 0.249869 |
| 0.001579 | 0.820563 | 0.249869 |
| 0.005418 | 0.841666 | 0.249869 |
| 0.011819 | 0.866193 | 0.249869 |
| 0.021312 | 0.893867 | 0.249869 |
| 0.033811 | 0.924568 | 0.249869 |
| 0.049440 | 0.958162 | 0.249869 |
| 0.068946 | 0.994166 | 0.249869 |
| 0.094380 | 1.031116 | 0.249869 |
| 0.127737 | 1.066667 | 0.249869 |
| 0.168309 | 1.097065 | 0.249869 |
| 0.217305 | 1.121185 | 0.249869 |
| 0.272021 | 1.135462 | 0.249869 |
| 0.328505 | 1.138317 | 0.249869 |
| 0.386341 | 1.129524 | 0.249869 |
| 0.441568 | 1.110227 | 0.249869 |

TABLE 1-continued

| Airfoil Surface (Normalized) | | |
|---|---|---|
| X/Bx | Y/Bx | Span Fraction |
| 0.492625 | 1.081663 | 0.249869 |
| 0.538217 | 1.045006 | 0.249869 |
| 0.577276 | 1.001447 | 0.249869 |
| 0.609971 | 0.952933 | 0.249869 |
| 0.637353 | 0.901233 | 0.249869 |
| 0.661643 | 0.848011 | 0.249869 |
| 0.685035 | 0.794391 | 0.249869 |
| 0.708474 | 0.740791 | 0.249869 |
| 0.732347 | 0.687379 | 0.249869 |
| 0.756581 | 0.634129 | 0.249869 |
| 0.780804 | 0.580878 | 0.249869 |
| 0.804603 | 0.527429 | 0.249869 |
| 0.826935 | 0.475474 | 0.249869 |
| 0.848663 | 0.423263 | 0.249869 |
| 0.869124 | 0.372641 | 0.249869 |
| 0.887693 | 0.325460 | 0.249869 |
| 0.905185 | 0.279953 | 0.249869 |
| 0.920994 | 0.237983 | 0.249869 |
| 0.935214 | 0.199576 | 0.249869 |
| 0.947903 | 0.164763 | 0.249869 |
| 0.959117 | 0.133571 | 0.249869 |
| 0.968884 | 0.106000 | 0.249869 |
| 0.977280 | 0.082079 | 0.249869 |
| 0.984333 | 0.061817 | 0.249869 |
| 0.990101 | 0.045242 | 0.249869 |
| 0.994592 | 0.032346 | 0.249869 |
| 0.997797 | 0.023146 | 0.249869 |
| 1.000000 | 0.015658 | 0.249869 |
| 0.999404 | 0.009843 | 0.249869 |
| 0.997712 | 0.006325 | 0.249869 |
| 0.995131 | 0.003404 | 0.249869 |
| 0.993571 | 0.002231 | 0.249869 |
| 0.991859 | 0.001295 | 0.249869 |
| 0.990640 | 0.000794 | 0.249869 |
| 0.989363 | 0.000407 | 0.249869 |
| 0.986744 | 0.000000 | 0.249869 |
| 0.984097 | 0.000085 | 0.249869 |
| 0.980248 | 0.001135 | 0.249869 |
| 0.975861 | 0.004113 | 0.249869 |
| 0.972098 | 0.009578 | 0.249869 |
| 0.967371 | 0.017577 | 0.249869 |
| 0.961291 | 0.027845 | 0.249869 |
| 0.953860 | 0.040411 | 0.249869 |
| 0.945076 | 0.055265 | 0.249869 |
| 0.934950 | 0.072397 | 0.249869 |
| 0.923443 | 0.091799 | 0.249869 |
| 0.910177 | 0.113233 | 0.249869 |
| 0.894917 | 0.136540 | 0.249869 |
| 0.877785 | 0.161804 | 0.249869 |
| 0.858884 | 0.189062 | 0.249869 |
| 0.839028 | 0.217276 | 0.249869 |
| 0.817102 | 0.247268 | 0.249869 |
| 0.793833 | 0.277911 | 0.249869 |
| 0.769808 | 0.307969 | 0.249869 |
| 0.744261 | 0.338499 | 0.249869 |
| 0.718345 | 0.368708 | 0.249869 |
| 0.692173 | 0.398699 | 0.249869 |
| 0.666077 | 0.428766 | 0.249869 |
| 0.640237 | 0.459050 | 0.249869 |
| 0.614283 | 0.489231 | 0.249869 |
| 0.588196 | 0.519298 | 0.249869 |
| 0.562176 | 0.549421 | 0.249869 |
| 0.535882 | 0.579309 | 0.249869 |
| 0.508547 | 0.608241 | 0.249869 |
| 0.480088 | 0.636077 | 0.249869 |
| 0.450569 | 0.662787 | 0.249869 |
| 0.419377 | 0.687512 | 0.249869 |
| 0.386105 | 0.709362 | 0.249869 |
| 0.351982 | 0.727138 | 0.249869 |
| 0.316261 | 0.741443 | 0.249869 |
| 0.280502 | 0.751541 | 0.249869 |
| 0.246398 | 0.756751 | 0.249869 |
| 0.213239 | 0.757498 | 0.249869 |
| 0.182775 | 0.755578 | 0.249869 |

TABLE 1-continued

| Airfoil Surface (Normalized) | | |
|---|---|---|
| X/Bx | Y/Bx | Span Fraction |
| 0.155053 | 0.752818 | 0.249869 |
| 0.129969 | 0.750236 | 0.249869 |
| 0.107589 | 0.747428 | 0.249869 |
| 0.087903 | 0.744478 | 0.249869 |
| 0.070913 | 0.741528 | 0.249869 |
| 0.056342 | 0.740677 | 0.249869 |
| 0.044533 | 0.742427 | 0.249869 |
| 0.035740 | 0.745424 | 0.249869 |
| 0.029774 | 0.748336 | 0.249869 |
| 0.025198 | 0.751021 | 0.249869 |
| 0.021888 | 0.753234 | 0.249869 |
| 0.019770 | 0.754822 | 0.249869 |
| 0.017728 | 0.756524 | 0.249869 |
| 0.016735 | 0.757403 | 0.249869 |
| 0.014428 | 0.759729 | 0.249869 |
| 0.013124 | 0.761176 | 0.249869 |
| 0.010703 | 0.764230 | 0.249869 |
| 0.008557 | 0.767492 | 0.249869 |
| 0.005805 | 0.772654 | 0.249869 |
| 0.003045 | 0.779944 | 0.249869 |
| 0.000879 | 0.789456 | 0.249869 |
| 0.000000 | 0.803080 | 0.249869 |
| | Section 5 | |
| 0.000000 | 0.918498 | 0.375013 |
| 0.002154 | 0.936522 | 0.375013 |
| 0.006979 | 0.958172 | 0.375013 |
| 0.013881 | 0.983458 | 0.375013 |
| 0.023317 | 1.012204 | 0.375013 |
| 0.035784 | 1.044138 | 0.375013 |
| 0.051927 | 1.078879 | 0.375013 |
| 0.072777 | 1.115746 | 0.375013 |
| 0.099594 | 1.153587 | 0.375013 |
| 0.134247 | 1.190200 | 0.375013 |
| 0.177108 | 1.220398 | 0.375013 |
| 0.230146 | 1.239806 | 0.375013 |
| 0.288506 | 1.243618 | 0.375013 |
| 0.345970 | 1.232768 | 0.375013 |
| 0.401601 | 1.209003 | 0.375013 |
| 0.452358 | 1.176085 | 0.375013 |
| 0.497792 | 1.136138 | 0.375013 |
| 0.537583 | 1.090577 | 0.375013 |
| 0.571408 | 1.040414 | 0.375013 |
| 0.600193 | 0.987201 | 0.375013 |
| 0.625450 | 0.932233 | 0.375013 |
| 0.649195 | 0.876583 | 0.375013 |
| 0.672678 | 0.820835 | 0.375013 |
| 0.696550 | 0.765243 | 0.375013 |
| 0.720891 | 0.709866 | 0.375013 |
| 0.745514 | 0.654605 | 0.375013 |
| 0.770215 | 0.599374 | 0.375013 |
| 0.794799 | 0.544104 | 0.375013 |
| 0.818418 | 0.490598 | 0.375013 |
| 0.841773 | 0.436985 | 0.375013 |
| 0.863862 | 0.385020 | 0.375013 |
| 0.883747 | 0.336505 | 0.375013 |
| 0.902259 | 0.289618 | 0.375013 |
| 0.918830 | 0.246289 | 0.375013 |
| 0.933617 | 0.206615 | 0.375013 |
| 0.946757 | 0.170616 | 0.375013 |
| 0.958318 | 0.138351 | 0.375013 |
| 0.968339 | 0.109809 | 0.375013 |
| 0.976878 | 0.085021 | 0.375013 |
| 0.984004 | 0.064014 | 0.375013 |
| 0.989794 | 0.046809 | 0.375013 |
| 0.994356 | 0.033455 | 0.375013 |
| 0.997622 | 0.023911 | 0.375013 |
| 1.000000 | 0.016211 | 0.375013 |
| 0.999649 | 0.010167 | 0.375013 |
| 0.998002 | 0.006482 | 0.375013 |
| 0.995370 | 0.003431 | 0.375013 |
| 0.993761 | 0.002213 | 0.375013 |
| 0.991987 | 0.001248 | 0.375013 |
| 0.990671 | 0.000731 | 0.375013 |

TABLE 1-continued

| Airfoil Surface (Normalized) | | |
|---|---|---|
| X/Bx | Y/Bx | Span Fraction |
| 0.989297 | 0.000341 | 0.375013 |
| 0.986480 | 0.000000 | 0.375013 |
| 0.983643 | 0.000234 | 0.375013 |
| 0.979627 | 0.001647 | 0.375013 |
| 0.975260 | 0.005283 | 0.375013 |
| 0.971527 | 0.011337 | 0.375013 |
| 0.966575 | 0.019954 | 0.375013 |
| 0.960151 | 0.031008 | 0.375013 |
| 0.952284 | 0.044509 | 0.375013 |
| 0.942985 | 0.060475 | 0.375013 |
| 0.932184 | 0.078840 | 0.375013 |
| 0.919951 | 0.099671 | 0.375013 |
| 0.906060 | 0.122813 | 0.375013 |
| 0.890376 | 0.148196 | 0.375013 |
| 0.872752 | 0.175714 | 0.375013 |
| 0.853276 | 0.205416 | 0.375013 |
| 0.832562 | 0.236005 | 0.375013 |
| 0.809469 | 0.268397 | 0.375013 |
| 0.785226 | 0.301705 | 0.375013 |
| 0.760827 | 0.334906 | 0.375013 |
| 0.735542 | 0.369218 | 0.375013 |
| 0.710168 | 0.403462 | 0.375013 |
| 0.684726 | 0.437668 | 0.375013 |
| 0.659323 | 0.471892 | 0.375013 |
| 0.634028 | 0.506185 | 0.375013 |
| 0.608654 | 0.540439 | 0.375013 |
| 0.583242 | 0.574654 | 0.375013 |
| 0.558024 | 0.609015 | 0.375013 |
| 0.532816 | 0.643386 | 0.375013 |
| 0.507072 | 0.677357 | 0.375013 |
| 0.481026 | 0.711094 | 0.375013 |
| 0.454483 | 0.744441 | 0.375013 |
| 0.426263 | 0.776385 | 0.375013 |
| 0.395947 | 0.806340 | 0.375013 |
| 0.364364 | 0.832805 | 0.375013 |
| 0.330169 | 0.855781 | 0.375013 |
| 0.294345 | 0.873083 | 0.375013 |
| 0.258824 | 0.883221 | 0.375013 |
| 0.223508 | 0.887003 | 0.375013 |
| 0.190843 | 0.886106 | 0.375013 |
| 0.161219 | 0.882558 | 0.375013 |
| 0.134725 | 0.877382 | 0.375013 |
| 0.111505 | 0.870724 | 0.375013 |
| 0.091464 | 0.863472 | 0.375013 |
| 0.074044 | 0.857331 | 0.375013 |
| 0.058614 | 0.854855 | 0.375013 |
| 0.045864 | 0.855742 | 0.375013 |
| 0.036242 | 0.858267 | 0.375013 |
| 0.029702 | 0.861045 | 0.375013 |
| 0.024730 | 0.863784 | 0.375013 |
| 0.021192 | 0.866162 | 0.375013 |
| 0.018940 | 0.867897 | 0.375013 |
| 0.016796 | 0.869769 | 0.375013 |
| 0.015762 | 0.870734 | 0.375013 |
| 0.013394 | 0.873230 | 0.375013 |
| 0.012078 | 0.874760 | 0.375013 |
| 0.009660 | 0.877986 | 0.375013 |
| 0.007525 | 0.881408 | 0.375013 |
| 0.004845 | 0.886838 | 0.375013 |
| 0.002271 | 0.894480 | 0.375013 |
| 0.000429 | 0.904393 | 0.375013 |
| 0.000000 | 0.918498 | 0.375013 |
| | Section 6 | |
| 0.000000 | 1.031685 | 0.499738 |
| 0.002145 | 1.050167 | 0.499738 |
| 0.007473 | 1.072274 | 0.499738 |
| 0.014805 | 1.098128 | 0.499738 |
| 0.024383 | 1.127617 | 0.499738 |
| 0.037084 | 1.160390 | 0.499738 |
| 0.054064 | 1.195812 | 0.499738 |
| 0.076726 | 1.232846 | 0.499738 |
| 0.106356 | 1.270030 | 0.499738 |
| 0.144941 | 1.304435 | 0.499738 |

TABLE 1-continued

| Airfoil Surface (Normalized) | | |
|---|---|---|
| X/Bx | Y/Bx | Span Fraction |
| 0.192468 | 1.329523 | 0.499738 |
| 0.249635 | 1.338638 | 0.499738 |
| 0.308634 | 1.327962 | 0.499738 |
| 0.362810 | 1.302279 | 0.499738 |
| 0.412382 | 1.265004 | 0.499738 |
| 0.456012 | 1.220931 | 0.499738 |
| 0.494385 | 1.172204 | 0.499738 |
| 0.528065 | 1.120124 | 0.499738 |
| 0.557393 | 1.065476 | 0.499738 |
| 0.583740 | 1.009326 | 0.499738 |
| 0.608668 | 0.952533 | 0.499738 |
| 0.633414 | 0.895658 | 0.499738 |
| 0.658119 | 0.838774 | 0.499738 |
| 0.683077 | 0.781990 | 0.499738 |
| 0.708447 | 0.725398 | 0.499738 |
| 0.734170 | 0.668966 | 0.499738 |
| 0.760084 | 0.612616 | 0.499738 |
| 0.785958 | 0.556245 | 0.499738 |
| 0.810986 | 0.501768 | 0.499738 |
| 0.835883 | 0.447220 | 0.499738 |
| 0.859380 | 0.394324 | 0.499738 |
| 0.880349 | 0.344832 | 0.499738 |
| 0.899677 | 0.296891 | 0.499738 |
| 0.916829 | 0.252546 | 0.499738 |
| 0.932057 | 0.211887 | 0.499738 |
| 0.945563 | 0.175004 | 0.499738 |
| 0.957437 | 0.141919 | 0.499738 |
| 0.967720 | 0.112671 | 0.499738 |
| 0.976463 | 0.087250 | 0.499738 |
| 0.983744 | 0.065707 | 0.499738 |
| 0.989636 | 0.048062 | 0.499738 |
| 0.994219 | 0.034334 | 0.499738 |
| 0.997492 | 0.024524 | 0.499738 |
| 1.000000 | 0.016648 | 0.499738 |
| 0.999738 | 0.010444 | 0.499738 |
| 0.998096 | 0.006657 | 0.499738 |
| 0.995417 | 0.003505 | 0.499738 |
| 0.993776 | 0.002256 | 0.499738 |
| 0.991953 | 0.001269 | 0.499738 |
| 0.990553 | 0.000715 | 0.499738 |
| 0.989103 | 0.000322 | 0.499738 |
| 0.986111 | 0.000000 | 0.499738 |
| 0.983120 | 0.000332 | 0.499738 |
| 0.978920 | 0.001984 | 0.499738 |
| 0.974519 | 0.006083 | 0.499738 |
| 0.970682 | 0.012559 | 0.499738 |
| 0.965354 | 0.021644 | 0.499738 |
| 0.958495 | 0.033327 | 0.499738 |
| 0.950125 | 0.047608 | 0.499738 |
| 0.940205 | 0.064468 | 0.499738 |
| 0.928572 | 0.083816 | 0.499738 |
| 0.915348 | 0.105712 | 0.499738 |
| 0.900513 | 0.130155 | 0.499738 |
| 0.883975 | 0.157087 | 0.499738 |
| 0.865453 | 0.186325 | 0.499738 |
| 0.845048 | 0.217929 | 0.499738 |
| 0.823263 | 0.250431 | 0.499738 |
| 0.798830 | 0.284755 | 0.499738 |
| 0.773338 | 0.320187 | 0.499738 |
| 0.748169 | 0.355840 | 0.499738 |
| 0.722567 | 0.393024 | 0.499738 |
| 0.697066 | 0.430269 | 0.499738 |
| 0.671746 | 0.467645 | 0.499738 |
| 0.646547 | 0.505111 | 0.499738 |
| 0.621358 | 0.542568 | 0.499738 |
| 0.596128 | 0.580014 | 0.499738 |
| 0.570879 | 0.617430 | 0.499738 |
| 0.545861 | 0.655007 | 0.499738 |
| 0.521145 | 0.692796 | 0.499738 |
| 0.496561 | 0.730655 | 0.499738 |
| 0.472721 | 0.768998 | 0.499738 |
| 0.449174 | 0.807511 | 0.499738 |
| 0.424317 | 0.845199 | 0.499738 |
| 0.397839 | 0.881769 | 0.499738 |

TABLE 1-continued

| Airfoil Surface (Normalized) | | |
|---|---|---|
| X/Bx | Y/Bx | Span Fraction |
| 0.370343 | 0.915660 | 0.499738 |
| 0.339796 | 0.946822 | 0.499738 |
| 0.306177 | 0.972223 | 0.499738 |
| 0.271148 | 0.989656 | 0.499738 |
| 0.234971 | 0.999970 | 0.499738 |
| 0.200576 | 1.003857 | 0.499738 |
| 0.168992 | 1.002770 | 0.499738 |
| 0.140872 | 0.997603 | 0.499738 |
| 0.116629 | 0.989425 | 0.499738 |
| 0.096134 | 0.979968 | 0.499738 |
| 0.078287 | 0.971961 | 0.499738 |
| 0.062202 | 0.968013 | 0.499738 |
| 0.048666 | 0.967922 | 0.499738 |
| 0.038343 | 0.970017 | 0.499738 |
| 0.031303 | 0.972666 | 0.499738 |
| 0.025944 | 0.975415 | 0.499738 |
| 0.022158 | 0.977873 | 0.499738 |
| 0.019750 | 0.979686 | 0.499738 |
| 0.017474 | 0.981660 | 0.499738 |
| 0.016376 | 0.982687 | 0.499738 |
| 0.013919 | 0.985265 | 0.499738 |
| 0.012579 | 0.986846 | 0.499738 |
| 0.010112 | 0.990170 | 0.499738 |
| 0.007936 | 0.993685 | 0.499738 |
| 0.005197 | 0.999245 | 0.499743 |
| 0.002518 | 1.007070 | 0.499738 |
| 0.000564 | 1.017222 | 0.499738 |
| 0.000000 | 1.031685 | 0.499738 |
| | Section 7 | |
| 0.000000 | 1.150249 | 0.624987 |
| 0.001320 | 1.169183 | 0.624987 |
| 0.005966 | 1.191919 | 0.624987 |
| 0.013084 | 1.218415 | 0.624987 |
| 0.022947 | 1.248479 | 0.624987 |
| 0.036263 | 1.281786 | 0.624987 |
| 0.054279 | 1.317595 | 0.624987 |
| 0.078757 | 1.354524 | 0.624987 |
| 0.112771 | 1.389140 | 0.624987 |
| 0.158412 | 1.415582 | 0.624987 |
| 0.212184 | 1.426396 | 0.624987 |
| 0.270487 | 1.417061 | 0.624987 |
| 0.324966 | 1.389235 | 0.624987 |
| 0.372138 | 1.350279 | 0.624987 |
| 0.414368 | 1.303138 | 0.624987 |
| 0.450874 | 1.251426 | 0.624987 |
| 0.482798 | 1.196788 | 0.624987 |
| 0.511595 | 1.140418 | 0.624987 |
| 0.538175 | 1.082971 | 0.624987 |
| 0.563677 | 1.025049 | 0.624987 |
| 0.589096 | 0.967084 | 0.624987 |
| 0.614894 | 0.909289 | 0.624987 |
| 0.640914 | 0.851599 | 0.624987 |
| 0.667262 | 0.794046 | 0.624987 |
| 0.694137 | 0.736747 | 0.624987 |
| 0.721667 | 0.679754 | 0.624987 |
| 0.749535 | 0.622930 | 0.624987 |
| 0.777171 | 0.565990 | 0.624987 |
| 0.803593 | 0.510803 | 0.624987 |
| 0.829634 | 0.455436 | 0.624987 |
| 0.854102 | 0.401675 | 0.624987 |
| 0.875824 | 0.351303 | 0.624987 |
| 0.895751 | 0.302473 | 0.624987 |
| 0.913428 | 0.257276 | 0.624987 |
| 0.929110 | 0.215838 | 0.624987 |
| 0.943060 | 0.178265 | 0.624987 |
| 0.955394 | 0.144578 | 0.624987 |
| 0.966123 | 0.114809 | 0.624987 |
| 0.975332 | 0.088979 | 0.624987 |
| 0.983051 | 0.067099 | 0.624987 |
| 0.989334 | 0.049178 | 0.624987 |
| 0.994118 | 0.035207 | 0.624987 |
| 0.997508 | 0.025239 | 0.624987 |
| 1.000000 | 0.017150 | 0.624987 |

TABLE 1-continued

| Airfoil Surface (Normalized) | | |
|---|---|---|
| X/Bx | Y/Bx | Span Fraction |
| 0.999641 | 0.010835 | 0.624987 |
| 0.997941 | 0.006970 | 0.624987 |
| 0.995216 | 0.003749 | 0.624987 |
| 0.993548 | 0.002461 | 0.624987 |
| 0.991700 | 0.001426 | 0.624987 |
| 0.990253 | 0.000834 | 0.624987 |
| 0.988743 | 0.000401 | 0.624987 |
| 0.985628 | 0.000000 | 0.624987 |
| 0.982502 | 0.000296 | 0.624987 |
| 0.978088 | 0.001932 | 0.624987 |
| 0.973410 | 0.006135 | 0.624987 |
| 0.969175 | 0.012778 | 0.624987 |
| 0.963420 | 0.022113 | 0.624987 |
| 0.956007 | 0.034151 | 0.624987 |
| 0.947041 | 0.048914 | 0.624987 |
| 0.936418 | 0.066349 | 0.624987 |
| 0.923957 | 0.086339 | 0.624987 |
| 0.909690 | 0.108906 | 0.624987 |
| 0.893628 | 0.134061 | 0.624987 |
| 0.875623 | 0.161686 | 0.624987 |
| 0.855612 | 0.191761 | 0.624987 |
| 0.833868 | 0.224455 | 0.624987 |
| 0.811048 | 0.258321 | 0.624987 |
| 0.785651 | 0.294215 | 0.624987 |
| 0.759156 | 0.331260 | 0.624987 |
| 0.732745 | 0.368368 | 0.624987 |
| 0.705542 | 0.406828 | 0.624987 |
| 0.678360 | 0.445320 | 0.624987 |
| 0.651749 | 0.484202 | 0.624987 |
| 0.625876 | 0.523570 | 0.624987 |
| 0.600458 | 0.563244 | 0.624987 |
| 0.575272 | 0.603056 | 0.624987 |
| 0.550129 | 0.642910 | 0.624987 |
| 0.525249 | 0.682922 | 0.624987 |
| 0.501003 | 0.723315 | 0.624987 |
| 0.477465 | 0.764129 | 0.624987 |
| 0.455373 | 0.805747 | 0.624987 |
| 0.434274 | 0.847871 | 0.624987 |
| 0.412351 | 0.889573 | 0.624987 |
| 0.389256 | 0.930641 | 0.624987 |
| 0.365675 | 0.969608 | 0.624987 |
| 0.339676 | 1.007001 | 0.624987 |
| 0.310795 | 1.040160 | 0.624987 |
| 0.279991 | 1.066962 | 0.624987 |
| 0.246864 | 1.088040 | 0.624987 |
| 0.213642 | 1.102222 | 0.624987 |
| 0.181412 | 1.109170 | 0.624987 |
| 0.151569 | 1.109508 | 0.624987 |
| 0.125243 | 1.105105 | 0.624987 |
| 0.102792 | 1.097977 | 0.624987 |
| 0.083721 | 1.090690 | 0.624987 |
| 0.067131 | 1.085854 | 0.624987 |
| 0.053012 | 1.085294 | 0.624987 |
| 0.042293 | 1.087733 | 0.624987 |
| 0.035007 | 1.090669 | 0.624987 |
| 0.029431 | 1.093563 | 0.624987 |
| 0.025450 | 1.096076 | 0.624987 |
| 0.022894 | 1.097903 | 0.624987 |
| 0.020465 | 1.099899 | 0.624987 |
| 0.019293 | 1.100944 | 0.624987 |
| 0.016696 | 1.103552 | 0.624987 |
| 0.015302 | 1.105126 | 0.624987 |
| 0.012693 | 1.108442 | 0.624987 |
| 0.010359 | 1.111969 | 0.624987 |
| 0.007339 | 1.117523 | 0.624987 |
| 0.004192 | 1.125359 | 0.624987 |
| 0.001500 | 1.135550 | 0.624987 |
| 0.000000 | 1.150249 | 0.624987 |
| | Section 8 | |
| 0.000000 | 1.215617 | 0.688714 |
| 0.001328 | 1.234703 | 0.688714 |
| 0.005901 | 1.257632 | 0.688714 |
| 0.013392 | 1.284220 | 0.688714 |

TABLE 1-continued

| Airfoil Surface (Normalized) | | |
|---|---|---|
| X/Bx | Y/Bx | Span Fraction |
| 0.024203 | 1.314215 | 0.688714 |
| 0.038879 | 1.347226 | 0.688714 |
| 0.058662 | 1.382436 | 0.688714 |
| 0.085587 | 1.418028 | 0.688714 |
| 0.123389 | 1.449035 | 0.688714 |
| 0.173112 | 1.467773 | 0.688714 |
| 0.228356 | 1.467631 | 0.688714 |
| 0.284307 | 1.447413 | 0.688714 |
| 0.334575 | 1.411745 | 0.688714 |
| 0.377580 | 1.367596 | 0.688714 |
| 0.416111 | 1.316795 | 0.688714 |
| 0.449384 | 1.262412 | 0.688714 |
| 0.478606 | 1.205742 | 0.688714 |
| 0.505476 | 1.147918 | 0.688714 |
| 0.531095 | 1.089539 | 0.688714 |
| 0.556321 | 1.030975 | 0.688714 |
| 0.581798 | 0.972531 | 0.688714 |
| 0.607711 | 0.914282 | 0.688714 |
| 0.633982 | 0.856175 | 0.688714 |
| 0.660668 | 0.798275 | 0.688714 |
| 0.688006 | 0.740669 | 0.688714 |
| 0.716140 | 0.683455 | 0.688714 |
| 0.744676 | 0.626448 | 0.688714 |
| 0.772897 | 0.569267 | 0.688714 |
| 0.799669 | 0.513751 | 0.688714 |
| 0.825930 | 0.457996 | 0.688714 |
| 0.850579 | 0.403830 | 0.688714 |
| 0.872518 | 0.353116 | 0.688714 |
| 0.892725 | 0.303970 | 0.688714 |
| 0.910711 | 0.258525 | 0.688714 |
| 0.926727 | 0.216858 | 0.688714 |
| 0.941022 | 0.179100 | 0.688714 |
| 0.953695 | 0.145262 | 0.688714 |
| 0.964779 | 0.115375 | 0.688714 |
| 0.974327 | 0.089441 | 0.688714 |
| 0.982395 | 0.067503 | 0.688714 |
| 0.988971 | 0.049538 | 0.688714 |
| 0.993947 | 0.035526 | 0.688714 |
| 0.997485 | 0.025510 | 0.688714 |
| 1.000000 | 0.017377 | 0.688714 |
| 0.999477 | 0.011018 | 0.688714 |
| 0.997714 | 0.007153 | 0.688714 |
| 0.994959 | 0.003920 | 0.688714 |
| 0.993282 | 0.002613 | 0.688714 |
| 0.991431 | 0.001557 | 0.688714 |
| 0.989962 | 0.000925 | 0.688714 |
| 0.988416 | 0.000457 | 0.688714 |
| 0.985236 | 0.000000 | 0.688714 |
| 0.982036 | 0.000218 | 0.688714 |
| 0.977474 | 0.001775 | 0.688714 |
| 0.972542 | 0.005890 | 0.688714 |
| 0.968110 | 0.012619 | 0.688714 |
| 0.962111 | 0.022102 | 0.688714 |
| 0.954392 | 0.034328 | 0.688714 |
| 0.945061 | 0.049332 | 0.688714 |
| 0.934011 | 0.067056 | 0.688714 |
| 0.921087 | 0.087394 | 0.688714 |
| 0.906247 | 0.110324 | 0.688714 |
| 0.889502 | 0.135844 | 0.688714 |
| 0.870656 | 0.163825 | 0.688714 |
| 0.849806 | 0.194321 | 0.688714 |
| 0.827291 | 0.227583 | 0.688714 |
| 0.803883 | 0.262172 | 0.688714 |
| 0.778025 | 0.298983 | 0.688714 |
| 0.751023 | 0.336948 | 0.688714 |
| 0.723870 | 0.374804 | 0.688714 |
| 0.695573 | 0.413814 | 0.688714 |
| 0.667265 | 0.452813 | 0.688714 |
| 0.639720 | 0.492368 | 0.688714 |
| 0.613307 | 0.532684 | 0.688714 |
| 0.587688 | 0.573502 | 0.688714 |
| 0.562451 | 0.614559 | 0.688714 |
| 0.537279 | 0.655659 | 0.688714 |
| 0.512412 | 0.696945 | 0.688714 |

TABLE 1-continued

| Airfoil Surface (Normalized) | | |
|---|---|---|
| X/Bx | Y/Bx | Span Fraction |
| 0.488318 | 0.738677 | 0.688714 |
| 0.465182 | 0.780964 | 0.688714 |
| 0.443777 | 0.824133 | 0.688714 |
| 0.423602 | 0.867901 | 0.688714 |
| 0.402741 | 0.911354 | 0.688714 |
| 0.380738 | 0.954229 | 0.688714 |
| 0.358364 | 0.995090 | 0.688714 |
| 0.333954 | 1.034775 | 0.688714 |
| 0.307192 | 1.070932 | 0.688714 |
| 0.278906 | 1.101657 | 0.688714 |
| 0.248323 | 1.127689 | 0.688714 |
| 0.216935 | 1.147178 | 0.688714 |
| 0.185361 | 1.159045 | 0.688714 |
| 0.155180 | 1.163607 | 0.688714 |
| 0.127874 | 1.162834 | 0.688714 |
| 0.104161 | 1.158588 | 0.688714 |
| 0.084063 | 1.152894 | 0.688714 |
| 0.066969 | 1.148441 | 0.688714 |
| 0.052511 | 1.148147 | 0.688714 |
| 0.041645 | 1.151032 | 0.688714 |
| 0.034318 | 1.154331 | 0.688714 |
| 0.028743 | 1.157521 | 0.688714 |
| 0.024769 | 1.160254 | 0.688714 |
| 0.022221 | 1.162214 | 0.688714 |
| 0.019826 | 1.164348 | 0.688714 |
| 0.018672 | 1.165458 | 0.688714 |
| 0.016135 | 1.168202 | 0.688714 |
| 0.014785 | 1.169846 | 0.688714 |
| 0.012281 | 1.173275 | 0.688714 |
| 0.010060 | 1.176901 | 0.688714 |
| 0.007175 | 1.182584 | 0.688714 |
| 0.004137 | 1.190532 | 0.688714 |
| 0.001492 | 1.200821 | 0.688714 |
| 0.000000 | 1.215617 | 0.688714 |
| | Section 9 | |
| 0.000000 | 1.283470 | 0.750131 |
| 0.002117 | 1.302533 | 0.750131 |
| 0.007420 | 1.325369 | 0.750131 |
| 0.016214 | 1.351638 | 0.750131 |
| 0.029051 | 1.380903 | 0.750131 |
| 0.046369 | 1.412724 | 0.750131 |
| 0.069452 | 1.445986 | 0.750131 |
| 0.100743 | 1.477975 | 0.750131 |
| 0.143632 | 1.501689 | 0.750131 |
| 0.196431 | 1.508805 | 0.750131 |
| 0.250434 | 1.496464 | 0.750131 |
| 0.302308 | 1.466986 | 0.750131 |
| 0.348328 | 1.425740 | 0.750131 |
| 0.387704 | 1.378122 | 0.750131 |
| 0.422847 | 1.324727 | 0.750131 |
| 0.453215 | 1.268472 | 0.750131 |
| 0.480182 | 1.210517 | 0.750131 |
| 0.505484 | 1.151807 | 0.750131 |
| 0.530132 | 1.092827 | 0.750131 |
| 0.554791 | 1.033848 | 0.750131 |
| 0.579867 | 0.975048 | 0.750131 |
| 0.605360 | 0.916428 | 0.750131 |
| 0.631280 | 0.857989 | 0.750131 |
| 0.657707 | 0.799786 | 0.750131 |
| 0.684889 | 0.741921 | 0.750131 |
| 0.712938 | 0.684484 | 0.750131 |
| 0.741403 | 0.627249 | 0.750131 |
| 0.769519 | 0.569834 | 0.750131 |
| 0.796115 | 0.514064 | 0.750131 |
| 0.822137 | 0.458011 | 0.750131 |
| 0.846628 | 0.403603 | 0.750131 |
| 0.868596 | 0.352742 | 0.750131 |
| 0.889022 | 0.303547 | 0.750131 |
| 0.907375 | 0.258102 | 0.750131 |
| 0.923815 | 0.216485 | 0.750131 |
| 0.938543 | 0.178775 | 0.750131 |
| 0.951638 | 0.144995 | 0.750131 |
| 0.963146 | 0.115178 | 0.750131 |

TABLE 1-continued

| Airfoil Surface (Normalized) | | |
|---|---|---|
| X/Bx | Y/Bx | Span Fraction |
| 0.973100 | 0.089326 | 0.750131 |
| 0.981522 | 0.067459 | 0.750131 |
| 0.988425 | 0.049566 | 0.750131 |
| 0.993784 | 0.035638 | 0.750131 |
| 0.997613 | 0.025695 | 0.750131 |
| 1.000000 | 0.017521 | 0.750131 |
| 0.999212 | 0.011181 | 0.750131 |
| 0.997354 | 0.007342 | 0.750131 |
| 0.994561 | 0.004121 | 0.750131 |
| 0.992884 | 0.002804 | 0.750131 |
| 0.991048 | 0.001734 | 0.750131 |
| 0.989551 | 0.001058 | 0.750131 |
| 0.987986 | 0.000552 | 0.750131 |
| 0.984731 | 0.000000 | 0.750131 |
| 0.981444 | 0.000124 | 0.750131 |
| 0.976703 | 0.001531 | 0.750131 |
| 0.971433 | 0.005472 | 0.750131 |
| 0.966851 | 0.012307 | 0.750131 |
| 0.960658 | 0.022025 | 0.750131 |
| 0.952708 | 0.034523 | 0.750131 |
| 0.942991 | 0.049803 | 0.750131 |
| 0.931483 | 0.067853 | 0.750131 |
| 0.918072 | 0.088582 | 0.750131 |
| 0.902691 | 0.111958 | 0.750131 |
| 0.885317 | 0.137969 | 0.750131 |
| 0.865770 | 0.166479 | 0.750131 |
| 0.844218 | 0.197602 | 0.750131 |
| 0.821011 | 0.231596 | 0.750131 |
| 0.797027 | 0.267042 | 0.750131 |
| 0.770724 | 0.304887 | 0.750131 |
| 0.743227 | 0.343914 | 0.750131 |
| 0.715381 | 0.382693 | 0.750131 |
| 0.686150 | 0.422497 | 0.750131 |
| 0.656919 | 0.462302 | 0.750131 |
| 0.628612 | 0.502770 | 0.750131 |
| 0.601745 | 0.544207 | 0.750131 |
| 0.575971 | 0.586330 | 0.750131 |
| 0.550681 | 0.628747 | 0.750131 |
| 0.525436 | 0.671197 | 0.750131 |
| 0.500507 | 0.713816 | 0.750131 |
| 0.476444 | 0.756953 | 0.750131 |
| 0.453564 | 0.800709 | 0.750131 |
| 0.432643 | 0.845445 | 0.750131 |
| 0.413163 | 0.890823 | 0.750131 |
| 0.393030 | 0.935919 | 0.750131 |
| 0.371501 | 0.980363 | 0.750131 |
| 0.349431 | 1.022700 | 0.750131 |
| 0.325515 | 1.064013 | 0.750131 |
| 0.299764 | 1.102241 | 0.750131 |
| 0.273021 | 1.135660 | 0.750131 |
| 0.244229 | 1.165060 | 0.750131 |
| 0.214413 | 1.188391 | 0.750131 |
| 0.183774 | 1.204403 | 0.750131 |
| 0.153710 | 1.213017 | 0.750131 |
| 0.125909 | 1.216181 | 0.750131 |
| 0.101216 | 1.215708 | 0.750131 |
| 0.079980 | 1.213129 | 0.750131 |
| 0.062065 | 1.210483 | 0.750131 |
| 0.047258 | 1.211159 | 0.750131 |
| 0.036280 | 1.214661 | 0.750131 |
| 0.028994 | 1.218478 | 0.750131 |
| 0.023578 | 1.222216 | 0.750131 |
| 0.019818 | 1.225425 | 0.750131 |
| 0.017464 | 1.227733 | 0.750131 |
| 0.015280 | 1.230188 | 0.750131 |
| 0.014244 | 1.231472 | 0.750131 |
| 0.012026 | 1.234523 | 0.750131 |
| 0.010866 | 1.236313 | 0.750131 |
| 0.008783 | 1.240029 | 0.750131 |
| 0.006981 | 1.243891 | 0.750131 |
| 0.004707 | 1.249871 | 0.750131 |
| 0.002410 | 1.258079 | 0.750131 |
| 0.000552 | 1.268573 | 0.750131 |
| 0.000000 | 1.283470 | 0.750131 |

TABLE 1-continued

| Airfoil Surface (Normalized) | | |
|---|---|---|
| X/Bx | Y/Bx | Span Fraction |
| | Section 10 | |
| 0.000000 | 1.321029 | 0.796325 |
| 0.000868 | 1.335887 | 0.796325 |
| 0.004189 | 1.354737 | 0.796325 |
| 0.010750 | 1.377197 | 0.796325 |
| 0.021303 | 1.402747 | 0.796325 |
| 0.036508 | 1.430785 | 0.796325 |
| 0.056793 | 1.460709 | 0.796325 |
| 0.083465 | 1.491061 | 0.796325 |
| 0.119175 | 1.517849 | 0.796325 |
| 0.165785 | 1.532626 | 0.796325 |
| 0.218806 | 1.528692 | 0.796325 |
| 0.270010 | 1.507817 | 0.796325 |
| 0.318622 | 1.473426 | 0.796325 |
| 0.362247 | 1.429836 | 0.796325 |
| 0.399657 | 1.380819 | 0.796325 |
| 0.432509 | 1.326120 | 0.796325 |
| 0.460963 | 1.269026 | 0.796325 |
| 0.486560 | 1.210590 | 0.796325 |
| 0.510871 | 1.151610 | 0.796325 |
| 0.534732 | 1.092445 | 0.796325 |
| 0.558650 | 1.033303 | 0.796325 |
| 0.583020 | 0.974334 | 0.796325 |
| 0.607795 | 0.915551 | 0.796325 |
| 0.632974 | 0.856930 | 0.796325 |
| 0.658721 | 0.798563 | 0.796325 |
| 0.685243 | 0.740543 | 0.796325 |
| 0.712633 | 0.682929 | 0.796325 |
| 0.740404 | 0.625487 | 0.796325 |
| 0.767875 | 0.567908 | 0.796325 |
| 0.793876 | 0.511994 | 0.796325 |
| 0.819368 | 0.455837 | 0.796325 |
| 0.843460 | 0.401382 | 0.796325 |
| 0.865319 | 0.350594 | 0.796325 |
| 0.885893 | 0.301577 | 0.796325 |
| 0.904535 | 0.256367 | 0.796325 |
| 0.921360 | 0.214999 | 0.796325 |
| 0.936484 | 0.177530 | 0.796325 |
| 0.949976 | 0.143985 | 0.796325 |
| 0.961837 | 0.114373 | 0.796325 |
| 0.972113 | 0.088719 | 0.796325 |
| 0.980826 | 0.066999 | 0.796325 |
| 0.987977 | 0.049248 | 0.796325 |
| 0.993821 | 0.035559 | 0.796325 |
| 0.998010 | 0.025793 | 0.796325 |
| 1.000000 | 0.017519 | 0.796325 |
| 0.998935 | 0.011224 | 0.796325 |
| 0.996980 | 0.007452 | 0.796325 |
| 0.994156 | 0.004270 | 0.796325 |
| 0.992490 | 0.002951 | 0.796325 |
| 0.990662 | 0.001863 | 0.796325 |
| 0.989134 | 0.001169 | 0.796325 |
| 0.987549 | 0.000625 | 0.796325 |
| 0.984251 | 0.000000 | 0.796325 |
| 0.980895 | 0.000023 | 0.796325 |
| 0.976012 | 0.001261 | 0.796325 |
| 0.970423 | 0.004987 | 0.796325 |
| 0.965517 | 0.011791 | 0.796325 |
| 0.959315 | 0.021801 | 0.796325 |
| 0.951400 | 0.034634 | 0.796325 |
| 0.941379 | 0.050139 | 0.796325 |
| 0.929518 | 0.068457 | 0.796325 |
| 0.915736 | 0.089529 | 0.796325 |
| 0.899976 | 0.113308 | 0.796325 |
| 0.882225 | 0.139796 | 0.796325 |
| 0.862299 | 0.168875 | 0.796325 |
| 0.840405 | 0.200673 | 0.796325 |
| 0.816800 | 0.235365 | 0.796325 |
| 0.792395 | 0.271538 | 0.796325 |
| 0.765769 | 0.310267 | 0.796325 |
| 0.737928 | 0.350189 | 0.796325 |
| 0.709682 | 0.389833 | 0.796325 |
| 0.680001 | 0.430507 | 0.796325 |

TABLE 1-continued

| Airfoil Surface (Normalized) | | |
|---|---|---|
| X/Bx | Y/Bx | Span Fraction |
| 0.650366 | 0.471204 | 0.796325 |
| 0.621715 | 0.512619 | 0.796325 |
| 0.594626 | 0.555063 | 0.796325 |
| 0.568799 | 0.598283 | 0.796325 |
| 0.543468 | 0.641803 | 0.796325 |
| 0.518162 | 0.685335 | 0.796325 |
| 0.493144 | 0.729029 | 0.796325 |
| 0.469029 | 0.773233 | 0.796325 |
| 0.446210 | 0.818119 | 0.796325 |
| 0.425531 | 0.864035 | 0.796325 |
| 0.406438 | 0.910622 | 0.796325 |
| 0.386628 | 0.956908 | 0.796325 |
| 0.365047 | 1.002407 | 0.796325 |
| 0.342552 | 1.045569 | 0.796325 |
| 0.318136 | 1.087677 | 0.796325 |
| 0.292135 | 1.126824 | 0.796325 |
| 0.265474 | 1.161377 | 0.796325 |
| 0.237008 | 1.192203 | 0.796325 |
| 0.207697 | 1.217325 | 0.796325 |
| 0.177565 | 1.235608 | 0.796325 |
| 0.147687 | 1.246751 | 0.796325 |
| 0.119765 | 1.252630 | 0.796325 |
| 0.094713 | 1.255222 | 0.796325 |
| 0.072912 | 1.256090 | 0.796325 |
| 0.054456 | 1.256379 | 0.796325 |
| 0.039517 | 1.258647 | 0.796325 |
| 0.028547 | 1.262847 | 0.796325 |
| 0.021373 | 1.267198 | 0.796325 |
| 0.016246 | 1.271538 | 0.796325 |
| 0.012902 | 1.275298 | 0.796325 |
| 0.010912 | 1.278006 | 0.796325 |
| 0.009130 | 1.280841 | 0.796325 |
| 0.008308 | 1.282311 | 0.796325 |
| 0.006607 | 1.285713 | 0.796325 |
| 0.005763 | 1.287668 | 0.796325 |
| 0.004316 | 1.291660 | 0.796325 |
| 0.003147 | 1.295757 | 0.796325 |
| 0.001805 | 1.301994 | 0.796325 |
| 0.000625 | 1.310418 | 0.796325 |
| 0.000000 | 1.321029 | 0.796325 |
| | Section 11 | |
| 0.000000 | 1.351262 | 0.835696 |
| 0.000663 | 1.361841 | 0.835696 |
| 0.003009 | 1.376484 | 0.835696 |
| 0.007606 | 1.395001 | 0.835696 |
| 0.015543 | 1.416917 | 0.835696 |
| 0.027876 | 1.441547 | 0.835696 |
| 0.045303 | 1.468132 | 0.835696 |
| 0.068298 | 1.495865 | 0.835696 |
| 0.098187 | 1.522853 | 0.835696 |
| 0.137342 | 1.543964 | 0.835696 |
| 0.185642 | 1.550290 | 0.835696 |
| 0.237128 | 1.537732 | 0.835696 |
| 0.285488 | 1.511349 | 0.835696 |
| 0.331845 | 1.474304 | 0.835696 |
| 0.374114 | 1.429688 | 0.835696 |
| 0.410378 | 1.380073 | 0.835696 |
| 0.441678 | 1.324736 | 0.835696 |
| 0.468925 | 1.267302 | 0.835696 |
| 0.493745 | 1.208767 | 0.835696 |
| 0.517498 | 1.149805 | 0.835696 |
| 0.540801 | 1.090653 | 0.835696 |
| 0.564104 | 1.031501 | 0.835696 |
| 0.587810 | 0.972515 | 0.835696 |
| 0.611906 | 0.913683 | 0.835696 |
| 0.636346 | 0.854993 | 0.835696 |
| 0.661355 | 0.796553 | 0.835696 |
| 0.687146 | 0.738443 | 0.835696 |
| 0.713719 | 0.680689 | 0.835696 |
| 0.740647 | 0.623102 | 0.835696 |
| 0.767350 | 0.565407 | 0.835696 |
| 0.792679 | 0.509406 | 0.835696 |
| 0.817581 | 0.453228 | 0.835696 |

TABLE 1-continued

| Airfoil Surface (Normalized) | | |
|---|---|---|
| X/Bx | Y/Bx | Span Fraction |
| 0.841239 | 0.398815 | 0.835696 |
| 0.862955 | 0.348170 | 0.835696 |
| 0.883639 | 0.299396 | 0.835696 |
| 0.902535 | 0.254472 | 0.835696 |
| 0.919690 | 0.213411 | 0.835696 |
| 0.935162 | 0.176235 | 0.835696 |
| 0.948963 | 0.142957 | 0.835696 |
| 0.961142 | 0.113600 | 0.835696 |
| 0.971674 | 0.088141 | 0.835696 |
| 0.980618 | 0.066615 | 0.835696 |
| 0.988354 | 0.049165 | 0.835696 |
| 0.994385 | 0.035624 | 0.835696 |
| 0.998531 | 0.025886 | 0.835696 |
| 1.000000 | 0.017533 | 0.835696 |
| 0.998638 | 0.011326 | 0.835696 |
| 0.996576 | 0.007618 | 0.835696 |
| 0.993721 | 0.004478 | 0.835696 |
| 0.992051 | 0.003187 | 0.835696 |
| 0.990238 | 0.002085 | 0.835696 |
| 0.988698 | 0.001362 | 0.835696 |
| 0.987087 | 0.000782 | 0.835696 |
| 0.983758 | 0.000083 | 0.835696 |
| 0.980346 | 0.000000 | 0.835696 |
| 0.975347 | 0.001066 | 0.835696 |
| 0.969470 | 0.004526 | 0.835696 |
| 0.964175 | 0.011195 | 0.835696 |
| 0.957813 | 0.021372 | 0.835696 |
| 0.949674 | 0.034368 | 0.835696 |
| 0.939782 | 0.050195 | 0.835696 |
| 0.927651 | 0.068736 | 0.835696 |
| 0.913588 | 0.090084 | 0.835696 |
| 0.897571 | 0.114228 | 0.835696 |
| 0.879552 | 0.141133 | 0.835696 |
| 0.859460 | 0.170750 | 0.835696 |
| 0.837401 | 0.203151 | 0.835696 |
| 0.813565 | 0.238467 | 0.835696 |
| 0.788864 | 0.275252 | 0.835696 |
| 0.762019 | 0.314702 | 0.835696 |
| 0.733953 | 0.355384 | 0.835696 |
| 0.705473 | 0.395771 | 0.835696 |
| 0.675583 | 0.437259 | 0.835696 |
| 0.645788 | 0.478806 | 0.835696 |
| 0.616989 | 0.521052 | 0.835696 |
| 0.589752 | 0.564317 | 0.835696 |
| 0.563831 | 0.608388 | 0.835696 |
| 0.538420 | 0.652754 | 0.835696 |
| 0.513020 | 0.697121 | 0.835696 |
| 0.487952 | 0.741678 | 0.835696 |
| 0.463819 | 0.786755 | 0.835696 |
| 0.441014 | 0.832520 | 0.835696 |
| 0.420424 | 0.879315 | 0.835696 |
| 0.401493 | 0.926810 | 0.835696 |
| 0.381768 | 0.973972 | 0.835696 |
| 0.359922 | 1.020199 | 0.835696 |
| 0.336832 | 1.063902 | 0.835696 |
| 0.311657 | 1.106433 | 0.835696 |
| 0.285014 | 1.146014 | 0.835696 |
| 0.257908 | 1.181069 | 0.835696 |
| 0.229167 | 1.212522 | 0.835696 |
| 0.199846 | 1.238526 | 0.835696 |
| 0.169932 | 1.258180 | 0.835696 |
| 0.140220 | 1.271058 | 0.835696 |
| 0.112333 | 1.278924 | 0.835696 |
| 0.087288 | 1.284018 | 0.835696 |
| 0.065502 | 1.288046 | 0.835696 |
| 0.047080 | 1.291506 | 0.835696 |
| 0.032295 | 1.295581 | 0.835696 |
| 0.021443 | 1.300557 | 0.835696 |
| 0.014465 | 1.305450 | 0.835696 |
| 0.009738 | 1.310354 | 0.835696 |
| 0.006871 | 1.314595 | 0.835696 |
| 0.005319 | 1.317628 | 0.835696 |
| 0.004004 | 1.320768 | 0.835696 |
| 0.003412 | 1.322367 | 0.835696 |

TABLE 1-continued

| Airfoil Surface (Normalized) | | |
|---|---|---|
| X/Bx | Y/Bx | Span Fraction |
| 0.002286 | 1.326028 | 0.835696 |
| 0.001765 | 1.328077 | 0.835696 |
| 0.000971 | 1.332236 | 0.835696 |
| 0.000450 | 1.336441 | 0.835696 |
| 0.000036 | 1.342791 | 0.835696 |
| 0.000000 | 1.351262 | 0.835696 |
| | Section 12 | |
| 0.000000 | 1.364455 | 0.875066 |
| 0.000024 | 1.368672 | 0.875066 |
| 0.000412 | 1.374985 | 0.875066 |
| 0.001418 | 1.383358 | 0.875066 |
| 0.003344 | 1.393718 | 0.875066 |
| 0.007198 | 1.407956 | 0.875066 |
| 0.013196 | 1.425951 | 0.875066 |
| 0.022623 | 1.447144 | 0.875066 |
| 0.036667 | 1.470664 | 0.875066 |
| 0.056091 | 1.495614 | 0.875066 |
| 0.081502 | 1.520890 | 0.875066 |
| 0.114109 | 1.544132 | 0.875066 |
| 0.155612 | 1.559496 | 0.875066 |
| 0.204081 | 1.558636 | 0.875066 |
| 0.253266 | 1.539709 | 0.875066 |
| 0.298985 | 1.509488 | 0.875066 |
| 0.343419 | 1.470640 | 0.875066 |
| 0.384461 | 1.425333 | 0.875066 |
| 0.419759 | 1.375433 | 0.875066 |
| 0.449907 | 1.319839 | 0.875066 |
| 0.476383 | 1.262414 | 0.875066 |
| 0.500848 | 1.204105 | 0.875066 |
| 0.524429 | 1.145433 | 0.875066 |
| 0.547500 | 1.086555 | 0.875066 |
| 0.570451 | 1.027628 | 0.875066 |
| 0.593716 | 0.968834 | 0.875066 |
| 0.617284 | 0.910150 | 0.875066 |
| 0.641107 | 0.851574 | 0.875066 |
| 0.665451 | 0.793205 | 0.875066 |
| 0.690534 | 0.735162 | 0.875066 |
| 0.716308 | 0.677411 | 0.875066 |
| 0.742384 | 0.619805 | 0.875066 |
| 0.768303 | 0.562126 | 0.875066 |
| 0.792950 | 0.506192 | 0.875066 |
| 0.817233 | 0.450088 | 0.875066 |
| 0.840450 | 0.395827 | 0.875066 |
| 0.861971 | 0.345431 | 0.875066 |
| 0.882704 | 0.296973 | 0.875066 |
| 0.901789 | 0.252405 | 0.875066 |
| 0.919201 | 0.211715 | 0.875066 |
| 0.934942 | 0.174890 | 0.875066 |
| 0.949010 | 0.141931 | 0.875066 |
| 0.961418 | 0.112849 | 0.875066 |
| 0.972166 | 0.087645 | 0.875066 |
| 0.981267 | 0.066318 | 0.875066 |
| 0.989106 | 0.049015 | 0.875066 |
| 0.995202 | 0.035589 | 0.875066 |
| 0.999261 | 0.025871 | 0.875066 |
| 1.000000 | 0.017473 | 0.875066 |
| 0.998267 | 0.011390 | 0.875066 |
| 0.996074 | 0.007791 | 0.875066 |
| 0.993178 | 0.004726 | 0.875066 |
| 0.991506 | 0.003453 | 0.875066 |
| 0.989712 | 0.002351 | 0.875066 |
| 0.988161 | 0.001599 | 0.875066 |
| 0.986538 | 0.000994 | 0.875066 |
| 0.983193 | 0.000206 | 0.875066 |
| 0.979752 | 0.000000 | 0.875066 |
| 0.974638 | 0.000812 | 0.875066 |
| 0.968471 | 0.003878 | 0.875066 |
| 0.962666 | 0.010251 | 0.875066 |
| 0.956135 | 0.020491 | 0.875066 |
| 0.947859 | 0.033602 | 0.875066 |
| 0.937753 | 0.049560 | 0.875066 |
| 0.925430 | 0.068269 | 0.875066 |
| 0.911167 | 0.089826 | 0.875066 |

TABLE 1-continued

| Airfoil Surface (Normalized) | | |
|---|---|---|
| X/Bx | Y/Bx | Span Fraction |
| 0.894966 | 0.114255 | 0.875066 |
| 0.876815 | 0.141507 | 0.875066 |
| 0.856675 | 0.171582 | 0.875066 |
| 0.834585 | 0.204505 | 0.875066 |
| 0.810654 | 0.240336 | 0.875066 |
| 0.785777 | 0.277622 | 0.875066 |
| 0.758815 | 0.317645 | 0.875066 |
| 0.730642 | 0.358929 | 0.875066 |
| 0.702070 | 0.399947 | 0.875066 |
| 0.672140 | 0.442115 | 0.875066 |
| 0.642367 | 0.484393 | 0.875066 |
| 0.613492 | 0.527288 | 0.875066 |
| 0.586058 | 0.571117 | 0.875066 |
| 0.559908 | 0.615733 | 0.875066 |
| 0.534280 | 0.660652 | 0.875066 |
| 0.508773 | 0.705620 | 0.875066 |
| 0.483738 | 0.750866 | 0.875066 |
| 0.459685 | 0.796646 | 0.875066 |
| 0.436929 | 0.843080 | 0.875066 |
| 0.416293 | 0.890495 | 0.875066 |
| 0.397305 | 0.938589 | 0.875066 |
| 0.377445 | 0.986332 | 0.875066 |
| 0.355294 | 1.033056 | 0.875066 |
| 0.331653 | 1.077103 | 0.875066 |
| 0.305867 | 1.119914 | 0.875066 |
| 0.278639 | 1.159768 | 0.875066 |
| 0.251012 | 1.195054 | 0.875066 |
| 0.221882 | 1.226813 | 0.875066 |
| 0.192436 | 1.253350 | 0.875066 |
| 0.162737 | 1.274035 | 0.875066 |
| 0.133291 | 1.288382 | 0.875066 |
| 0.105652 | 1.298124 | 0.875066 |
| 0.080896 | 1.305552 | 0.875066 |
| 0.059593 | 1.312520 | 0.875066 |
| 0.041757 | 1.318930 | 0.875066 |
| 0.027397 | 1.324819 | 0.875066 |
| 0.016831 | 1.330635 | 0.875066 |
| 0.010154 | 1.336088 | 0.875066 |
| 0.005889 | 1.341504 | 0.875066 |
| 0.003538 | 1.346109 | 0.875066 |
| 0.002399 | 1.349369 | 0.875066 |
| 0.001490 | 1.352689 | 0.875066 |
| 0.001127 | 1.354373 | 0.875066 |
| 0.000485 | 1.358154 | 0.875066 |
| 0.000242 | 1.360250 | 0.875066 |
| 0.000000 | 1.364455 | 0.875066 |
| | Section 13 | |
| 0.000000 | 1.382026 | 0.911690 |
| 0.000012 | 1.386225 | 0.911690 |
| 0.000297 | 1.390399 | 0.911690 |
| 0.001115 | 1.396641 | 0.911690 |
| 0.002774 | 1.404865 | 0.911690 |
| 0.005636 | 1.414947 | 0.911690 |
| 0.010800 | 1.428683 | 0.911690 |
| 0.018195 | 1.446035 | 0.911690 |
| 0.028995 | 1.466410 | 0.911690 |
| 0.044440 | 1.488865 | 0.911690 |
| 0.065310 | 1.512398 | 0.911690 |
| 0.092435 | 1.535510 | 0.911690 |
| 0.126991 | 1.555327 | 0.911690 |
| 0.169697 | 1.566016 | 0.911690 |
| 0.217605 | 1.560529 | 0.911690 |
| 0.264968 | 1.538099 | 0.911690 |
| 0.308752 | 1.505623 | 0.911690 |
| 0.351408 | 1.465295 | 0.911690 |
| 0.390807 | 1.418997 | 0.911690 |
| 0.424843 | 1.368612 | 0.911690 |
| 0.454148 | 1.312963 | 0.911690 |
| 0.480282 | 1.255766 | 0.911690 |
| 0.504843 | 1.197862 | 0.911690 |
| 0.528710 | 1.139674 | 0.911690 |
| 0.552094 | 1.081288 | 0.911690 |
| 0.575256 | 1.022815 | 0.911690 |

TABLE 1-continued

| Airfoil Surface (Normalized) | | |
|---|---|---|
| X/Bx | Y/Bx | Span Fraction |
| 0.598578 | 0.964403 | 0.911690 |
| 0.622061 | 0.906054 | 0.911690 |
| 0.645681 | 0.847767 | 0.911690 |
| 0.669734 | 0.789653 | 0.911690 |
| 0.694444 | 0.731812 | 0.911690 |
| 0.719735 | 0.674230 | 0.911690 |
| 0.745262 | 0.616748 | 0.911690 |
| 0.770678 | 0.559216 | 0.911690 |
| 0.794843 | 0.503431 | 0.911690 |
| 0.818673 | 0.447497 | 0.911690 |
| 0.841549 | 0.393433 | 0.911690 |
| 0.862902 | 0.343283 | 0.911690 |
| 0.883611 | 0.295140 | 0.911690 |
| 0.902772 | 0.250898 | 0.911690 |
| 0.920323 | 0.210508 | 0.911690 |
| 0.936201 | 0.173983 | 0.911690 |
| 0.950420 | 0.141297 | 0.911690 |
| 0.962954 | 0.112463 | 0.911690 |
| 0.973817 | 0.087468 | 0.911690 |
| 0.983007 | 0.066313 | 0.911690 |
| 0.990525 | 0.049010 | 0.911690 |
| 0.996371 | 0.035547 | 0.911690 |
| 1.000000 | 0.025713 | 0.911690 |
| 0.999851 | 0.017328 | 0.911690 |
| 0.997671 | 0.011432 | 0.911690 |
| 0.995318 | 0.007964 | 0.911690 |
| 0.992358 | 0.004991 | 0.911690 |
| 0.990674 | 0.003740 | 0.911690 |
| 0.988890 | 0.002651 | 0.911690 |
| 0.987329 | 0.001883 | 0.911690 |
| 0.985719 | 0.001251 | 0.911690 |
| 0.982350 | 0.000359 | 0.911690 |
| 0.978907 | 0.000000 | 0.911690 |
| 0.973717 | 0.000520 | 0.911690 |
| 0.967264 | 0.003059 | 0.911690 |
| 0.960824 | 0.008881 | 0.911690 |
| 0.954098 | 0.019000 | 0.911690 |
| 0.945478 | 0.032030 | 0.911690 |
| 0.934950 | 0.047945 | 0.911690 |
| 0.922490 | 0.066759 | 0.911690 |
| 0.908135 | 0.088471 | 0.911690 |
| 0.891848 | 0.113082 | 0.911690 |
| 0.873653 | 0.140578 | 0.911690 |
| 0.853551 | 0.170985 | 0.911690 |
| 0.831517 | 0.204266 | 0.911690 |
| 0.807575 | 0.240457 | 0.911690 |
| 0.782643 | 0.278060 | 0.911690 |
| 0.755654 | 0.318475 | 0.911690 |
| 0.727464 | 0.360177 | 0.911690 |
| 0.698903 | 0.401620 | 0.911690 |
| 0.669041 | 0.444264 | 0.911690 |
| 0.639315 | 0.487007 | 0.911690 |
| 0.610307 | 0.530258 | 0.911690 |
| 0.582514 | 0.574290 | 0.911690 |
| 0.555872 | 0.619015 | 0.911690 |
| 0.529825 | 0.664099 | 0.911690 |
| 0.504124 | 0.709381 | 0.911690 |
| 0.479180 | 0.755084 | 0.911690 |
| 0.455325 | 0.801370 | 0.911690 |
| 0.432622 | 0.848225 | 0.911690 |
| 0.411776 | 0.895935 | 0.911690 |
| 0.392393 | 0.944252 | 0.911690 |
| 0.372179 | 0.992234 | 0.911690 |
| 0.349749 | 1.039226 | 0.911690 |
| 0.325906 | 1.083554 | 0.911690 |
| 0.299995 | 1.126706 | 0.911690 |
| 0.272672 | 1.166885 | 0.911690 |
| 0.244878 | 1.202445 | 0.911690 |
| 0.215611 | 1.234462 | 0.911690 |
| 0.186232 | 1.261488 | 0.911690 |
| 0.156865 | 1.283076 | 0.911690 |
| 0.127908 | 1.298856 | 0.911690 |
| 0.100733 | 1.310362 | 0.911690 |
| 0.076470 | 1.319787 | 0.911690 |

TABLE 1-continued

| Airfoil Surface (Normalized) | | |
|---|---|---|
| X/Bx | Y/Bx | Span Fraction |
| 0.055847 | 1.328928 | 0.911690 |
| 0.038730 | 1.337375 | 0.911690 |
| 0.024895 | 1.344633 | 0.911690 |
| 0.014677 | 1.351210 | 0.911690 |
| 0.008336 | 1.357130 | 0.911690 |
| 0.004434 | 1.362865 | 0.911690 |
| 0.002390 | 1.367658 | 0.911690 |
| 0.001474 | 1.371003 | 0.911690 |
| 0.000768 | 1.374409 | 0.911690 |
| 0.000508 | 1.376118 | 0.911690 |
| 0.000111 | 1.379933 | 0.911690 |
| 0.000000 | 1.382026 | 0.911690 |
| | Section 14 | |
| 0.000000 | 1.396684 | 0.941207 |
| 0.000252 | 1.400848 | 0.941207 |
| 0.001098 | 1.407044 | 0.941207 |
| 0.002966 | 1.415184 | 0.941207 |
| 0.006348 | 1.425052 | 0.941207 |
| 0.012430 | 1.438316 | 0.941207 |
| 0.020936 | 1.455049 | 0.941207 |
| 0.032824 | 1.474673 | 0.941207 |
| 0.049204 | 1.496290 | 0.941207 |
| 0.070872 | 1.518854 | 0.941207 |
| 0.098988 | 1.540458 | 0.941207 |
| 0.134676 | 1.557684 | 0.941207 |
| 0.177835 | 1.565180 | 0.941207 |
| 0.225184 | 1.557406 | 0.941207 |
| 0.271712 | 1.533871 | 0.941207 |
| 0.314518 | 1.500568 | 0.941207 |
| 0.355594 | 1.459062 | 0.941207 |
| 0.392797 | 1.411360 | 0.941207 |
| 0.425040 | 1.360188 | 0.941207 |
| 0.453573 | 1.304498 | 0.941207 |
| 0.479657 | 1.247621 | 0.941207 |
| 0.504594 | 1.190227 | 0.941207 |
| 0.529063 | 1.132644 | 0.941207 |
| 0.553154 | 1.074897 | 0.941207 |
| 0.577030 | 1.017049 | 0.941207 |
| 0.600868 | 0.959201 | 0.941207 |
| 0.624732 | 0.901353 | 0.941207 |
| 0.648583 | 0.843505 | 0.941207 |
| 0.672762 | 0.785795 | 0.941207 |
| 0.697522 | 0.728326 | 0.941207 |
| 0.722761 | 0.671071 | 0.941207 |
| 0.748176 | 0.613892 | 0.941207 |
| 0.773441 | 0.556649 | 0.941207 |
| 0.797418 | 0.501111 | 0.941207 |
| 0.821042 | 0.445433 | 0.941207 |
| 0.843744 | 0.391623 | 0.941207 |
| 0.864983 | 0.341725 | 0.941207 |
| 0.885629 | 0.293834 | 0.941207 |
| 0.904747 | 0.249842 | 0.941207 |
| 0.922276 | 0.209699 | 0.941207 |
| 0.938151 | 0.173393 | 0.941207 |
| 0.952361 | 0.140898 | 0.941207 |
| 0.964892 | 0.112238 | 0.941207 |
| 0.975770 | 0.087403 | 0.941207 |
| 0.984692 | 0.066265 | 0.941207 |
| 0.991987 | 0.048964 | 0.941207 |
| 0.997514 | 0.035474 | 0.941207 |
| 1.000000 | 0.025340 | 0.941207 |
| 0.998902 | 0.017074 | 0.941207 |
| 0.996265 | 0.011395 | 0.941207 |
| 0.993753 | 0.008077 | 0.941207 |
| 0.990712 | 0.005225 | 0.941207 |
| 0.989021 | 0.004000 | 0.941207 |
| 0.987229 | 0.002915 | 0.941207 |
| 0.985677 | 0.002145 | 0.941207 |
| 0.984061 | 0.001476 | 0.941207 |
| 0.980730 | 0.000517 | 0.941207 |
| 0.977285 | 0.000000 | 0.941207 |
| 0.972073 | 0.000189 | 0.941207 |
| 0.965397 | 0.002145 | 0.941207 |

TABLE 1-continued

| Airfoil Surface (Normalized) | | |
|---|---|---|
| X/Bx | Y/Bx | Span Fraction |
| 0.958305 | 0.007193 | 0.941207 |
| 0.950645 | 0.016658 | 0.941207 |
| 0.941698 | 0.029505 | 0.941207 |
| 0.931148 | 0.045468 | 0.941207 |
| 0.918679 | 0.064335 | 0.941207 |
| 0.904306 | 0.086103 | 0.941207 |
| 0.888039 | 0.110800 | 0.941207 |
| 0.869854 | 0.138399 | 0.941207 |
| 0.849814 | 0.168938 | 0.941207 |
| 0.827856 | 0.202380 | 0.941207 |
| 0.803968 | 0.238712 | 0.941207 |
| 0.779069 | 0.276470 | 0.941207 |
| 0.752152 | 0.317054 | 0.941207 |
| 0.724023 | 0.358938 | 0.941207 |
| 0.695540 | 0.400558 | 0.941207 |
| 0.665758 | 0.443414 | 0.941207 |
| 0.636039 | 0.486308 | 0.941207 |
| 0.606850 | 0.529568 | 0.941207 |
| 0.578557 | 0.573421 | 0.941207 |
| 0.551223 | 0.617867 | 0.941207 |
| 0.524608 | 0.662755 | 0.941207 |
| 0.498700 | 0.708046 | 0.941207 |
| 0.473903 | 0.753969 | 0.941207 |
| 0.450317 | 0.800510 | 0.941207 |
| 0.427677 | 0.847530 | 0.941207 |
| 0.406464 | 0.895207 | 0.941207 |
| 0.386474 | 0.943414 | 0.941207 |
| 0.365778 | 0.991318 | 0.941207 |
| 0.343227 | 1.038376 | 0.941207 |
| 0.319616 | 1.082948 | 0.941207 |
| 0.294187 | 1.126511 | 0.941207 |
| 0.267371 | 1.167171 | 0.941207 |
| 0.239898 | 1.203099 | 0.941207 |
| 0.210898 | 1.235506 | 0.941207 |
| 0.181873 | 1.263042 | 0.941207 |
| 0.153038 | 1.285467 | 0.941207 |
| 0.124744 | 1.302554 | 0.941207 |
| 0.098193 | 1.315552 | 0.941207 |
| 0.074443 | 1.326367 | 0.941207 |
| 0.054315 | 1.336652 | 0.941207 |
| 0.037669 | 1.346104 | 0.941207 |
| 0.024242 | 1.354156 | 0.941207 |
| 0.014361 | 1.361273 | 0.941207 |
| 0.008278 | 1.367495 | 0.941207 |
| 0.004530 | 1.373350 | 0.941207 |
| 0.002511 | 1.378158 | 0.941207 |
| 0.001590 | 1.381515 | 0.941207 |
| 0.000858 | 1.384922 | 0.941207 |
| 0.000581 | 1.386638 | 0.941207 |
| 0.000151 | 1.390437 | 0.941207 |
| 0.000025 | 1.392519 | 0.941207 |
| 0.000000 | 1.396684 | 0.941207 |
| | Section 15 | |
| 0.000000 | 1.405282 | 0.970604 |
| 0.000592 | 1.411476 | 0.970604 |
| 0.002382 | 1.419576 | 0.970604 |
| 0.006091 | 1.429272 | 0.970604 |
| 0.012942 | 1.442072 | 0.970604 |
| 0.022548 | 1.458078 | 0.970604 |
| 0.035502 | 1.476866 | 0.970604 |
| 0.052642 | 1.497676 | 0.970604 |
| 0.074829 | 1.519490 | 0.970604 |
| 0.103648 | 1.539810 | 0.970604 |
| 0.140193 | 1.554567 | 0.970604 |
| 0.183499 | 1.559254 | 0.970604 |
| 0.230346 | 1.550227 | 0.970604 |
| 0.276704 | 1.526997 | 0.970604 |
| 0.319173 | 1.493748 | 0.970604 |
| 0.358461 | 1.450983 | 0.970604 |
| 0.392457 | 1.401368 | 0.970604 |
| 0.421997 | 1.348958 | 0.970604 |
| 0.449618 | 1.293212 | 0.970604 |
| 0.475836 | 1.236772 | 0.970604 |

TABLE 1-continued

| Airfoil Surface (Normalized) | | |
|---|---|---|
| X/Bx | Y/Bx | Span Fraction |
| 0.501449 | 1.180061 | 0.970604 |
| 0.526855 | 1.123260 | 0.970604 |
| 0.552133 | 1.066395 | 0.970604 |
| 0.577218 | 1.009452 | 0.970604 |
| 0.602084 | 0.952406 | 0.970604 |
| 0.626743 | 0.895283 | 0.970604 |
| 0.651261 | 0.838083 | 0.970604 |
| 0.675960 | 0.780973 | 0.970604 |
| 0.701122 | 0.724056 | 0.970604 |
| 0.726657 | 0.667319 | 0.970604 |
| 0.752295 | 0.610621 | 0.970604 |
| 0.777715 | 0.553820 | 0.970604 |
| 0.801731 | 0.498667 | 0.970604 |
| 0.825334 | 0.443334 | 0.970604 |
| 0.847972 | 0.389855 | 0.970604 |
| 0.869130 | 0.340253 | 0.970604 |
| 0.889669 | 0.292646 | 0.970604 |
| 0.908650 | 0.248876 | 0.970604 |
| 0.926047 | 0.208944 | 0.970604 |
| 0.941795 | 0.172811 | 0.970604 |
| 0.955896 | 0.140490 | 0.970604 |
| 0.968335 | 0.111980 | 0.970604 |
| 0.979113 | 0.087255 | 0.970604 |
| 0.988256 | 0.066356 | 0.970604 |
| 0.995055 | 0.048998 | 0.970604 |
| 0.999433 | 0.035193 | 0.970604 |
| 1.000000 | 0.024840 | 0.970604 |
| 0.997708 | 0.016869 | 0.970604 |
| 0.994527 | 0.011525 | 0.970604 |
| 0.991797 | 0.008396 | 0.970604 |
| 0.988655 | 0.005679 | 0.970604 |
| 0.986943 | 0.004507 | 0.970604 |
| 0.985166 | 0.003451 | 0.970604 |
| 0.983607 | 0.002666 | 0.970604 |
| 0.982011 | 0.001983 | 0.970604 |
| 0.978701 | 0.000901 | 0.970604 |
| 0.975289 | 0.000219 | 0.970604 |
| 0.970086 | 0.000000 | 0.970604 |
| 0.963223 | 0.001172 | 0.970604 |
| 0.955406 | 0.004971 | 0.970604 |
| 0.946418 | 0.013173 | 0.970604 |
| 0.937044 | 0.025716 | 0.970604 |
| 0.926549 | 0.041696 | 0.970604 |
| 0.914109 | 0.060587 | 0.970604 |
| 0.899790 | 0.082388 | 0.970604 |
| 0.883578 | 0.107099 | 0.970604 |
| 0.865473 | 0.134734 | 0.970604 |
| 0.845500 | 0.165317 | 0.970604 |
| 0.823622 | 0.198797 | 0.970604 |
| 0.799838 | 0.235175 | 0.970604 |
| 0.775036 | 0.272982 | 0.970604 |
| 0.748226 | 0.313636 | 0.970604 |
| 0.720218 | 0.355564 | 0.970604 |
| 0.691837 | 0.397247 | 0.970604 |
| 0.662142 | 0.440141 | 0.970604 |
| 0.632396 | 0.483009 | 0.970604 |
| 0.602895 | 0.526031 | 0.970604 |
| 0.573870 | 0.569376 | 0.970604 |
| 0.545566 | 0.613196 | 0.970604 |
| 0.518150 | 0.657584 | 0.970604 |
| 0.491920 | 0.702680 | 0.970604 |
| 0.467311 | 0.748677 | 0.970604 |
| 0.444107 | 0.795395 | 0.970604 |
| 0.421533 | 0.842422 | 0.970604 |
| 0.399797 | 0.889849 | 0.970604 |
| 0.378897 | 0.937649 | 0.970604 |
| 0.357547 | 0.985256 | 0.970604 |
| 0.334960 | 1.032283 | 0.970604 |
| 0.311962 | 1.077160 | 0.970604 |
| 0.287598 | 1.121316 | 0.970604 |
| 0.261870 | 1.162651 | 0.970604 |
| 0.235201 | 1.199158 | 0.970604 |
| 0.206858 | 1.232123 | 0.970604 |
| 0.178503 | 1.260324 | 0.970604 |

TABLE 1-continued

| Airfoil Surface (Normalized) | | |
|---|---|---|
| X/Bx | Y/Bx | Span Fraction |
| 0.150456 | 1.283709 | 0.970604 |
| 0.123105 | 1.302252 | 0.970604 |
| 0.097390 | 1.316829 | 0.970604 |
| 0.074211 | 1.328792 | 0.970604 |
| 0.054393 | 1.339686 | 0.970604 |
| 0.038039 | 1.349589 | 0.970604 |
| 0.024969 | 1.358203 | 0.970604 |
| 0.015478 | 1.365827 | 0.970604 |
| 0.009632 | 1.372265 | 0.970604 |
| 0.005872 | 1.378111 | 0.970604 |
| 0.003696 | 1.382850 | 0.970604 |
| 0.002563 | 1.386147 | 0.970604 |
| 0.001635 | 1.389495 | 0.970604 |
| 0.001249 | 1.391195 | 0.970604 |
| 0.000579 | 1.394942 | 0.970604 |
| 0.000309 | 1.397002 | 0.970604 |
| 0.000000 | 1.401136 | 0.970604 |
| | Section 16 | |
| 0.000000 | 1.399556 | 1.000000 |
| 0.000013 | 1.405727 | 1.000000 |
| 0.001431 | 1.413827 | 1.000000 |
| 0.005238 | 1.423384 | 1.000000 |
| 0.012734 | 1.435672 | 1.000000 |
| 0.023421 | 1.450796 | 1.000000 |
| 0.037350 | 1.468637 | 1.000000 |
| 0.055046 | 1.488670 | 1.000000 |
| 0.077443 | 1.509899 | 1.000000 |
| 0.106666 | 1.529105 | 1.000000 |
| 0.143767 | 1.541380 | 1.000000 |
| 0.186906 | 1.543546 | 1.000000 |
| 0.233327 | 1.534370 | 1.000000 |
| 0.280077 | 1.512944 | 1.000000 |
| 0.322625 | 1.480544 | 1.000000 |
| 0.359594 | 1.436368 | 1.000000 |
| 0.389041 | 1.384498 | 1.000000 |
| 0.414851 | 1.330712 | 1.000000 |
| 0.441461 | 1.275035 | 1.000000 |
| 0.467993 | 1.219319 | 1.000000 |
| 0.494539 | 1.163617 | 1.000000 |
| 0.521255 | 1.107979 | 1.000000 |
| 0.548128 | 1.052434 | 1.000000 |
| 0.574909 | 0.996836 | 1.000000 |
| 0.601231 | 0.941015 | 1.000000 |
| 0.627081 | 0.884984 | 1.000000 |
| 0.652641 | 0.828822 | 1.000000 |
| 0.678215 | 0.772659 | 1.000000 |
| 0.704104 | 0.716641 | 1.000000 |
| 0.730268 | 0.660755 | 1.000000 |
| 0.756472 | 0.604881 | 1.000000 |
| 0.782295 | 0.548837 | 1.000000 |
| 0.806530 | 0.494329 | 1.000000 |
| 0.830253 | 0.439597 | 1.000000 |
| 0.852938 | 0.386651 | 1.000000 |
| 0.874022 | 0.337499 | 1.000000 |
| 0.894371 | 0.290277 | 1.000000 |
| 0.913078 | 0.246810 | 1.000000 |
| 0.930171 | 0.207150 | 1.000000 |
| 0.945623 | 0.171244 | 1.000000 |
| 0.959460 | 0.139132 | 1.000000 |
| 0.971656 | 0.110789 | 1.000000 |
| 0.982251 | 0.086239 | 1.000000 |
| 0.991191 | 0.065457 | 1.000000 |
| 0.998346 | 0.048377 | 1.000000 |
| 1.000000 | 0.034081 | 1.000000 |
| 0.997781 | 0.024038 | 1.000000 |
| 0.994053 | 0.016699 | 1.000000 |
| 0.990259 | 0.011828 | 1.000000 |
| 0.987305 | 0.008967 | 1.000000 |
| 0.984049 | 0.006459 | 1.000000 |
| 0.982316 | 0.005330 | 1.000000 |
| 0.980531 | 0.004319 | 1.000000 |
| 0.978995 | 0.003531 | 1.000000 |
| 0.977420 | 0.002809 | 1.000000 |

TABLE 1-continued

| Airfoil Surface (Normalized) | | |
|---|---|---|
| X/Bx | Y/Bx | Span Fraction |
| 0.974164 | 0.001628 | 1.000000 |
| 0.970829 | 0.000735 | 1.000000 |
| 0.965683 | 0.000000 | 1.000000 |
| 0.958764 | 0.000144 | 1.000000 |
| 0.950349 | 0.002127 | 1.000000 |
| 0.939781 | 0.008048 | 1.000000 |
| 0.929764 | 0.019968 | 1.000000 |
| 0.919380 | 0.035919 | 1.000000 |
| 0.907092 | 0.054758 | 1.000000 |
| 0.892913 | 0.076498 | 1.000000 |
| 0.876858 | 0.101140 | 1.000000 |
| 0.858898 | 0.128669 | 1.000000 |
| 0.839048 | 0.159114 | 1.000000 |
| 0.817308 | 0.192446 | 1.000000 |
| 0.793691 | 0.228680 | 1.000000 |
| 0.769115 | 0.266358 | 1.000000 |
| 0.742543 | 0.306871 | 1.000000 |
| 0.714738 | 0.348632 | 1.000000 |
| 0.686565 | 0.390156 | 1.000000 |
| 0.657039 | 0.432849 | 1.000000 |
| 0.627265 | 0.475358 | 1.000000 |
| 0.597372 | 0.517802 | 1.000000 |
| 0.567453 | 0.560206 | 1.000000 |
| 0.537914 | 0.602899 | 1.000000 |
| 0.509518 | 0.646340 | 1.000000 |
| 0.482933 | 0.690923 | 1.000000 |
| 0.458607 | 0.736780 | 1.000000 |
| 0.435934 | 0.783464 | 1.000000 |
| 0.413485 | 0.830266 | 1.000000 |
| 0.391075 | 0.877094 | 1.000000 |
| 0.369007 | 0.924067 | 1.000000 |
| 0.346833 | 0.971000 | 1.000000 |
| 0.324358 | 1.017789 | 1.000000 |
| 0.302460 | 1.062937 | 1.000000 |
| 0.279853 | 1.107730 | 1.000000 |
| 0.255934 | 1.149858 | 1.000000 |
| 0.230636 | 1.187063 | 1.000000 |
| 0.203461 | 1.220698 | 1.000000 |
| 0.176154 | 1.249659 | 1.000000 |
| 0.149202 | 1.274025 | 1.000000 |
| 0.123155 | 1.294084 | 1.000000 |
| 0.098606 | 1.310271 | 1.000000 |
| 0.076078 | 1.323176 | 1.000000 |
| 0.056451 | 1.334152 | 1.000000 |
| 0.040159 | 1.343998 | 1.000000 |
| 0.027425 | 1.352951 | 1.000000 |
| 0.018393 | 1.361025 | 1.000000 |
| 0.012800 | 1.367615 | 1.000000 |
| 0.008927 | 1.373352 | 1.000000 |
| 0.006380 | 1.377882 | 1.000000 |
| 0.004897 | 1.381006 | 1.000000 |
| 0.003584 | 1.384209 | 1.000000 |
| 0.002993 | 1.385837 | 1.000000 |
| 0.001877 | 1.389461 | 1.000000 |
| 0.001339 | 1.391443 | 1.000000 |
| 0.000499 | 1.395473 | 1.000000 |
| 0.000000 | 1.399556 | 1.000000 |

Table 2, Axial Chord Distribution, tabulates the variation in the radial direction of the axial chord of each of the cold, uncoated blade sections shown in FIG. 6. The airfoil sections each have a unique axial chord, and this chord is used in normalizing the airfoil section coordinates. For simplicity the local axial chord has been normalized by the root axial chord. So, for example, the tip section has an axial chord that is only 65.9% of the length of the root section (typical of a turbine blade).

TABLE 2

| Axial Chord Distribution | |
|---|---|
| Radial Span Fraction | Bx/BxRoot |
| 0.000000 | 1.000000 |
| 0.053543 | 0.977986 |
| 0.142782 | 0.945969 |
| 0.249869 | 0.915206 |
| 0.375013 | 0.887715 |
| 0.499738 | 0.859176 |
| 0.624987 | 0.819432 |
| 0.688714 | 0.794787 |
| 0.750131 | 0.768499 |
| 0.796325 | 0.747809 |
| 0.835696 | 0.730424 |
| 0.875066 | 0.714121 |
| 0.911690 | 0.698649 |
| 0.941207 | 0.685704 |
| 0.970604 | 0.671988 |
| 1.000000 | 0.659138 |

Table 3, Radial Stacking Distribution, tabulates the offsets for cold, uncoated blades required to accurately stack the blade airfoil sections of FIG. 6 relative to one another in accord with the sections as dimensioned in the foregoing. For example, the leading edge points are not all lined up along a radial line, there is some axial sweep and tangential lean to the three dimensional blade shape. A radial distribution of axial and tangential offsets is supplied, all relative to the root section. The offsets are normalized by the root axial chord in the axial direction and by the root pitch in the tangential direction.

TABLE 3

| Radial Stacking Distribution | | |
|---|---|---|
| Radial Span Fraction | Axial Offset (Normalized by Root Bx) of LE Point Relative to Root LE | Tangential Offset (Normalized By Root Pitch) of LE Point Relative to Root LE |
| 0.000000 | 0.00000 | 0.00000 |
| 0.053543 | 0.02198 | −0.01591 |
| 0.142782 | 0.05290 | −0.03948 |
| 0.249869 | 0.08066 | −0.06302 |
| 0.375013 | 0.10232 | −0.08381 |
| 0.499738 | 0.12246 | −0.09666 |
| 0.624987 | 0.14962 | −0.09909 |
| 0.688714 | 0.16394 | −0.09320 |
| 0.750131 | 0.17619 | −0.08087 |
| 0.796325 | 0.18304 | −0.06628 |
| 0.835696 | 0.18646 | −0.04983 |
| 0.875066 | 0.18695 | −0.02916 |
| 0.911690 | 0.18632 | −0.00568 |
| 0.941207 | 0.18587 | 0.01662 |
| 0.970604 | 0.18551 | 0.04186 |
| 1.000000 | 0.18491 | 0.07030 |

Table 4, Inner Diameter Flowpath, tabulates the normalized coordinates of the cold, uncoated ring platform surface forming the inner diameter passageway limit described above with a surface profile tolerance of ±0.0500 in. including coating and manufacturing variability. The ring platform surface, or flowpath, is a three dimensional shape that begins upstream of the root section leading edge and concludes downstream of the root section trailing edge. The flowpath varies in radius from the engine centerline with both axial and tangential position, and so the coordinates describe a surface rather than a line. The axial coordinate is normalized by the root axial chord, the tangential coordinate is normalized by the root pitch, and the radial coordinate is normalized by the airfoil span. The origin (0,0,0) of the surface is aligned with the root section leading edge. The surface platform surface dips below the root section radius in some places which leads to negative radial values in the table for those locations.

TABLE 4

| Inner Diameter Flowpath | | |
|---|---|---|
| X/Root_Bx | Y/Root_Pitch | Z/Span |
| −0.614825 | −1.622024 | −0.167559 |
| −0.614825 | −1.573205 | −0.162677 |
| −0.614825 | −1.524294 | −0.158005 |
| −0.614825 | −1.475383 | −0.153438 |
| −0.614825 | −1.426471 | −0.149029 |
| −0.614825 | −1.377468 | −0.144777 |
| −0.614825 | −1.328371 | −0.140682 |
| −0.614825 | −1.279368 | −0.136693 |
| −0.614825 | −1.230271 | −0.132861 |
| −0.614825 | −1.181083 | −0.129186 |
| −0.614825 | −1.131894 | −0.125669 |
| −0.614825 | −1.082705 | −0.122257 |
| −0.614825 | −1.033517 | −0.119055 |
| −0.614825 | −0.984236 | −0.115958 |
| −0.614825 | −0.934954 | −0.112966 |
| −0.614825 | −0.885581 | −0.110184 |
| −0.614825 | −0.836207 | −0.107559 |
| −0.614825 | −0.786926 | −0.105039 |
| −0.614825 | −0.737460 | −0.102677 |
| −0.614825 | −0.688087 | −0.100472 |
| −0.614825 | −0.638620 | −0.098373 |
| −0.614825 | −0.589154 | −0.096483 |
| −0.614825 | −0.539688 | −0.094698 |
| −0.614825 | −0.490222 | −0.093071 |
| −0.614825 | −0.440756 | −0.091601 |
| −0.614825 | −0.391198 | −0.090236 |
| −0.614825 | −0.341732 | −0.089081 |
| −0.614825 | −0.292173 | −0.088031 |
| −0.614825 | −0.242615 | −0.087139 |
| −0.614825 | −0.193056 | −0.086404 |
| −0.614825 | −0.143590 | −0.085827 |
| −0.614825 | −0.094032 | −0.085354 |
| −0.614825 | −0.044381 | −0.085039 |
| −0.614825 | 0.005178 | −0.084934 |
| −0.614825 | 0.054736 | −0.084882 |
| −0.614825 | 0.104295 | −0.085039 |
| −0.614825 | 0.153853 | −0.085354 |
| −0.614825 | 0.203412 | −0.085774 |
| −0.614825 | 0.252970 | −0.086352 |
| −0.614825 | 0.302529 | −0.087087 |
| −0.614825 | 0.351995 | −0.087979 |
| −0.614825 | 0.401553 | −0.088976 |
| −0.614825 | 0.451112 | −0.090184 |
| −0.614825 | 0.500578 | −0.091496 |
| −0.614825 | 0.550136 | −0.092966 |
| −0.614825 | 0.599602 | −0.094593 |
| −0.614825 | 0.649068 | −0.096325 |
| −0.614825 | 0.698535 | −0.098215 |
| −0.614825 | 0.747908 | −0.100315 |
| −0.614825 | 0.797374 | −0.102520 |
| −0.614825 | 0.846748 | −0.104829 |
| −0.614825 | 0.896121 | −0.107349 |
| −0.614825 | 0.945495 | −0.109974 |
| −0.614825 | 0.994776 | −0.112756 |
| −0.614825 | 1.044057 | −0.115696 |
| −0.614825 | 1.093338 | −0.118793 |
| −0.614825 | 1.142619 | −0.121995 |
| −0.614825 | 1.191808 | −0.125407 |
| −0.614825 | 1.240997 | −0.128924 |
| −0.614825 | 1.290093 | −0.132598 |
| −0.614825 | 1.339189 | −0.136378 |
| −0.614825 | 1.388285 | −0.140367 |
| −0.614825 | 1.437289 | −0.144462 |
| −0.614825 | 1.486293 | −0.148714 |
| −0.614825 | 1.535297 | −0.153123 |
| −0.614825 | 1.584208 | −0.157638 |
| −0.614825 | 1.633027 | −0.162362 |
| −0.614825 | 1.681938 | −0.167192 |
| −0.614825 | 1.730664 | −0.172126 |
| −0.614825 | 1.779391 | −0.177270 |

TABLE 4-continued

| Inner Diameter Flowpath | | |
|---|---|---|
| X/Root_Bx | Y/Root_Pitch | Z/Span |
| −0.614825 | 1.828117 | −0.182520 |
| −0.614825 | 1.876751 | −0.187927 |
| −0.614825 | 1.925292 | −0.193491 |
| −0.614825 | 1.973834 | −0.199213 |
| −0.614825 | 2.022375 | −0.205039 |
| −0.614825 | 2.070824 | −0.211024 |
| −0.614825 | 2.119181 | −0.217165 |
| −0.614825 | 2.167445 | −0.223465 |
| −0.614825 | 2.215709 | −0.229869 |
| −0.614825 | 2.263973 | −0.236430 |
| −0.614825 | 2.312052 | −0.243150 |
| −0.571558 | −1.613795 | −0.162835 |
| −0.571558 | −1.564976 | −0.158005 |
| −0.571558 | −1.516065 | −0.153333 |
| −0.571558 | −1.467061 | −0.148819 |
| −0.571558 | −1.418057 | −0.144409 |
| −0.571558 | −1.369054 | −0.140210 |
| −0.571558 | −1.319957 | −0.136115 |
| −0.571558 | −1.270861 | −0.132178 |
| −0.571558 | −1.221673 | −0.128346 |
| −0.571558 | −1.172484 | −0.124724 |
| −0.571558 | −1.123295 | −0.121207 |
| −0.571558 | −1.074107 | −0.117848 |
| −0.571558 | −1.024825 | −0.114646 |
| −0.571558 | −0.975452 | −0.111549 |
| −0.571558 | −0.926171 | −0.108609 |
| −0.571558 | −0.876797 | −0.105879 |
| −0.571558 | −0.827424 | −0.103255 |
| −0.571558 | −0.777958 | −0.100735 |
| −0.571558 | −0.728584 | −0.098425 |
| −0.571558 | −0.679118 | −0.096220 |
| −0.571558 | −0.629652 | −0.094173 |
| −0.571558 | −0.580186 | −0.092283 |
| −0.571558 | −0.530627 | −0.090551 |
| −0.571558 | −0.481161 | −0.088976 |
| −0.571558 | −0.431603 | −0.087507 |
| −0.571558 | −0.382044 | −0.086194 |
| −0.571558 | −0.332486 | −0.085039 |
| −0.571558 | −0.282927 | −0.084042 |
| −0.571558 | −0.233369 | −0.083150 |
| −0.571558 | −0.183718 | −0.082467 |
| −0.571558 | −0.134159 | −0.081890 |
| −0.571558 | −0.084601 | −0.081470 |
| −0.571558 | −0.034950 | −0.081207 |
| −0.571558 | 0.014609 | −0.081050 |
| −0.571558 | 0.064260 | −0.081102 |
| −0.571558 | 0.113818 | −0.081260 |
| −0.571558 | 0.163377 | −0.081575 |
| −0.571558 | 0.213028 | −0.082047 |
| −0.571558 | 0.262586 | −0.082677 |
| −0.571558 | 0.312145 | −0.083412 |
| −0.571558 | 0.361796 | −0.084304 |
| −0.571558 | 0.411354 | −0.085354 |
| −0.571558 | 0.460913 | −0.086562 |
| −0.571558 | 0.510471 | −0.087927 |
| −0.571558 | 0.559937 | −0.089449 |
| −0.571558 | 0.609496 | −0.091076 |
| −0.571558 | 0.658962 | −0.092861 |
| −0.571558 | 0.708428 | −0.094803 |
| −0.571558 | 0.757894 | −0.096903 |
| −0.571558 | 0.807360 | −0.099108 |
| −0.571558 | 0.856826 | −0.101522 |
| −0.571558 | 0.906199 | −0.104042 |
| −0.571558 | 0.955573 | −0.106719 |
| −0.571558 | 1.004947 | −0.109501 |
| −0.571558 | 1.054228 | −0.112493 |
| −0.571558 | 1.103509 | −0.115591 |
| −0.571558 | 1.152790 | −0.118845 |
| −0.571558 | 1.202071 | −0.122257 |
| −0.571558 | 1.251260 | −0.125827 |
| −0.571558 | 1.300448 | −0.129501 |
| −0.571558 | 1.349545 | −0.133333 |
| −0.571558 | 1.398641 | −0.137323 |
| −0.571558 | 1.447737 | −0.141470 |
| −0.571558 | 1.496741 | −0.145774 |

TABLE 4-continued

| Inner Diameter Flowpath | | |
|---|---|---|
| X/Root_Bx | Y/Root_Pitch | Z/Span |
| −0.571558 | 1.545745 | −0.150184 |
| −0.571558 | 1.594656 | −0.154751 |
| −0.571558 | 1.643567 | −0.159475 |
| −0.571558 | 1.692386 | −0.164357 |
| −0.571558 | 1.741205 | −0.169344 |
| −0.571558 | 1.790024 | −0.174488 |
| −0.571558 | 1.838750 | −0.179790 |
| −0.571558 | 1.887384 | −0.185249 |
| −0.571558 | 1.936018 | −0.190814 |
| −0.571558 | 1.964559 | −0.196588 |
| −0.571558 | 2.033101 | −0.202467 |
| −0.571558 | 2.081550 | −0.208451 |
| −0.571558 | 2.129906 | −0.214646 |
| −0.571558 | 2.178263 | −0.220945 |
| −0.571558 | 2.226527 | −0.227402 |
| −0.571558 | 2.274791 | −0.234016 |
| −0.571558 | 2.322870 | −0.240735 |
| −0.528292 | −1.605659 | −0.158110 |
| −0.528292 | −1.556747 | −0.153333 |
| −0.528292 | −1.507744 | −0.148661 |
| −0.528292 | −1.458740 | −0.144199 |
| −0.528292 | −1.409736 | −0.139843 |
| −0.528292 | −1.360640 | −0.135591 |
| −0.528292 | −1.311544 | −0.131549 |
| −0.528292 | −1.262355 | −0.127612 |
| −0.528292 | −1.213166 | −0.123832 |
| −0.528292 | −1.163978 | −0.120210 |
| −0.528292 | −1.114697 | −0.116745 |
| −0.528292 | −1.065415 | −0.113386 |
| −0.528292 | −1.016134 | −0.110236 |
| −0.528292 | −0.966761 | −0.107192 |
| −0.528292 | −0.917387 | −0.104304 |
| −0.528292 | −0.868013 | −0.101522 |
| −0.528292 | −0.818547 | −0.098950 |
| −0.528292 | −0.769081 | −0.096483 |
| −0.528292 | −0.719615 | −0.094173 |
| −0.528292 | −0.670149 | −0.092021 |
| −0.528292 | −0.620591 | −0.089974 |
| −0.528292 | −0.571125 | −0.088136 |
| −0.528292 | −0.521566 | −0.086404 |
| −0.528292 | −0.472008 | −0.084829 |
| −0.528292 | −0.422449 | −0.083412 |
| −0.528292 | −0.372891 | −0.082152 |
| −0.528292 | −0.323240 | −0.080997 |
| −0.528292 | −0.273681 | −0.080052 |
| −0.528292 | −0.224030 | −0.079213 |
| −0.528292 | −0.174379 | −0.078530 |
| −0.528292 | −0.124821 | −0.077953 |
| −0.528292 | −0.075170 | −0.077585 |
| −0.528292 | −0.025519 | −0.077323 |
| −0.528292 | 0.024132 | −0.077218 |
| −0.528292 | 0.073783 | −0.077270 |
| −0.528292 | 0.123342 | −0.077480 |
| −0.528292 | 0.172992 | −0.077848 |
| −0.528292 | 0.222643 | −0.078320 |
| −0.528292 | 0.272294 | −0.078950 |
| −0.528292 | 0.321853 | −0.079738 |
| −0.528292 | 0.371504 | −0.080682 |
| −0.528292 | 0.421062 | −0.081785 |
| −0.528292 | 0.470713 | −0.082992 |
| −0.528292 | 0.520272 | −0.084409 |
| −0.528292 | 0.569830 | −0.085932 |
| −0.528292 | 0.619389 | −0.087559 |
| −0.528292 | 0.668947 | −0.089396 |
| −0.528292 | 0.718413 | −0.091391 |
| −0.528292 | 0.767879 | −0.093491 |
| −0.528292 | 0.817345 | −0.095748 |
| −0.528292 | 0.866812 | −0.098163 |
| −0.528292 | 0.916278 | −0.100735 |
| −0.528292 | 0.965651 | −0.103412 |
| −0.528292 | 1.015025 | −0.106247 |
| −0.528292 | 1.064398 | −0.109239 |
| −0.528292 | 1.113772 | −0.112388 |
| −0.528292 | 1.163053 | −0.115696 |
| −0.528292 | 1.212334 | −0.119108 |

TABLE 4-continued

| Inner Diameter Flowpath | | |
|---|---|---|
| X/Root_Bx | Y/Root_Pitch | Z/Span |
| −0.528292 | 1.261523 | −0.122730 |
| −0.528292 | 1.310711 | −0.126457 |
| −0.528292 | 1.359900 | −0.130289 |
| −0.528292 | 1.408996 | −0.134331 |
| −0.528292 | 1.458093 | −0.138478 |
| −0.528292 | 1.507189 | −0.142835 |
| −0.528292 | 1.556193 | −0.147297 |
| −0.528292 | 1.605196 | −0.151864 |
| −0.528292 | 1.654108 | −0.156640 |
| −0.528292 | 1.702926 | −0.161522 |
| −0.528292 | 1.751838 | −0.166562 |
| −0.528292 | 1.800564 | −0.171759 |
| −0.528292 | 1.849290 | −0.177060 |
| −0.528292 | 1.898017 | −0.182572 |
| −0.528292 | 1.946651 | −0.188189 |
| −0.528292 | 1.995285 | −0.193963 |
| −0.528292 | 2.043734 | −0.199843 |
| −0.528292 | 2.092275 | −0.205879 |
| −0.528292 | 2.140632 | −0.212073 |
| −0.528292 | 2.189080 | −0.218425 |
| −0.528292 | 2.237345 | −0.224934 |
| −0.528292 | 2.285609 | −0.231549 |
| −0.528292 | 2.333780 | −0.238320 |
| −0.485025 | −1.597430 | −0.153438 |
| −0.485025 | −1.548426 | −0.148661 |
| −0.485025 | −1.499422 | −0.144042 |
| −0.485025 | −1.450418 | −0.139580 |
| −0.485025 | −1.401322 | −0.135223 |
| −0.485025 | −1.352226 | −0.131024 |
| −0.485025 | −1.303037 | −0.126982 |
| −0.485025 | −1.253849 | −0.123097 |
| −0.485025 | −1.204660 | −0.119370 |
| −0.485025 | −1.155379 | −0.115748 |
| −0.485025 | −1.106098 | −0.112283 |
| −0.485025 | −1.056724 | −0.108976 |
| −0.485025 | −1.007351 | −0.105827 |
| −0.485025 | −0.957977 | −0.102782 |
| −0.485025 | −0.908603 | −0.099948 |
| −0.485025 | −0.859137 | −0.097218 |
| −0.485025 | −0.809671 | −0.094646 |
| −0.485025 | −0.760205 | −0.092231 |
| −0.485025 | −0.710647 | −0.089921 |
| −0.485025 | −0.661181 | −0.087769 |
| −0.485025 | −0.611622 | −0.085827 |
| −0.485025 | −0.562064 | −0.083990 |
| −0.485025 | −0.512505 | −0.082257 |
| −0.485025 | −0.462854 | −0.080735 |
| −0.485025 | −0.413296 | −0.079318 |
| −0.485025 | −0.363645 | −0.078110 |
| −0.485025 | −0.313994 | −0.077008 |
| −0.485025 | −0.264343 | −0.076010 |
| −0.485025 | −0.214692 | −0.075223 |
| −0.485025 | −0.165041 | −0.074541 |
| −0.485025 | −0.115390 | −0.074068 |
| −0.485025 | −0.065739 | −0.073701 |
| −0.485025 | −0.016088 | −0.073491 |
| −0.485025 | 0.033655 | −0.073386 |
| −0.485025 | 0.083306 | −0.073491 |
| −0.485025 | 0.132957 | −0.073701 |
| −0.485025 | 0.182608 | −0.074068 |
| −0.485025 | 0.232259 | −0.074593 |
| −0.485025 | 0.281910 | −0.075276 |
| −0.485025 | 0.331561 | −0.076115 |
| −0.485025 | 0.381212 | −0.077060 |
| −0.485025 | 0.430863 | −0.078163 |
| −0.485025 | 0.480514 | −0.079423 |
| −0.485025 | 0.530073 | −0.080840 |
| −0.485025 | 0.579724 | −0.082415 |
| −0.485025 | 0.629282 | −0.084094 |
| −0.485025 | 0.678841 | −0.085932 |
| −0.485025 | 0.728399 | −0.087927 |
| −0.485025 | 0.777958 | −0.090079 |
| −0.485025 | 0.827424 | −0.092388 |
| −0.485025 | 0.876890 | −0.094803 |
| −0.485025 | 0.926356 | −0.097428 |

TABLE 4-continued

| Inner Diameter Flowpath | | |
|---|---|---|
| X/Root_Bx | Y/Root_Pitch | Z/Span |
| −0.485025 | 0.975822 | −0.100157 |
| −0.485025 | 1.025195 | −0.103045 |
| −0.485025 | 1.074569 | −0.106037 |
| −0.485025 | 1.123942 | −0.109239 |
| −0.485025 | 1.173316 | −0.112546 |
| −0.485025 | 1.222597 | −0.116010 |
| −0.485025 | 1.271878 | −0.119633 |
| −0.485025 | 1.321067 | −0.123360 |
| −0.485025 | 1.370256 | −0.127297 |
| −0.485025 | 1.419444 | −0.131339 |
| −0.485025 | 1.468541 | −0.135538 |
| −0.485025 | 1.517637 | −0.139895 |
| −0.485025 | 1.566640 | −0.144357 |
| −0.485025 | 1.615644 | −0.148976 |
| −0.485025 | 1.664648 | −0.153806 |
| −0.485025 | 1.713559 | −0.158688 |
| −0.485025 | 1.762378 | −0.163780 |
| −0.485025 | 1.811197 | −0.168976 |
| −0.485025 | 1.859923 | −0.174383 |
| −0.485025 | 1.908650 | −0.179843 |
| −0.485025 | 1.957376 | −0.185512 |
| −0.485025 | 2.005917 | −0.191339 |
| −0.485025 | 2.054459 | −0.197270 |
| −0.485025 | 2.103000 | −0.203360 |
| −0.485025 | 2.151449 | −0.209554 |
| −0.485025 | 2.199806 | −0.215958 |
| −0.485025 | 2.248162 | −0.222467 |
| −0.485025 | 2.296426 | −0.229134 |
| −0.485025 | 2.344598 | −0.235906 |
| −0.441759 | −1.589201 | −0.148714 |
| −0.441759 | −1.540197 | −0.143990 |
| −0.441759 | −1.491193 | −0.139370 |
| −0.441759 | −1.442097 | −0.134908 |
| −0.441759 | −1.392908 | −0.130604 |
| −0.441759 | −1.343812 | −0.126457 |
| −0.441759 | −1.294623 | −0.122467 |
| −0.441759 | −1.245342 | −0.118583 |
| −0.441759 | −1.196061 | −0.114856 |
| −0.441759 | −1.146780 | −0.111286 |
| −0.441759 | −1.097406 | −0.107822 |
| −0.441759 | −1.048033 | −0.104567 |
| −0.441759 | −0.998659 | −0.101417 |
| −0.441759 | −0.949193 | −0.098425 |
| −0.441759 | −0.899820 | −0.095591 |
| −0.441759 | −0.850261 | −0.092913 |
| −0.441759 | −0.800795 | −0.090341 |
| −0.441759 | −0.751237 | −0.087927 |
| −0.441759 | −0.701678 | −0.085669 |
| −0.441759 | −0.652120 | −0.083570 |
| −0.441759 | −0.602561 | −0.081627 |
| −0.441759 | −0.553003 | −0.079790 |
| −0.441759 | −0.503352 | −0.078163 |
| −0.441759 | −0.453701 | −0.076640 |
| −0.441759 | −0.404050 | −0.075276 |
| −0.441759 | −0.354399 | −0.074016 |
| −0.441759 | −0.304748 | −0.072966 |
| −0.441759 | −0.255004 | −0.072021 |
| −0.441759 | −0.205353 | −0.071286 |
| −0.441759 | −0.155702 | −0.070604 |
| −0.441759 | −0.105959 | −0.070131 |
| −0.441759 | −0.056308 | −0.069816 |
| −0.441759 | −0.006565 | −0.069606 |
| −0.441759 | 0.043179 | −0.069606 |
| −0.441759 | 0.092830 | −0.069711 |
| −0.441759 | 0.142573 | −0.069921 |
| −0.441759 | 0.192224 | −0.070341 |
| −0.441759 | 0.241968 | −0.070919 |
| −0.441759 | 0.291619 | −0.071601 |
| −0.441759 | 0.341362 | −0.072441 |
| −0.441759 | 0.391013 | −0.073438 |
| −0.441759 | 0.440664 | −0.074593 |
| −0.441759 | 0.490315 | −0.075853 |
| −0.441759 | 0.539966 | −0.077323 |
| −0.441759 | 0.589617 | −0.078898 |
| −0.441759 | 0.639175 | −0.080630 |

TABLE 4-continued

| Inner Diameter Flowpath | | |
|---|---|---|
| X/Root_Bx | Y/Root_Pitch | Z/Span |
| −0.441759 | 0.688826 | −0.082520 |
| −0.441759 | 0.738385 | −0.084514 |
| −0.441759 | 0.787943 | −0.086719 |
| −0.441759 | 0.837502 | −0.089029 |
| −0.441759 | 0.886968 | −0.091496 |
| −0.441759 | 0.936526 | −0.094121 |
| −0.441759 | 0.985992 | −0.096850 |
| −0.441759 | 1.035366 | −0.099790 |
| −0.441759 | 1.084832 | −0.102835 |
| −0.441759 | 1.134206 | −0.106037 |
| −0.441759 | 1.183579 | −0.109396 |
| −0.441759 | 1.232860 | −0.112913 |
| −0.441759 | 1.282141 | −0.116535 |
| −0.441759 | 1.331422 | −0.120315 |
| −0.441759 | 1.380611 | −0.124252 |
| −0.441759 | 1.429800 | −0.128346 |
| −0.441759 | 1.478988 | −0.132546 |
| −0.441759 | 1.528085 | −0.136955 |
| −0.441759 | 1.577181 | −0.141470 |
| −0.441759 | 1.626185 | −0.146142 |
| −0.441759 | 1.675188 | −0.150971 |
| −0.441759 | 1.724100 | −0.155906 |
| −0.441759 | 1.773011 | −0.160997 |
| −0.441759 | 1.821830 | −0.166247 |
| −0.441759 | 1.870556 | −0.171654 |
| −0.441759 | 1.919375 | −0.177165 |
| −0.441759 | 1.968009 | −0.182887 |
| −0.441759 | 2.016643 | −0.188714 |
| −0.441759 | 2.065277 | −0.194646 |
| −0.441759 | 2.113726 | −0.200787 |
| −0.441759 | 2.162267 | −0.207034 |
| −0.441759 | 2.210624 | −0.213438 |
| −0.441759 | 2.258980 | −0.220000 |
| −0.441759 | 2.307244 | −0.226719 |
| −0.441759 | 2.355508 | −0.233543 |
| −0.398493 | −1.580972 | −0.144042 |
| −0.398493 | −1.531876 | −0.139318 |
| −0.398493 | −1.482872 | −0.134751 |
| −0.398493 | −1.433683 | −0.130289 |
| −0.398493 | −1.384494 | −0.126037 |
| −0.398493 | −1.335306 | −0.121890 |
| −0.398493 | −1.286117 | −0.117900 |
| −0.398493 | −1.236836 | −0.114068 |
| −0.398493 | −1.187462 | −0.110341 |
| −0.398493 | −1.138181 | −0.106824 |
| −0.398493 | −1.088808 | −0.103412 |
| −0.398493 | −1.039342 | −0.100157 |
| −0.398493 | −0.989876 | −0.097008 |
| −0.398493 | −0.940410 | −0.094068 |
| −0.398493 | −0.890944 | −0.091234 |
| −0.398493 | −0.841478 | −0.088609 |
| −0.398493 | −0.791919 | −0.086037 |
| −0.398493 | −0.742361 | −0.083675 |
| −0.398493 | −0.692710 | −0.081470 |
| −0.398493 | −0.643151 | −0.079370 |
| −0.398493 | −0.593500 | −0.077428 |
| −0.398493 | −0.543849 | −0.075643 |
| −0.398493 | −0.494198 | −0.074016 |
| −0.398493 | −0.444547 | −0.072546 |
| −0.398493 | −0.394896 | −0.071181 |
| −0.398493 | −0.345153 | −0.069974 |
| −0.398493 | −0.295409 | −0.068924 |
| −0.398493 | −0.245758 | −0.068031 |
| −0.398493 | −0.196015 | −0.067297 |
| −0.398493 | −0.146272 | −0.066719 |
| −0.398493 | −0.096528 | −0.066247 |
| −0.398493 | −0.046785 | −0.065932 |
| −0.398493 | 0.002959 | −0.065774 |
| −0.398493 | 0.052702 | −0.065774 |
| −0.398493 | 0.102446 | −0.065879 |
| −0.398493 | 0.152189 | −0.066194 |
| −0.398493 | 0.201932 | −0.066614 |
| −0.398493 | 0.251676 | −0.067192 |
| −0.398493 | 0.301327 | −0.067927 |
| −0.398493 | 0.351070 | −0.068819 |

TABLE 4-continued

| Inner Diameter Flowpath | | |
|---|---|---|
| X/Root_Bx | Y/Root_Pitch | Z/Span |
| −0.398493 | 0.400814 | −0.069816 |
| −0.398493 | 0.450465 | −0.070971 |
| −0.398493 | 0.500208 | −0.072283 |
| −0.398493 | 0.549859 | −0.073753 |
| −0.398493 | 0.599510 | −0.075381 |
| −0.398493 | 0.649161 | −0.077165 |
| −0.398493 | 0.698812 | −0.079055 |
| −0.398493 | 0.748370 | −0.081102 |
| −0.398493 | 0.798021 | −0.083307 |
| −0.398493 | 0.847580 | −0.085669 |
| −0.398493 | 0.897138 | −0.088189 |
| −0.398493 | 0.946604 | −0.090814 |
| −0.398493 | 0.996070 | −0.093596 |
| −0.398493 | 1.045629 | −0.096535 |
| −0.398493 | 1.095003 | −0.099633 |
| −0.398493 | 1.144469 | −0.102887 |
| −0.398493 | 1.193842 | −0.106247 |
| −0.398493 | 1.243216 | −0.109764 |
| −0.398493 | 1.292497 | −0.113438 |
| −0.398493 | 1.341778 | −0.117270 |
| −0.398493 | 1.391059 | −0.121260 |
| −0.398493 | 1.440248 | −0.125354 |
| −0.398493 | 1.489436 | −0.129606 |
| −0.398493 | 1.538533 | −0.134016 |
| −0.398493 | 1.587629 | −0.138583 |
| −0.398493 | 1.636725 | −0.143255 |
| −0.398493 | 1.685729 | −0.148136 |
| −0.398493 | 1.734640 | −0.153123 |
| −0.398493 | 1.783551 | −0.158215 |
| −0.398493 | 1.832463 | −0.163517 |
| −0.398493 | 1.881281 | −0.168924 |
| −0.398493 | 1.930008 | −0.174488 |
| −0.398493 | 1.978734 | −0.180210 |
| −0.398493 | 2.027368 | −0.186089 |
| −0.398493 | 2.076002 | −0.192073 |
| −0.398493 | 2.124543 | −0.198215 |
| −0.398493 | 2.172992 | −0.204514 |
| −0.398493 | 2.221441 | −0.210971 |
| −0.398493 | 2.269798 | −0.217533 |
| −0.398493 | 2.318155 | −0.224252 |
| −0.398493 | 2.366419 | −0.231129 |
| −0.355226 | −1.572743 | −0.139318 |
| −0.355226 | −1.523647 | −0.134646 |
| −0.355226 | −1.474458 | −0.130079 |
| −0.355226 | −1.425362 | −0.125669 |
| −0.355226 | −1.376081 | −0.121417 |
| −0.355226 | −1.326892 | −0.117323 |
| −0.355226 | −1.277611 | −0.113333 |
| −0.355226 | −1.228237 | −0.109501 |
| −0.355226 | −1.178956 | −0.105827 |
| −0.355226 | −1.129490 | −0.102310 |
| −0.355226 | −1.080116 | −0.098950 |
| −0.355226 | −1.030650 | −0.095696 |
| −0.355226 | −0.981184 | −0.092651 |
| −0.355226 | −0.931626 | −0.089711 |
| −0.355226 | −0.882160 | −0.086877 |
| −0.355226 | −0.832601 | −0.084252 |
| −0.355226 | −0.782950 | −0.081732 |
| −0.355226 | −0.733392 | −0.079423 |
| −0.355226 | −0.683741 | −0.077218 |
| −0.355226 | −0.634090 | −0.075171 |
| −0.355226 | −0.584439 | −0.073228 |
| −0.355226 | −0.534788 | −0.071496 |
| −0.355226 | −0.485045 | −0.069869 |
| −0.355226 | −0.435394 | −0.068399 |
| −0.355226 | −0.385650 | −0.067087 |
| −0.355226 | −0.335907 | −0.065932 |
| −0.355226 | −0.286163 | −0.064934 |
| −0.355226 | −0.236420 | −0.064042 |
| −0.355226 | −0.186677 | −0.063307 |
| −0.355226 | −0.136841 | −0.062730 |
| −0.355226 | −0.087097 | −0.062310 |
| −0.355226 | −0.037354 | −0.062047 |
| −0.355226 | 0.012482 | −0.061890 |
| −0.355226 | 0.062226 | −0.061942 |

TABLE 4-continued

| Inner Diameter Flowpath | | |
|---|---|---|
| X/Root_Bx | Y/Root_Pitch | Z/Span |
| −0.355226 | 0.111969 | −0.062100 |
| −0.355226 | 0.161805 | −0.062415 |
| −0.355226 | 0.211548 | −0.062887 |
| −0.355226 | 0.261292 | −0.063465 |
| −0.355226 | 0.311035 | −0.064252 |
| −0.355226 | 0.360871 | −0.065144 |
| −0.355226 | 0.410614 | −0.066194 |
| −0.355226 | 0.460265 | −0.067402 |
| −0.355226 | 0.510009 | −0.068714 |
| −0.355226 | 0.559752 | −0.070236 |
| −0.355226 | 0.609403 | −0.071864 |
| −0.355226 | 0.659147 | −0.073648 |
| −0.355226 | 0.708798 | −0.075591 |
| −0.355226 | 0.758449 | −0.077690 |
| −0.355226 | 0.808007 | −0.079895 |
| −0.355226 | 0.857658 | −0.082310 |
| −0.355226 | 0.907216 | −0.084829 |
| −0.355226 | 0.956775 | −0.087507 |
| −0.355226 | 1.006334 | −0.090341 |
| −0.355226 | 1.055800 | −0.093281 |
| −0.355226 | 1.105266 | −0.096430 |
| −0.355226 | 1.154732 | −0.099685 |
| −0.355226 | 1.204105 | −0.103097 |
| −0.355226 | 1.253479 | −0.106667 |
| −0.355226 | 1.302852 | −0.110341 |
| −0.355226 | 1.352134 | −0.114226 |
| −0.355226 | 1.401415 | −0.118215 |
| −0.355226 | 1.450696 | −0.122362 |
| −0.355226 | 1.499884 | −0.126667 |
| −0.355226 | 1.549073 | −0.131076 |
| −0.355226 | 1.598169 | −0.135643 |
| −0.355226 | 1.647265 | −0.140367 |
| −0.355226 | 1.696269 | −0.145249 |
| −0.355226 | 1.745273 | −0.150289 |
| −0.355226 | 1.794184 | −0.155433 |
| −0.355226 | 1.843096 | −0.160787 |
| −0.355226 | 1.891914 | −0.166247 |
| −0.355226 | 1.940733 | −0.171811 |
| −0.355226 | 1.989460 | −0.177585 |
| −0.355226 | 2.038093 | −0.183465 |
| −0.355226 | 2.086727 | −0.189501 |
| −0.355226 | 2.135361 | −0.195696 |
| −0.355226 | 2.183810 | −0.201995 |
| −0.355226 | 2.232259 | −0.208451 |
| −0.355226 | 2.280708 | −0.215066 |
| −0.355226 | 2.329065 | −0.221837 |
| −0.355226 | 2.377329 | −0.228766 |
| −0.311960 | −1.564421 | −0.134698 |
| −0.311960 | −1.515325 | −0.130026 |
| −0.311960 | −1.466137 | −0.125512 |
| −0.311960 | −1.416948 | −0.121102 |
| −0.311960 | −1.367667 | −0.116903 |
| −0.311960 | −1.318386 | −0.112808 |
| −0.311960 | −1.269012 | −0.108871 |
| −0.311960 | −1.219731 | −0.105039 |
| −0.311960 | −1.170265 | −0.101417 |
| −0.311960 | −1.120891 | −0.097900 |
| −0.311960 | −1.071425 | −0.094541 |
| −0.311960 | −1.021959 | −0.091339 |
| −0.311960 | −0.972401 | −0.088294 |
| −0.311960 | −0.922842 | −0.085407 |
| −0.311960 | −0.873284 | −0.082625 |
| −0.311960 | −0.823633 | −0.080000 |
| −0.311960 | −0.774074 | −0.077533 |
| −0.311960 | −0.724423 | −0.075223 |
| −0.311960 | −0.674772 | −0.073018 |
| −0.311960 | −0.625029 | −0.071024 |
| −0.311960 | −0.575378 | −0.069134 |
| −0.311960 | −0.525635 | −0.067402 |
| −0.311960 | −0.475891 | −0.065827 |
| −0.311960 | −0.426148 | −0.064409 |
| −0.311960 | −0.376404 | −0.063097 |
| −0.311960 | −0.326661 | −0.061942 |
| −0.311960 | −0.276825 | −0.060945 |
| −0.311960 | −0.227082 | −0.060105 |

TABLE 4-continued

| Inner Diameter Flowpath | | |
|---|---|---|
| X/Root_Bx | Y/Root_Pitch | Z/Span |
| −0.311960 | −0.177246 | −0.059423 |
| −0.311960 | −0.127410 | −0.058898 |
| −0.311960 | −0.077666 | −0.058478 |
| −0.311960 | −0.027830 | −0.058215 |
| −0.311960 | 0.022005 | −0.058110 |
| −0.311960 | 0.071749 | −0.058163 |
| −0.311960 | 0.121585 | −0.058373 |
| −0.311960 | 0.171421 | −0.058688 |
| −0.311960 | 0.221257 | −0.059213 |
| −0.311960 | 0.271000 | −0.059843 |
| −0.311960 | 0.320836 | −0.060630 |
| −0.311960 | 0.370579 | −0.061522 |
| −0.311960 | 0.420415 | −0.062625 |
| −0.311960 | 0.470159 | −0.063832 |
| −0.311960 | 0.519902 | −0.065249 |
| −0.311960 | 0.569645 | −0.066772 |
| −0.311960 | 0.619389 | −0.068451 |
| −0.311960 | 0.669040 | −0.070236 |
| −0.311960 | 0.718783 | −0.072231 |
| −0.311960 | 0.768434 | −0.074331 |
| −0.311960 | 0.818085 | −0.076588 |
| −0.311960 | 0.867736 | −0.079003 |
| −0.311960 | 0.917295 | −0.081575 |
| −0.311960 | 0.966946 | −0.084252 |
| −0.311960 | 1.016504 | −0.087139 |
| −0.311960 | 1.065970 | −0.090131 |
| −0.311960 | 1.115529 | −0.093281 |
| −0.311960 | 1.164995 | −0.096588 |
| −0.311960 | 1.214368 | −0.100000 |
| −0.311960 | 1.263834 | −0.103622 |
| −0.311960 | 1.313208 | −0.107349 |
| −0.311960 | 1.362489 | −0.111234 |
| −0.311960 | 1.411863 | −0.115276 |
| −0.311960 | 1.461144 | −0.119423 |
| −0.311960 | 1.510332 | −0.123727 |
| −0.311960 | 1.559521 | −0.128241 |
| −0.311960 | 1.608710 | −0.132808 |
| −0.311960 | 1.657806 | −0.137585 |
| −0.311960 | 1.706810 | −0.142520 |
| −0.311960 | 1.755813 | −0.147559 |
| −0.311960 | 1.804817 | −0.152756 |
| −0.311960 | 1.853728 | −0.158110 |
| −0.311960 | 1.902547 | −0.163570 |
| −0.311960 | 1.951366 | −0.169239 |
| −0.311960 | 2.000185 | −0.175013 |
| −0.311960 | 2.048819 | −0.180892 |
| −0.311960 | 2.097545 | −0.186982 |
| −0.311960 | 2.146087 | −0.193176 |
| −0.311960 | 2.194628 | −0.199580 |
| −0.311960 | 2.243077 | −0.206037 |
| −0.311960 | 2.291526 | −0.212703 |
| −0.311960 | 2.339883 | −0.219475 |
| −0.311960 | 2.388147 | −0.226404 |
| −0.268693 | −1.556100 | −0.130026 |
| −0.268693 | −1.507004 | −0.125407 |
| −0.268693 | −1.457723 | −0.120892 |
| −0.268693 | −1.408534 | −0.116535 |
| −0.268693 | −1.359253 | −0.112336 |
| −0.268693 | −1.309879 | −0.108241 |
| −0.268693 | −1.260506 | −0.104357 |
| −0.268693 | −1.211132 | −0.100577 |
| −0.268693 | −1.161666 | −0.096955 |
| −0.268693 | −1.112200 | −0.093491 |
| −0.268693 | −1.062734 | −0.090184 |
| −0.268693 | −1.013176 | −0.086982 |
| −0.268693 | −0.963617 | −0.083937 |
| −0.268693 | −0.914059 | −0.081050 |
| −0.268693 | −0.864408 | −0.078320 |
| −0.268693 | −0.814757 | −0.075748 |
| −0.268693 | −0.765106 | −0.073281 |
| −0.268693 | −0.715455 | −0.070971 |
| −0.268693 | −0.665711 | −0.068871 |
| −0.268693 | −0.615968 | −0.066824 |
| −0.268693 | −0.566224 | −0.064987 |
| −0.268693 | −0.516481 | −0.063307 |

TABLE 4-continued

| Inner Diameter Flowpath | | |
|---|---|---|
| X/Root_Bx | Y/Root_Pitch | Z/Span |
| −0.268693 | −0.466738 | −0.061732 |
| −0.268693 | −0.416902 | −0.060315 |
| −0.268693 | −0.367158 | −0.059055 |
| −0.268693 | −0.317322 | −0.057953 |
| −0.268693 | −0.267486 | −0.057008 |
| −0.268693 | −0.217651 | −0.056168 |
| −0.268693 | −0.167815 | −0.055486 |
| −0.268693 | −0.117979 | −0.055013 |
| −0.268693 | −0.068143 | −0.054646 |
| −0.268693 | −0.018307 | −0.054383 |
| −0.268693 | 0.031529 | −0.054331 |
| −0.268693 | 0.081365 | −0.054383 |
| −0.268693 | 0.131201 | −0.054593 |
| −0.268693 | 0.181036 | −0.055013 |
| −0.268693 | 0.230872 | −0.055486 |
| −0.268693 | 0.280708 | −0.056168 |
| −0.268693 | 0.330544 | −0.057008 |
| −0.268693 | 0.380380 | −0.057953 |
| −0.268693 | 0.430216 | −0.059055 |
| −0.268693 | 0.479959 | −0.060315 |
| −0.268693 | 0.529795 | −0.061732 |
| −0.268693 | 0.579539 | −0.063255 |
| −0.268693 | 0.629282 | −0.064987 |
| −0.268693 | 0.679025 | −0.066824 |
| −0.268693 | 0.728769 | −0.068819 |
| −0.268693 | 0.778420 | −0.070971 |
| −0.268693 | 0.828163 | −0.073281 |
| −0.268693 | 0.877814 | −0.075696 |
| −0.268693 | 0.927465 | −0.078320 |
| −0.268693 | 0.977024 | −0.081050 |
| −0.268693 | 1.026675 | −0.083937 |
| −0.268693 | 1.076233 | −0.086929 |
| −0.268693 | 1.125699 | −0.090131 |
| −0.268693 | 1.175258 | −0.093438 |
| −0.268693 | 1.224724 | −0.096903 |
| −0.268693 | 1.274190 | −0.100525 |
| −0.268693 | 1.323563 | −0.104304 |
| −0.268693 | 1.372937 | −0.108241 |
| −0.268693 | 1.422218 | −0.112283 |
| −0.268693 | 1.471592 | −0.116483 |
| −0.268693 | 1.520780 | −0.120840 |
| −0.268693 | 1.570061 | −0.125354 |
| −0.268693 | 1.619158 | −0.129974 |
| −0.268693 | 1.668346 | −0.134803 |
| −0.268693 | 1.717443 | −0.139738 |
| −0.268693 | 1.766446 | −0.144777 |
| −0.268693 | 1.815450 | −0.150026 |
| −0.268693 | 1.864361 | −0.155381 |
| −0.268693 | 1.913273 | −0.160945 |
| −0.268693 | 1.962091 | −0.166614 |
| −0.268693 | 2.010910 | −0.172388 |
| −0.268693 | 2.059637 | −0.178373 |
| −0.268693 | 2.108271 | −0.184462 |
| −0.268693 | 2.156904 | −0.190709 |
| −0.268693 | 2.205446 | −0.197113 |
| −0.268693 | 2.253987 | −0.203622 |
| −0.268693 | 2.302436 | −0.210289 |
| −0.268693 | 2.350793 | −0.217113 |
| −0.268693 | 2.399057 | −0.224094 |
| −0.225427 | −1.547964 | −0.124934 |
| −0.225427 | −1.498775 | −0.120262 |
| −0.225427 | −1.449494 | −0.115801 |
| −0.225427 | −1.400213 | −0.111496 |
| −0.225427 | −1.350839 | −0.107297 |
| −0.225427 | −1.301465 | −0.103255 |
| −0.225427 | −1.252092 | −0.099370 |
| −0.225427 | −1.202626 | −0.095643 |
| −0.225427 | −1.153160 | −0.092021 |
| −0.225427 | −1.103601 | −0.088556 |
| −0.225427 | −1.054043 | −0.085302 |
| −0.225427 | −1.004484 | −0.082100 |
| −0.225427 | −0.954926 | −0.079108 |
| −0.225427 | −0.905275 | −0.076273 |
| −0.225427 | −0.855624 | −0.073543 |
| −0.225427 | −0.805880 | −0.070971 |

TABLE 4-continued

| Inner Diameter Flowpath | | |
|---|---|---|
| X/Root_Bx | Y/Root_Pitch | Z/Span |
| −0.225427 | −0.756229 | −0.068556 |
| −0.225427 | −0.706486 | −0.066299 |
| −0.225427 | −0.656743 | −0.064199 |
| −0.225427 | −0.606999 | −0.062205 |
| −0.225427 | −0.557163 | −0.060367 |
| −0.225427 | −0.507420 | −0.058688 |
| −0.225427 | −0.457584 | −0.057165 |
| −0.225427 | −0.407748 | −0.055801 |
| −0.225427 | −0.357912 | −0.054541 |
| −0.225427 | −0.308076 | −0.053491 |
| −0.225427 | −0.258240 | −0.052546 |
| −0.225427 | −0.208312 | −0.051759 |
| −0.225427 | −0.158476 | −0.051129 |
| −0.225427 | −0.108548 | −0.050604 |
| −0.225427 | −0.058712 | −0.050289 |
| −0.225427 | −0.008784 | −0.050079 |
| −0.225427 | 0.041052 | −0.050026 |
| −0.225427 | 0.090981 | −0.050131 |
| −0.225427 | 0.140816 | −0.050394 |
| −0.225427 | 0.190745 | −0.050761 |
| −0.225427 | 0.240581 | −0.051339 |
| −0.225427 | 0.290509 | −0.052021 |
| −0.225427 | 0.340345 | −0.052861 |
| −0.225427 | 0.390181 | −0.053858 |
| −0.225427 | 0.440017 | −0.055013 |
| −0.225427 | 0.489853 | −0.056273 |
| −0.225427 | 0.539688 | −0.057743 |
| −0.225427 | 0.589524 | −0.059318 |
| −0.225427 | 0.639268 | −0.061050 |
| −0.225427 | 0.689104 | −0.062940 |
| −0.225427 | 0.738847 | −0.064934 |
| −0.225427 | 0.788590 | −0.067139 |
| −0.225427 | 0.838334 | −0.069449 |
| −0.225427 | 0.887985 | −0.071916 |
| −0.225427 | 0.937636 | −0.074541 |
| −0.225427 | 0.987287 | −0.077323 |
| −0.225427 | 1.036938 | −0.080210 |
| −0.225427 | 1.086496 | −0.083255 |
| −0.225427 | 1.136055 | −0.086509 |
| −0.225427 | 1.185613 | −0.089869 |
| −0.225427 | 1.235172 | −0.093333 |
| −0.225427 | 1.284638 | −0.097008 |
| −0.225427 | 1.334011 | −0.100787 |
| −0.225427 | 1.383477 | −0.104724 |
| −0.225427 | 1.432851 | −0.108819 |
| −0.225427 | 1.482132 | −0.113071 |
| −0.225427 | 1.531413 | −0.117480 |
| −0.225427 | 1.580694 | −0.121995 |
| −0.225427 | 1.629883 | −0.126667 |
| −0.225427 | 1.679072 | −0.131496 |
| −0.225427 | 1.728168 | −0.136483 |
| −0.225427 | 1.777172 | −0.141575 |
| −0.225427 | 1.826268 | −0.146824 |
| −0.225427 | 1.875179 | −0.152231 |
| −0.225427 | 1.924090 | −0.157795 |
| −0.225427 | 1.973002 | −0.163517 |
| −0.225427 | 2.021821 | −0.169344 |
| −0.225427 | 2.070547 | −0.175328 |
| −0.225427 | 2.119273 | −0.181470 |
| −0.225427 | 2.167907 | −0.187717 |
| −0.225427 | 2.216449 | −0.194173 |
| −0.225427 | 2.264990 | −0.200735 |
| −0.225427 | 2.313439 | −0.207454 |
| −0.225427 | 2.361888 | −0.214278 |
| −0.225427 | 2.410245 | −0.221312 |
| −0.182160 | −1.540289 | −0.118005 |
| −0.182160 | −1.491008 | −0.113438 |
| −0.182160 | −1.441727 | −0.108976 |
| −0.182160 | −1.392354 | −0.104672 |
| −0.182160 | −1.342980 | −0.100525 |
| −0.182160 | −1.293514 | −0.096483 |
| −0.182160 | −1.244048 | −0.092651 |
| −0.182160 | −1.194489 | −0.088924 |
| −0.182160 | −1.144931 | −0.085354 |
| −0.182160 | −1.095372 | −0.081890 |

TABLE 4-continued

| Inner Diameter Flowpath | | |
|---|---|---|
| X/Root_Bx | Y/Root_Pitch | Z/Span |
| −0.182160 | −1.045814 | −0.078635 |
| −0.182160 | −0.996163 | −0.075486 |
| −0.182160 | −0.946512 | −0.072546 |
| −0.182160 | −0.896769 | −0.069711 |
| −0.182160 | −0.847118 | −0.066982 |
| −0.182160 | −0.797374 | −0.064462 |
| −0.182160 | −0.747538 | −0.062047 |
| −0.182160 | −0.697795 | −0.059843 |
| −0.182160 | −0.647959 | −0.057743 |
| −0.182160 | −0.598123 | −0.055801 |
| −0.182160 | −0.548287 | −0.053963 |
| −0.182160 | −0.498451 | −0.052336 |
| −0.182160 | −0.448615 | −0.050814 |
| −0.182160 | −0.398687 | −0.049501 |
| −0.182160 | −0.348759 | −0.048294 |
| −0.182160 | −0.298923 | −0.047244 |
| −0.182160 | −0.248994 | −0.046299 |
| −0.182160 | −0.199066 | −0.045564 |
| −0.182160 | −0.149138 | −0.044934 |
| −0.182160 | −0.099209 | −0.044462 |
| −0.182160 | −0.049189 | −0.044147 |
| −0.182160 | 0.000740 | −0.043990 |
| −0.182160 | 0.050668 | −0.043990 |
| −0.182160 | 0.100596 | −0.044094 |
| −0.182160 | 0.150525 | −0.044357 |
| −0.182160 | 0.200453 | −0.044829 |
| −0.182160 | 0.250381 | −0.045407 |
| −0.182160 | 0.300310 | −0.046089 |
| −0.182160 | 0.350238 | −0.046982 |
| −0.182160 | 0.400166 | −0.047979 |
| −0.182160 | 0.450095 | −0.049186 |
| −0.182160 | 0.499931 | −0.050499 |
| −0.182160 | 0.549859 | −0.051969 |
| −0.182160 | 0.599695 | −0.053543 |
| −0.182160 | 0.649531 | −0.055328 |
| −0.182160 | 0.699367 | −0.057218 |
| −0.182160 | 0.749203 | −0.059318 |
| −0.182160 | 0.798946 | −0.061522 |
| −0.182160 | 0.848782 | −0.063885 |
| −0.182160 | 0.898525 | −0.066352 |
| −0.182160 | 0.948176 | −0.069029 |
| −0.182160 | 0.997920 | −0.071811 |
| −0.182160 | 1.047571 | −0.074751 |
| −0.182160 | 1.097222 | −0.077848 |
| −0.182160 | 1.146873 | −0.081102 |
| −0.182160 | 1.196431 | −0.084462 |
| −0.182160 | 1.245990 | −0.088031 |
| −0.182160 | 1.295456 | −0.091706 |
| −0.182160 | 1.345014 | −0.095538 |
| −0.182160 | 1.394388 | −0.099528 |
| −0.182160 | 1.443854 | −0.103622 |
| −0.182160 | 1.493227 | −0.107927 |
| −0.182160 | 1.542508 | −0.112336 |
| −0.182160 | 1.591882 | −0.116903 |
| −0.182160 | 1.641071 | −0.121575 |
| −0.182160 | 1.690259 | −0.126457 |
| −0.182160 | 1.739448 | −0.131444 |
| −0.182160 | 1.788544 | −0.136588 |
| −0.182160 | 1.837640 | −0.141890 |
| −0.182160 | 1.886644 | −0.147349 |
| −0.182160 | 1.935648 | −0.152913 |
| −0.182160 | 1.984559 | −0.158635 |
| −0.182160 | 2.033378 | −0.164514 |
| −0.182160 | 2.082197 | −0.170551 |
| −0.182160 | 2.130923 | −0.176745 |
| −0.182160 | 2.179650 | −0.183045 |
| −0.182160 | 2.228283 | −0.189501 |
| −0.182160 | 2.276825 | −0.196115 |
| −0.182160 | 2.325366 | −0.202835 |
| −0.182160 | 2.373815 | −0.209711 |
| −0.182160 | 2.422172 | −0.216745 |
| −0.138894 | −1.532800 | −0.107874 |
| −0.138894 | −1.483427 | −0.103307 |
| −0.138894 | −1.434053 | −0.098898 |
| −0.138894 | −1.384587 | −0.094593 |

TABLE 4-continued

| Inner Diameter Flowpath | | |
|---|---|---|
| X/Root_Bx | Y/Root_Pitch | Z/Span |
| −0.138894 | −1.335028 | −0.090446 |
| −0.138894 | −1.285562 | −0.086457 |
| −0.138894 | −1.236004 | −0.082625 |
| −0.138894 | −1.186353 | −0.078950 |
| −0.138894 | −1.136702 | −0.075381 |
| −0.138894 | −1.087051 | −0.071969 |
| −0.138894 | −1.037308 | −0.068714 |
| −0.138894 | −0.987657 | −0.065617 |
| −0.138894 | −0.937913 | −0.062677 |
| −0.138894 | −0.888077 | −0.059843 |
| −0.138894 | −0.838241 | −0.057218 |
| −0.138894 | −0.788406 | −0.054698 |
| −0.138894 | −0.738570 | −0.052336 |
| −0.138894 | −0.688734 | −0.050079 |
| −0.138894 | −0.638805 | −0.048031 |
| −0.138894 | −0.588877 | −0.046142 |
| −0.138894 | −0.538949 | −0.044357 |
| −0.138894 | −0.489020 | −0.042730 |
| −0.138894 | −0.439092 | −0.041260 |
| −0.138894 | −0.389071 | −0.039948 |
| −0.138894 | −0.339143 | −0.038740 |
| −0.138894 | −0.289122 | −0.037743 |
| −0.138894 | −0.239101 | −0.036850 |
| −0.138894 | −0.189080 | −0.036115 |
| −0.138894 | −0.139060 | −0.035538 |
| −0.138894 | −0.089039 | −0.035118 |
| −0.138894 | −0.039018 | −0.034803 |
| −0.138894 | 0.011003 | −0.034646 |
| −0.138894 | 0.061024 | −0.034698 |
| −0.138894 | 0.111044 | −0.034856 |
| −0.138894 | 0.161065 | −0.035171 |
| −0.138894 | 0.211086 | −0.035591 |
| −0.138894 | 0.261107 | −0.036220 |
| −0.138894 | 0.311128 | −0.036955 |
| −0.138894 | 0.361148 | −0.037900 |
| −0.138894 | 0.411169 | −0.038950 |
| −0.138894 | 0.461097 | −0.040157 |
| −0.138894 | 0.511118 | −0.041470 |
| −0.138894 | 0.561047 | −0.042992 |
| −0.138894 | 0.610975 | −0.044619 |
| −0.138894 | 0.660903 | −0.046404 |
| −0.138894 | 0.710832 | −0.048399 |
| −0.138894 | 0.760760 | −0.050446 |
| −0.138894 | 0.810596 | −0.052703 |
| −0.138894 | 0.860432 | −0.055118 |
| −0.138894 | 0.910268 | −0.057638 |
| −0.138894 | 0.960104 | −0.060315 |
| −0.138894 | 1.009847 | −0.063150 |
| −0.138894 | 1.059590 | −0.066142 |
| −0.138894 | 1.109334 | −0.069239 |
| −0.138894 | 1.159077 | −0.072546 |
| −0.138894 | 1.208728 | −0.075958 |
| −0.138894 | 1.258287 | −0.079528 |
| −0.138894 | 1.307938 | −0.083255 |
| −0.138894 | 1.357496 | −0.087139 |
| −0.138894 | 1.407055 | −0.091129 |
| −0.138894 | 1.456521 | −0.095328 |
| −0.138894 | 1.505987 | −0.099633 |
| −0.138894 | 1.555360 | −0.104042 |
| −0.138894 | 1.604734 | −0.108661 |
| −0.138894 | 1.654015 | −0.113438 |
| −0.138894 | 1.703296 | −0.118320 |
| −0.138894 | 1.752577 | −0.123360 |
| −0.138894 | 1.801766 | −0.128556 |
| −0.138894 | 1.850862 | −0.133858 |
| −0.138894 | 1.899958 | −0.139370 |
| −0.138894 | 1.949055 | −0.144987 |
| −0.138894 | 1.997966 | −0.150761 |
| −0.138894 | 2.046970 | −0.156693 |
| −0.138894 | 2.095788 | −0.162730 |
| −0.138894 | 2.144607 | −0.168924 |
| −0.138894 | 2.193426 | −0.175276 |
| −0.138894 | 2.242060 | −0.181785 |
| −0.138894 | 2.290694 | −0.188451 |
| −0.138894 | 2.339328 | −0.195223 |

TABLE 4-continued

| Inner Diameter Flowpath | | |
|---|---|---|
| X/Root_Bx | Y/Root_Pitch | Z/Span |
| −0.138894 | 2.387869 | −0.202152 |
| −0.138894 | 2.436318 | −0.209239 |
| −0.095627 | −1.524571 | −0.094593 |
| −0.095627 | −1.475105 | −0.090026 |
| −0.095627 | −1.425547 | −0.085617 |
| −0.095627 | −1.375988 | −0.081365 |
| −0.095627 | −1.326337 | −0.077270 |
| −0.095627 | −1.276686 | −0.073281 |
| −0.095627 | −1.227035 | −0.069501 |
| −0.095627 | −1.177292 | −0.065827 |
| −0.095627 | −1.127548 | −0.062310 |
| −0.095627 | −1.077713 | −0.058950 |
| −0.095627 | −1.027969 | −0.055696 |
| −0.095627 | −0.978041 | −0.052651 |
| −0.095627 | −0.928205 | −0.049711 |
| −0.095627 | −0.878277 | −0.046929 |
| −0.095627 | −0.828348 | −0.044304 |
| −0.095627 | −0.778420 | −0.041785 |
| −0.095627 | −0.728399 | −0.039475 |
| −0.095627 | −0.678471 | −0.037270 |
| −0.095627 | −0.628450 | −0.035223 |
| −0.095627 | −0.578429 | −0.033386 |
| −0.095627 | −0.528316 | −0.031601 |
| −0.095627 | −0.478295 | −0.030026 |
| −0.095627 | −0.428182 | −0.028609 |
| −0.095627 | −0.378161 | −0.027297 |
| −0.095627 | −0.328048 | −0.026142 |
| −0.095627 | −0.277934 | −0.025144 |
| −0.095627 | −0.227821 | −0.024304 |
| −0.095627 | −0.177615 | −0.023622 |
| −0.095627 | −0.127502 | −0.023045 |
| −0.095627 | −0.077389 | −0.022677 |
| −0.095627 | −0.027276 | −0.022415 |
| −0.095627 | 0.022930 | −0.022310 |
| −0.095627 | 0.073043 | −0.022362 |
| −0.095627 | 0.123157 | −0.022572 |
| −0.095627 | 0.173362 | −0.022887 |
| −0.095627 | 0.223476 | −0.023412 |
| −0.095627 | 0.273589 | −0.024042 |
| −0.095627 | 0.323702 | −0.024829 |
| −0.095627 | 0.373815 | −0.025774 |
| −0.095627 | 0.423929 | −0.026877 |
| −0.095627 | 0.474042 | −0.028136 |
| −0.095627 | 0.524063 | −0.029501 |
| −0.095627 | 0.574176 | −0.031024 |
| −0.095627 | 0.624197 | −0.032703 |
| −0.095627 | 0.674310 | −0.034541 |
| −0.095627 | 0.724331 | −0.036535 |
| −0.095627 | 0.774259 | −0.038688 |
| −0.095627 | 0.824280 | −0.040945 |
| −0.095627 | 0.874208 | −0.043412 |
| −0.095627 | 0.924137 | −0.045984 |
| −0.095627 | 0.974065 | −0.048714 |
| −0.095627 | 1.023993 | −0.051549 |
| −0.095627 | 1.073829 | −0.054593 |
| −0.095627 | 1.123665 | −0.057743 |
| −0.095627 | 1.173409 | −0.061102 |
| −0.095627 | 1.223244 | −0.064567 |
| −0.095627 | 1.272988 | −0.068189 |
| −0.095627 | 1.322639 | −0.071916 |
| −0.095627 | 1.372290 | −0.075853 |
| −0.095627 | 1.421941 | −0.079895 |
| −0.095627 | 1.471592 | −0.084094 |
| −0.095627 | 1.521058 | −0.088451 |
| −0.095627 | 1.570616 | −0.092966 |
| −0.095627 | 1.620082 | −0.097585 |
| −0.095627 | 1.669548 | −0.102415 |
| −0.095627 | 1.718922 | −0.107349 |
| −0.095627 | 1.768203 | −0.112441 |
| −0.095627 | 1.817484 | −0.117690 |
| −0.095627 | 1.866765 | −0.123045 |
| −0.095627 | 1.915954 | −0.128556 |
| −0.095627 | 1.965050 | −0.134278 |
| −0.095627 | 2.014146 | −0.140052 |
| −0.095627 | 2.063150 | −0.146037 |

TABLE 4-continued

| Inner Diameter Flowpath | | |
|---|---|---|
| X/Root_Bx | Y/Root_Pitch | Z/Span |
| −0.095627 | 2.112154 | −0.152126 |
| −0.095627 | 2.161065 | −0.158425 |
| −0.095627 | 2.209976 | −0.164829 |
| −0.095627 | 2.258703 | −0.171339 |
| −0.095627 | 2.307429 | −0.178058 |
| −0.095627 | 2.356156 | −0.184882 |
| −0.095627 | 2.404789 | −0.191864 |
| −0.095627 | 2.453331 | −0.199003 |
| −0.052361 | −1.515788 | −0.079843 |
| −0.052361 | −1.466137 | −0.075328 |
| −0.052361 | −1.416486 | −0.070971 |
| −0.052361 | −1.366742 | −0.066719 |
| −0.052361 | −1.316999 | −0.062625 |
| −0.052361 | −1.267255 | −0.058688 |
| −0.052361 | −1.217419 | −0.054908 |
| −0.052361 | −1.167491 | −0.051286 |
| −0.052361 | −1.117655 | −0.047769 |
| −0.052361 | −1.067727 | −0.044462 |
| −0.052361 | −1.017799 | −0.041260 |
| −0.052361 | −0.967778 | −0.038215 |
| −0.052361 | −0.917757 | −0.035328 |
| −0.052361 | −0.867736 | −0.032546 |
| −0.052361 | −0.817715 | −0.029974 |
| −0.052361 | −0.767602 | −0.027507 |
| −0.052361 | −0.717489 | −0.025197 |
| −0.052361 | −0.667376 | −0.023045 |
| −0.052361 | −0.617262 | −0.021050 |
| −0.052361 | −0.567057 | −0.019213 |
| −0.052361 | −0.516851 | −0.017480 |
| −0.052361 | −0.466645 | −0.015958 |
| −0.052361 | −0.416439 | −0.014541 |
| −0.052361 | −0.366234 | −0.013281 |
| −0.052361 | −0.316028 | −0.012178 |
| −0.052361 | −0.265822 | −0.011181 |
| −0.052361 | −0.215524 | −0.010394 |
| −0.052361 | −0.165318 | −0.009711 |
| −0.052361 | −0.115020 | −0.009239 |
| −0.052361 | −0.064722 | −0.008871 |
| −0.052361 | −0.014516 | −0.008661 |
| −0.052361 | 0.035782 | −0.008609 |
| −0.052361 | 0.086080 | −0.008661 |
| −0.052361 | 0.136286 | −0.008924 |
| −0.052361 | 0.186584 | −0.009291 |
| −0.052361 | 0.236882 | −0.009816 |
| −0.052361 | 0.287088 | −0.010499 |
| −0.052361 | 0.337386 | −0.011339 |
| −0.052361 | 0.387592 | −0.012336 |
| −0.052361 | 0.437798 | −0.013438 |
| −0.052361 | 0.488003 | −0.014751 |
| −0.052361 | 0.538209 | −0.016168 |
| −0.052361 | 0.588415 | −0.017743 |
| −0.052361 | 0.638620 | −0.019475 |
| −0.052361 | 0.688734 | −0.021365 |
| −0.052361 | 0.738939 | −0.023412 |
| −0.052361 | 0.789053 | −0.025564 |
| −0.052361 | 0.839166 | −0.027874 |
| −0.052361 | 0.889187 | −0.030341 |
| −0.052361 | 0.939300 | −0.032966 |
| −0.052361 | 0.989321 | −0.035748 |
| −0.052361 | 1.039342 | −0.038688 |
| −0.052361 | 1.089270 | −0.041732 |
| −0.052361 | 1.139198 | −0.044987 |
| −0.052361 | 1.189127 | −0.048346 |
| −0.052361 | 1.239055 | −0.051864 |
| −0.052361 | 1.288891 | −0.055486 |
| −0.052361 | 1.338727 | −0.059318 |
| −0.052361 | 1.388470 | −0.063307 |
| −0.052361 | 1.438214 | −0.067402 |
| −0.052361 | 1.487957 | −0.071654 |
| −0.052361 | 1.537608 | −0.076063 |
| −0.052361 | 1.587259 | −0.080577 |
| −0.052361 | 1.636818 | −0.085302 |
| −0.052361 | 1.686376 | −0.090131 |
| −0.052361 | 1.735842 | −0.095118 |
| −0.052361 | 1.785308 | −0.100262 |

TABLE 4-continued

| Inner Diameter Flowpath | | |
|---|---|---|
| X/Root_Bx | Y/Root_Pitch | Z/Span |
| −0.052361 | 1.834682 | −0.105564 |
| −0.052361 | 1.884055 | −0.110971 |
| −0.052361 | 1.933336 | −0.116588 |
| −0.052361 | 1.982618 | −0.122310 |
| −0.052361 | 2.031806 | −0.128189 |
| −0.052361 | 2.080902 | −0.134173 |
| −0.052361 | 2.129999 | −0.140367 |
| −0.052361 | 2.179002 | −0.146667 |
| −0.052361 | 2.228006 | −0.153123 |
| −0.052361 | 2.276917 | −0.159738 |
| −0.052361 | 2.325736 | −0.166457 |
| −0.052361 | 2.374555 | −0.173333 |
| −0.052361 | 2.423281 | −0.180367 |
| −0.052361 | 2.471915 | −0.187559 |
| −0.009095 | −1.506079 | −0.066667 |
| −0.009095 | −1.456336 | −0.062152 |
| −0.009095 | −1.406592 | −0.057848 |
| −0.009095 | −1.356757 | −0.053596 |
| −0.009095 | −1.306828 | −0.049554 |
| −0.009095 | −1.256900 | −0.045669 |
| −0.009095 | −1.206971 | −0.041890 |
| −0.009095 | −1.157043 | −0.038320 |
| −0.009095 | −1.107022 | −0.034856 |
| −0.009095 | −1.057002 | −0.031549 |
| −0.009095 | −1.006888 | −0.028346 |
| −0.009095 | −0.956775 | −0.025354 |
| −0.009095 | −0.906662 | −0.022467 |
| −0.009095 | −0.856548 | −0.019790 |
| −0.009095 | −0.806343 | −0.017218 |
| −0.009095 | −0.756137 | −0.014803 |
| −0.009095 | −0.705931 | −0.012546 |
| −0.009095 | −0.655633 | −0.010394 |
| −0.009095 | −0.605427 | −0.008451 |
| −0.009095 | −0.555129 | −0.006614 |
| −0.009095 | −0.504831 | −0.004934 |
| −0.009095 | −0.454533 | −0.003412 |
| −0.009095 | −0.404235 | −0.002047 |
| −0.009095 | −0.353844 | −0.000840 |
| −0.009095 | −0.303546 | 0.000262 |
| −0.009095 | −0.253155 | 0.001155 |
| −0.009095 | −0.202765 | 0.001942 |
| −0.009095 | −0.152466 | 0.002572 |
| −0.009095 | −0.102076 | 0.003045 |
| −0.009095 | −0.051685 | 0.003360 |
| −0.009095 | −0.001294 | 0.003517 |
| −0.009095 | 0.049096 | 0.003570 |
| −0.009095 | 0.099487 | 0.003412 |
| −0.009095 | 0.149877 | 0.003150 |
| −0.009095 | 0.200176 | 0.002730 |
| −0.009095 | 0.250566 | 0.002152 |
| −0.009095 | 0.300957 | 0.001417 |
| −0.009095 | 0.351348 | 0.000525 |
| −0.009095 | 0.401646 | −0.000472 |
| −0.009095 | 0.452036 | −0.001680 |
| −0.009095 | 0.502335 | −0.002992 |
| −0.009095 | 0.552633 | −0.004462 |
| −0.009095 | 0.602931 | −0.006089 |
| −0.009095 | 0.653229 | −0.007822 |
| −0.009095 | 0.703527 | −0.009764 |
| −0.009095 | 0.753733 | −0.011864 |
| −0.009095 | 0.803939 | −0.014068 |
| −0.009095 | 0.854145 | −0.016430 |
| −0.009095 | 0.904350 | −0.018950 |
| −0.009095 | 0.954556 | −0.021627 |
| −0.009095 | 1.004669 | −0.024462 |
| −0.009095 | 1.054782 | −0.027402 |
| −0.009095 | 1.104896 | −0.030499 |
| −0.009095 | 1.154917 | −0.033806 |
| −0.009095 | 1.204937 | −0.037218 |
| −0.009095 | 1.254958 | −0.040735 |
| −0.009095 | 1.304887 | −0.044462 |
| −0.009095 | 1.354815 | −0.048346 |
| −0.009095 | 1.404651 | −0.052336 |
| −0.009095 | 1.454487 | −0.056483 |
| −0.009095 | 1.504323 | −0.060787 |

TABLE 4-continued

| Inner Diameter Flowpath | | |
|---|---|---|
| X/Root_Bx | Y/Root_Pitch | Z/Span |
| −0.009095 | 1.554066 | −0.065249 |
| −0.009095 | 1.603809 | −0.069816 |
| −0.009095 | 1.653460 | −0.074593 |
| −0.009095 | 1.703111 | −0.079475 |
| −0.009095 | 1.752762 | −0.084514 |
| −0.009095 | 1.802321 | −0.089711 |
| −0.009095 | 1.851787 | −0.095066 |
| −0.009095 | 1.901253 | −0.100525 |
| −0.009095 | 1.950626 | −0.106142 |
| −0.009095 | 2.000000 | −0.111969 |
| −0.009095 | 2.049281 | −0.117848 |
| −0.009095 | 2.098470 | −0.123937 |
| −0.009095 | 2.147658 | −0.130131 |
| −0.009095 | 2.196755 | −0.136535 |
| −0.009095 | 2.245851 | −0.143045 |
| −0.009095 | 2.294855 | −0.149659 |
| −0.009095 | 2.343766 | −0.156483 |
| −0.009095 | 2.392677 | −0.163412 |
| −0.009095 | 2.441496 | −0.170499 |
| −0.009095 | 2.490222 | −0.177743 |
| 0.034172 | −1.495539 | −0.055538 |
| 0.034172 | −1.445610 | −0.051076 |
| 0.034172 | −1.395775 | −0.046719 |
| 0.034172 | −1.345846 | −0.042572 |
| 0.034172 | −1.295825 | −0.038530 |
| 0.034172 | −1.245805 | −0.034646 |
| 0.034172 | −1.195784 | −0.030971 |
| 0.034172 | −1.145671 | −0.027349 |
| 0.034172 | −1.095557 | −0.023937 |
| 0.034172 | −1.045444 | −0.020682 |
| 0.034172 | −0.995238 | −0.017533 |
| 0.034172 | −0.945033 | −0.014541 |
| 0.034172 | −0.894827 | −0.011759 |
| 0.034172 | −0.844621 | −0.009029 |
| 0.034172 | −0.794323 | −0.006509 |
| 0.034172 | −0.744025 | −0.004147 |
| 0.034172 | −0.693727 | −0.001890 |
| 0.034172 | −0.643336 | 0.000157 |
| 0.034172 | −0.592945 | 0.002100 |
| 0.034172 | −0.542647 | 0.003885 |
| 0.034172 | −0.492256 | 0.005512 |
| 0.034172 | −0.441773 | 0.006982 |
| 0.034172 | −0.391383 | 0.008346 |
| 0.034172 | −0.340992 | 0.009501 |
| 0.034172 | −0.290509 | 0.010551 |
| 0.034172 | −0.240118 | 0.011444 |
| 0.034172 | −0.189635 | 0.012178 |
| 0.034172 | −0.139152 | 0.012756 |
| 0.034172 | −0.088669 | 0.013176 |
| 0.034172 | −0.038186 | 0.013491 |
| 0.034172 | 0.012297 | 0.013596 |
| 0.034172 | 0.062688 | 0.013596 |
| 0.034172 | 0.113171 | 0.013438 |
| 0.034172 | 0.163654 | 0.013123 |
| 0.034172 | 0.214137 | 0.012651 |
| 0.034172 | 0.264620 | 0.012021 |
| 0.034172 | 0.315103 | 0.011234 |
| 0.034172 | 0.365494 | 0.010341 |
| 0.034172 | 0.415977 | 0.009239 |
| 0.034172 | 0.466368 | 0.008031 |
| 0.034172 | 0.516758 | 0.006667 |
| 0.034172 | 0.567241 | 0.005144 |
| 0.034172 | 0.617540 | 0.003517 |
| 0.034172 | 0.667930 | 0.001680 |
| 0.034172 | 0.718321 | −0.000262 |
| 0.034172 | 0.768619 | −0.002415 |
| 0.034172 | 0.819010 | −0.004672 |
| 0.034172 | 0.869215 | −0.007087 |
| 0.034172 | 0.919514 | −0.009659 |
| 0.034172 | 0.969812 | −0.012336 |
| 0.034172 | 1.020018 | −0.015223 |
| 0.034172 | 1.070223 | −0.018215 |
| 0.034172 | 1.120337 | −0.021417 |
| 0.034172 | 1.170450 | −0.024724 |
| 0.034172 | 1.220563 | −0.028189 |

TABLE 4-continued

| Inner Diameter Flowpath | | |
|---|---|---|
| X/Root_Bx | Y/Root_Pitch | Z/Span |
| 0.034172 | 1.270676 | −0.031759 |
| 0.034172 | 1.320697 | −0.035538 |
| 0.034172 | 1.370718 | −0.039423 |
| 0.034172 | 1.420646 | −0.043517 |
| 0.034172 | 1.470575 | −0.047717 |
| 0.034172 | 1.520503 | −0.052021 |
| 0.034172 | 1.570339 | −0.056535 |
| 0.034172 | 1.620175 | −0.061207 |
| 0.034172 | 1.669918 | −0.065984 |
| 0.034172 | 1.719662 | −0.070919 |
| 0.034172 | 1.769313 | −0.076010 |
| 0.034172 | 1.818964 | −0.081260 |
| 0.034172 | 1.868522 | −0.086667 |
| 0.034172 | 1.917988 | −0.092178 |
| 0.034172 | 1.967454 | −0.097848 |
| 0.034172 | 2.016920 | −0.103675 |
| 0.034172 | 2.066294 | −0.109659 |
| 0.034172 | 2.115575 | −0.115801 |
| 0.034172 | 2.164856 | −0.122047 |
| 0.034172 | 2.214045 | −0.128451 |
| 0.034172 | 2.263141 | −0.135013 |
| 0.034172 | 2.312237 | −0.141732 |
| 0.034172 | 2.361241 | −0.148609 |
| 0.034172 | 2.410152 | −0.155591 |
| 0.034172 | 2.459063 | −0.162730 |
| 0.034172 | 2.507882 | −0.170026 |
| 0.077438 | −1.483981 | −0.045774 |
| 0.077438 | −1.434053 | −0.041312 |
| 0.077438 | −1.384032 | −0.037060 |
| 0.077438 | −1.334011 | −0.032913 |
| 0.077438 | −1.283991 | −0.028924 |
| 0.077438 | −1.233877 | −0.025092 |
| 0.077438 | −1.183764 | −0.021417 |
| 0.077438 | −1.133558 | −0.017848 |
| 0.077438 | −1.083353 | −0.014488 |
| 0.077438 | −1.033147 | −0.011234 |
| 0.077438 | −0.982849 | −0.008136 |
| 0.077438 | −0.932643 | −0.005197 |
| 0.077438 | −0.882252 | −0.002415 |
| 0.077438 | −0.831954 | 0.000210 |
| 0.077438 | −0.781563 | 0.002730 |
| 0.077438 | −0.731173 | 0.005092 |
| 0.077438 | −0.680782 | 0.007244 |
| 0.077438 | −0.630392 | 0.009291 |
| 0.077438 | −0.579908 | 0.011181 |
| 0.077438 | −0.529518 | 0.012966 |
| 0.077438 | −0.479035 | 0.014541 |
| 0.077438 | −0.428552 | 0.015958 |
| 0.077438 | −0.377976 | 0.017270 |
| 0.077438 | −0.327493 | 0.018425 |
| 0.077438 | −0.277010 | 0.019423 |
| 0.077438 | −0.226434 | 0.020262 |
| 0.077438 | −0.175859 | 0.020945 |
| 0.077438 | −0.125376 | 0.021470 |
| 0.077438 | −0.074800 | 0.021890 |
| 0.077438 | −0.024224 | 0.022100 |
| 0.077438 | 0.026259 | 0.022205 |
| 0.077438 | 0.076834 | 0.022152 |
| 0.077438 | 0.127410 | 0.021942 |
| 0.077438 | 0.177985 | 0.021575 |
| 0.077438 | 0.228468 | 0.021050 |
| 0.077438 | 0.279044 | 0.020420 |
| 0.077438 | 0.329527 | 0.019580 |
| 0.077438 | 0.380103 | 0.018635 |
| 0.077438 | 0.430586 | 0.017533 |
| 0.077438 | 0.481069 | 0.016273 |
| 0.077438 | 0.531644 | 0.014856 |
| 0.077438 | 0.582128 | 0.013281 |
| 0.077438 | 0.632518 | 0.011601 |
| 0.077438 | 0.683001 | 0.009711 |
| 0.077438 | 0.733392 | 0.007717 |
| 0.077438 | 0.783875 | 0.005564 |
| 0.077438 | 0.834266 | 0.003255 |
| 0.077438 | 0.884564 | 0.000787 |
| 0.077438 | 0.934954 | −0.001837 |

TABLE 4-continued

| Inner Diameter Flowpath | | |
|---|---|---|
| X/Root_Bx | Y/Root_Pitch | Z/Span |
| 0.077438 | 0.985253 | −0.004567 |
| 0.077438 | 1.035551 | −0.007507 |
| 0.077438 | 1.085849 | −0.010551 |
| 0.077438 | 1.136055 | −0.013753 |
| 0.077438 | 1.186260 | −0.017113 |
| 0.077438 | 1.236466 | −0.020630 |
| 0.077438 | 1.286579 | −0.024252 |
| 0.077438 | 1.336693 | −0.028064 |
| 0.077438 | 1.386714 | −0.032021 |
| 0.077438 | 1.436734 | −0.036115 |
| 0.077438 | 1.486755 | −0.040367 |
| 0.077438 | 1.536776 | −0.044777 |
| 0.077438 | 1.586612 | −0.049344 |
| 0.077438 | 1.636540 | −0.054016 |
| 0.077438 | 1.686376 | −0.058898 |
| 0.077438 | 1.736119 | −0.063885 |
| 0.077438 | 1.785863 | −0.069029 |
| 0.077438 | 1.835514 | −0.074278 |
| 0.077438 | 1.885165 | −0.079738 |
| 0.077438 | 1.934816 | −0.085302 |
| 0.077438 | 1.984282 | −0.091024 |
| 0.077438 | 2.033840 | −0.096903 |
| 0.077438 | 2.083214 | −0.102940 |
| 0.077438 | 2.132587 | −0.109134 |
| 0.077438 | 2.181869 | −0.115433 |
| 0.077438 | 2.231150 | −0.121890 |
| 0.077438 | 2.280338 | −0.128504 |
| 0.077438 | 2.329527 | −0.135276 |
| 0.077438 | 2.378531 | −0.142152 |
| 0.077438 | 2.427535 | −0.149239 |
| 0.077438 | 2.476538 | −0.156430 |
| 0.077438 | 2.525357 | −0.163780 |
| 0.120705 | −1.473626 | −0.037585 |
| 0.120705 | −1.423605 | −0.033176 |
| 0.120705 | −1.373584 | −0.028924 |
| 0.120705 | −1.323471 | −0.024829 |
| 0.120705 | −1.273265 | −0.020892 |
| 0.120705 | −1.223152 | −0.017060 |
| 0.120705 | −1.172946 | −0.013386 |
| 0.120705 | −1.122648 | −0.009921 |
| 0.120705 | −1.072442 | −0.006562 |
| 0.120705 | −1.022144 | −0.003360 |
| 0.120705 | −0.971754 | −0.000262 |
| 0.120705 | −0.921455 | 0.002625 |
| 0.120705 | −0.871065 | 0.005407 |
| 0.120705 | −0.820582 | 0.007979 |
| 0.120705 | −0.770191 | 0.010446 |
| 0.120705 | −0.719708 | 0.012756 |
| 0.120705 | −0.669225 | 0.014908 |
| 0.120705 | −0.618742 | 0.016955 |
| 0.120705 | −0.568259 | 0.018793 |
| 0.120705 | −0.517683 | 0.020525 |
| 0.120705 | −0.467200 | 0.022047 |
| 0.120705 | −0.416624 | 0.023465 |
| 0.120705 | −0.366049 | 0.024724 |
| 0.120705 | −0.315473 | 0.025827 |
| 0.120705 | −0.264898 | 0.026772 |
| 0.120705 | −0.214230 | 0.027612 |
| 0.120705 | −0.163654 | 0.028241 |
| 0.120705 | −0.113078 | 0.028766 |
| 0.120705 | −0.062410 | 0.029134 |
| 0.120705 | −0.011835 | 0.029344 |
| 0.120705 | 0.038833 | 0.029396 |
| 0.120705 | 0.089409 | 0.029291 |
| 0.120705 | 0.140077 | 0.029029 |
| 0.120705 | 0.190652 | 0.028661 |
| 0.120705 | 0.241228 | 0.028084 |
| 0.120705 | 0.291896 | 0.027402 |
| 0.120705 | 0.342471 | 0.026562 |
| 0.120705 | 0.393047 | 0.025564 |
| 0.120705 | 0.443623 | 0.024409 |
| 0.120705 | 0.494198 | 0.023097 |
| 0.120705 | 0.544774 | 0.021627 |
| 0.120705 | 0.595257 | 0.020052 |
| 0.120705 | 0.645832 | 0.018320 |

TABLE 4-continued

| Inner Diameter Flowpath | | |
|---|---|---|
| X/Root_Bx | Y/Root_Pitch | Z/Span |
| 0.120705 | 0.696315 | 0.016378 |
| 0.120705 | 0.746799 | 0.014331 |
| 0.120705 | 0.797282 | 0.012126 |
| 0.120705 | 0.847765 | 0.009816 |
| 0.120705 | 0.898155 | 0.007297 |
| 0.120705 | 0.948546 | 0.004619 |
| 0.120705 | 0.998937 | 0.001837 |
| 0.120705 | 1.049327 | −0.001102 |
| 0.120705 | 1.099626 | −0.004199 |
| 0.120705 | 1.149924 | −0.007454 |
| 0.120705 | 1.200222 | −0.010866 |
| 0.120705 | 1.250428 | −0.014383 |
| 0.120705 | 1.300633 | −0.018110 |
| 0.120705 | 1.350747 | −0.021942 |
| 0.120705 | 1.400860 | −0.025932 |
| 0.120705 | 1.450973 | −0.030079 |
| 0.120705 | 1.501086 | −0.034383 |
| 0.120705 | 1.551015 | −0.038845 |
| 0.120705 | 1.601036 | −0.043412 |
| 0.120705 | 1.650964 | −0.048136 |
| 0.120705 | 1.700800 | −0.053018 |
| 0.120705 | 1.750636 | −0.058058 |
| 0.120705 | 1.800472 | −0.063255 |
| 0.120705 | 1.850215 | −0.068609 |
| 0.120705 | 1.899866 | −0.074068 |
| 0.120705 | 1.949517 | −0.079685 |
| 0.120705 | 1.999075 | −0.085459 |
| 0.120705 | 2.048634 | −0.091391 |
| 0.120705 | 2.098100 | −0.097480 |
| 0.120705 | 2.147566 | −0.103675 |
| 0.120705 | 2.196940 | −0.110026 |
| 0.120705 | 2.246221 | −0.116535 |
| 0.120705 | 2.295502 | −0.123202 |
| 0.120705 | 2.344598 | −0.130026 |
| 0.120705 | 2.393787 | −0.136955 |
| 0.120705 | 2.442790 | −0.144042 |
| 0.120705 | 2.491794 | −0.151286 |
| 0.120705 | 2.540705 | −0.158688 |
| 0.163971 | −1.464842 | −0.031024 |
| 0.163971 | −1.414729 | −0.026667 |
| 0.163971 | −1.364616 | −0.022415 |
| 0.163971 | −1.314410 | −0.018373 |
| 0.163971 | −1.264297 | −0.014436 |
| 0.163971 | −1.213998 | −0.010656 |
| 0.163971 | −1.163793 | −0.007034 |
| 0.163971 | −1.113495 | −0.003517 |
| 0.163971 | −1.063104 | −0.000210 |
| 0.163971 | −1.012806 | 0.002992 |
| 0.163971 | −0.962415 | 0.005984 |
| 0.163971 | −0.911932 | 0.008871 |
| 0.163971 | −0.861541 | 0.011601 |
| 0.163971 | −0.811058 | 0.014173 |
| 0.163971 | −0.760575 | 0.016640 |
| 0.163971 | −0.710000 | 0.018898 |
| 0.163971 | −0.659516 | 0.021050 |
| 0.163971 | −0.608941 | 0.022992 |
| 0.163971 | −0.558365 | 0.024829 |
| 0.163971 | −0.507790 | 0.026509 |
| 0.163971 | −0.457214 | 0.028031 |
| 0.163971 | −0.406546 | 0.029449 |
| 0.163971 | −0.355971 | 0.030656 |
| 0.163971 | −0.305303 | 0.031759 |
| 0.163971 | −0.254727 | 0.032651 |
| 0.163971 | −0.204059 | 0.033438 |
| 0.163971 | −0.153391 | 0.034068 |
| 0.163971 | −0.102723 | 0.034541 |
| 0.163971 | −0.052055 | 0.034856 |
| 0.163971 | −0.001387 | 0.035013 |
| 0.163971 | 0.049281 | 0.035066 |
| 0.163971 | 0.099949 | 0.034908 |
| 0.163971 | 0.150617 | 0.034646 |
| 0.163971 | 0.201285 | 0.034226 |
| 0.163971 | 0.251953 | 0.033648 |
| 0.163971 | 0.302621 | 0.032913 |
| 0.163971 | 0.353289 | 0.032021 |

TABLE 4-continued

| Inner Diameter Flowpath | | |
|---|---|---|
| X/Root_Bx | Y/Root_Pitch | Z/Span |
| 0.163971 | 0.403957 | 0.031024 |
| 0.163971 | 0.454533 | 0.029816 |
| 0.163971 | 0.505201 | 0.028504 |
| 0.163971 | 0.555776 | 0.027034 |
| 0.163971 | 0.606352 | 0.025354 |
| 0.163971 | 0.656928 | 0.023570 |
| 0.163971 | 0.707503 | 0.021680 |
| 0.163971 | 0.757986 | 0.019580 |
| 0.163971 | 0.808562 | 0.017323 |
| 0.163971 | 0.859045 | 0.014961 |
| 0.163971 | 0.909528 | 0.012441 |
| 0.163971 | 0.960011 | 0.009764 |
| 0.163971 | 1.010402 | 0.006929 |
| 0.163971 | 1.060792 | 0.003937 |
| 0.163971 | 1.111183 | 0.000787 |
| 0.163971 | 1.161481 | −0.002520 |
| 0.163971 | 1.211779 | −0.005932 |
| 0.163971 | 1.262078 | −0.009501 |
| 0.163971 | 1.312376 | −0.013228 |
| 0.163971 | 1.362581 | −0.017113 |
| 0.163971 | 1.412695 | −0.021155 |
| 0.163971 | 1.462808 | −0.025354 |
| 0.163971 | 1.512921 | −0.029659 |
| 0.163971 | 1.563035 | −0.034121 |
| 0.163971 | 1.613055 | −0.038740 |
| 0.163971 | 1.662984 | −0.043517 |
| 0.163971 | 1.712912 | −0.048451 |
| 0.163971 | 1.762748 | −0.053543 |
| 0.163971 | 1.812584 | −0.058740 |
| 0.163971 | 1.862420 | −0.064147 |
| 0.163971 | 1.912163 | −0.069659 |
| 0.163971 | 1.961814 | −0.075276 |
| 0.163971 | 2.011465 | −0.081102 |
| 0.163971 | 2.061024 | −0.087087 |
| 0.163971 | 2.110490 | −0.093176 |
| 0.163971 | 2.159956 | −0.099423 |
| 0.163971 | 2.209422 | −0.105827 |
| 0.163971 | 2.258703 | −0.112388 |
| 0.163971 | 2.307984 | −0.119055 |
| 0.163971 | 2.357265 | −0.125932 |
| 0.163971 | 2.406361 | −0.132913 |
| 0.163971 | 2.455457 | −0.140000 |
| 0.163971 | 2.504461 | −0.147297 |
| 0.163971 | 2.553465 | −0.154751 |
| 0.207238 | −1.458277 | −0.026089 |
| 0.207238 | −1.408164 | −0.021732 |
| 0.207238 | −1.357958 | −0.017533 |
| 0.207238 | −1.307753 | −0.013491 |
| 0.207238 | −1.257547 | −0.009554 |
| 0.207238 | −1.207249 | −0.005827 |
| 0.207238 | −1.156951 | −0.002205 |
| 0.207238 | −1.106560 | 0.001260 |
| 0.207238 | −1.056262 | 0.004567 |
| 0.207238 | −1.005779 | 0.007717 |
| 0.207238 | −0.955388 | 0.010761 |
| 0.207238 | −0.904905 | 0.013596 |
| 0.207238 | −0.854422 | 0.016325 |
| 0.207238 | −0.803939 | 0.018845 |
| 0.207238 | −0.753363 | 0.021260 |
| 0.207238 | −0.702880 | 0.023517 |
| 0.207238 | −0.652305 | 0.025669 |
| 0.207238 | −0.601637 | 0.027612 |
| 0.207238 | −0.551061 | 0.029396 |
| 0.207238 | −0.500393 | 0.031076 |
| 0.207238 | −0.449817 | 0.032598 |
| 0.207238 | −0.399149 | 0.033911 |
| 0.207238 | −0.348481 | 0.035118 |
| 0.207238 | −0.297813 | 0.036168 |
| 0.207238 | −0.247145 | 0.037113 |
| 0.207238 | −0.196385 | 0.037848 |
| 0.207238 | −0.145717 | 0.038478 |
| 0.207238 | −0.094956 | 0.038898 |
| 0.207238 | −0.044288 | 0.039213 |
| 0.207238 | 0.006380 | 0.039370 |
| 0.207238 | 0.057140 | 0.039370 |

TABLE 4-continued

| Inner Diameter Flowpath | | |
|---|---|---|
| X/Root_Bx | Y/Root_Pitch | Z/Span |
| 0.207238 | 0.107808 | 0.039213 |
| 0.207238 | 0.158569 | 0.038898 |
| 0.207238 | 0.209237 | 0.038478 |
| 0.207238 | 0.259997 | 0.037848 |
| 0.207238 | 0.310665 | 0.037113 |
| 0.207238 | 0.361333 | 0.036168 |
| 0.207238 | 0.412001 | 0.035118 |
| 0.207238 | 0.462669 | 0.033911 |
| 0.207238 | 0.513337 | 0.032598 |
| 0.207238 | 0.564005 | 0.031076 |
| 0.207238 | 0.614581 | 0.029396 |
| 0.207238 | 0.665249 | 0.027612 |
| 0.207238 | 0.715825 | 0.025669 |
| 0.207238 | 0.766400 | 0.023517 |
| 0.207238 | 0.816976 | 0.021260 |
| 0.207238 | 0.867459 | 0.018845 |
| 0.207238 | 0.917942 | 0.016325 |
| 0.207238 | 0.968517 | 0.013596 |
| 0.207238 | 1.018908 | 0.010761 |
| 0.207238 | 1.069391 | 0.007717 |
| 0.207238 | 1.119782 | 0.004567 |
| 0.207238 | 1.170172 | 0.001260 |
| 0.207238 | 1.220471 | −0.002205 |
| 0.207238 | 1.270769 | −0.005827 |
| 0.207238 | 1.321067 | −0.009554 |
| 0.207238 | 1.371365 | −0.013491 |
| 0.207238 | 1.421571 | −0.017533 |
| 0.207238 | 1.471684 | −0.021732 |
| 0.207238 | 1.521797 | −0.026089 |
| 0.207238 | 1.571911 | −0.030604 |
| 0.207238 | 1.621931 | −0.035223 |
| 0.207238 | 1.671952 | −0.040052 |
| 0.207238 | 1.721881 | −0.044987 |
| 0.207238 | 1.771809 | −0.050079 |
| 0.207238 | 1.821645 | −0.055328 |
| 0.207238 | 1.871481 | −0.060735 |
| 0.207238 | 1.921224 | −0.066299 |
| 0.207238 | 1.970968 | −0.071969 |
| 0.207238 | 2.020619 | −0.077795 |
| 0.207238 | 2.070270 | −0.083780 |
| 0.207238 | 2.119736 | −0.089921 |
| 0.207238 | 2.169294 | −0.096220 |
| 0.207238 | 2.218668 | −0.102625 |
| 0.207238 | 2.268041 | −0.109186 |
| 0.207238 | 2.317415 | −0.115906 |
| 0.207238 | 2.366603 | −0.122782 |
| 0.207238 | 2.415792 | −0.129816 |
| 0.207238 | 2.464888 | −0.136955 |
| 0.207238 | 2.513985 | −0.144252 |
| 0.207238 | 2.562988 | −0.151706 |
| 0.250504 | −1.454487 | −0.022782 |
| 0.250504 | −1.404281 | −0.018425 |
| 0.250504 | −1.354075 | −0.014278 |
| 0.250504 | −1.303869 | −0.010184 |
| 0.250504 | −1.253571 | −0.006299 |
| 0.250504 | −1.203273 | −0.002520 |
| 0.250504 | −1.152975 | 0.001050 |
| 0.250504 | −1.102584 | 0.004567 |
| 0.250504 | −1.052194 | 0.007874 |
| 0.250504 | −1.001711 | 0.011024 |
| 0.250504 | −0.951320 | 0.014016 |
| 0.250504 | −0.900837 | 0.016903 |
| 0.250504 | −0.850261 | 0.019580 |
| 0.250504 | −0.799778 | 0.022100 |
| 0.250504 | −0.749203 | 0.024514 |
| 0.250504 | −0.698627 | 0.026719 |
| 0.250504 | −0.647959 | 0.028819 |
| 0.250504 | −0.597383 | 0.030761 |
| 0.250504 | −0.546715 | 0.032493 |
| 0.250504 | −0.496047 | 0.034173 |
| 0.250504 | −0.445379 | 0.035643 |
| 0.250504 | −0.394711 | 0.036955 |
| 0.250504 | −0.344043 | 0.038163 |
| 0.250504 | −0.293283 | 0.039213 |
| 0.250504 | −0.242615 | 0.040105 |

TABLE 4-continued

| Inner Diameter Flowpath | | |
|---|---|---|
| X/Root_Bx | Y/Root_Pitch | Z/Span |
| 0.250504 | −0.191854 | 0.040840 |
| 0.250504 | −0.141094 | 0.041470 |
| 0.250504 | −0.090426 | 0.041942 |
| 0.250504 | −0.039665 | 0.042257 |
| 0.250504 | 0.011095 | 0.042362 |
| 0.250504 | 0.061856 | 0.042362 |
| 0.250504 | 0.112524 | 0.042205 |
| 0.250504 | 0.163284 | 0.041890 |
| 0.250504 | 0.214045 | 0.041417 |
| 0.250504 | 0.264713 | 0.040787 |
| 0.250504 | 0.315473 | 0.040052 |
| 0.250504 | 0.366141 | 0.039108 |
| 0.250504 | 0.416902 | 0.038005 |
| 0.250504 | 0.467570 | 0.036745 |
| 0.250504 | 0.518238 | 0.035381 |
| 0.250504 | 0.568906 | 0.033858 |
| 0.250504 | 0.619574 | 0.032178 |
| 0.250504 | 0.670242 | 0.030341 |
| 0.250504 | 0.720817 | 0.028399 |
| 0.250504 | 0.771393 | 0.026247 |
| 0.250504 | 0.822061 | 0.023990 |
| 0.250504 | 0.872544 | 0.021627 |
| 0.250504 | 0.923120 | 0.019055 |
| 0.250504 | 0.973603 | 0.016325 |
| 0.250504 | 1.024086 | 0.013491 |
| 0.250504 | 1.074569 | 0.010446 |
| 0.250504 | 1.125052 | 0.007297 |
| 0.250504 | 1.175443 | 0.003990 |
| 0.250504 | 1.225741 | 0.000472 |
| 0.250504 | 1.276131 | −0.003150 |
| 0.250504 | 1.326430 | −0.006929 |
| 0.250504 | 1.376635 | −0.010866 |
| 0.250504 | 1.426934 | −0.014961 |
| 0.250504 | 1.477047 | −0.019213 |
| 0.250504 | 1.527253 | −0.023570 |
| 0.250504 | 1.577366 | −0.028136 |
| 0.250504 | 1.627387 | −0.032808 |
| 0.250504 | 1.677407 | −0.037585 |
| 0.250504 | 1.727428 | −0.042572 |
| 0.250504 | 1.777357 | −0.047664 |
| 0.250504 | 1.827192 | −0.052913 |
| 0.250504 | 1.877121 | −0.058320 |
| 0.250504 | 1.926864 | −0.063885 |
| 0.250504 | 1.976608 | −0.069554 |
| 0.250504 | 2.026259 | −0.075381 |
| 0.250504 | 2.075910 | −0.081365 |
| 0.250504 | 2.125468 | −0.087507 |
| 0.250504 | 2.175027 | −0.093806 |
| 0.250504 | 2.224493 | −0.100262 |
| 0.250504 | 2.273866 | −0.106877 |
| 0.250504 | 2.323147 | −0.113648 |
| 0.250504 | 2.372428 | −0.120525 |
| 0.250504 | 2.421617 | −0.127559 |
| 0.250504 | 2.470806 | −0.134751 |
| 0.250504 | 2.519810 | −0.142100 |
| 0.250504 | 2.568813 | −0.149606 |
| 0.293770 | −1.453377 | −0.021365 |
| 0.293770 | −1.403171 | −0.017060 |
| 0.293770 | −1.352966 | −0.012861 |
| 0.293770 | −1.302667 | −0.008766 |
| 0.293770 | −1.252462 | −0.004777 |
| 0.293770 | −1.202164 | −0.000840 |
| 0.293770 | −1.151865 | 0.002887 |
| 0.293770 | −1.101475 | 0.006562 |
| 0.293770 | −1.051084 | 0.010026 |
| 0.293770 | −1.000693 | 0.013333 |
| 0.293770 | −0.950210 | 0.016430 |
| 0.293770 | −0.899727 | 0.019370 |
| 0.293770 | −0.849152 | 0.022047 |
| 0.293770 | −0.798576 | 0.024514 |
| 0.293770 | −0.748001 | 0.026824 |
| 0.293770 | −0.697333 | 0.028871 |
| 0.293770 | −0.646757 | 0.030814 |
| 0.293770 | −0.596089 | 0.032546 |
| 0.293770 | −0.545421 | 0.034173 |

TABLE 4-continued

| Inner Diameter Flowpath | | |
|---|---|---|
| X/Root_Bx | Y/Root_Pitch | Z/Span |
| 0.293770 | −0.494660 | 0.035643 |
| 0.293770 | −0.443992 | 0.037008 |
| 0.293770 | −0.393324 | 0.038268 |
| 0.293770 | −0.342564 | 0.039475 |
| 0.293770 | −0.291896 | 0.040577 |
| 0.293770 | −0.241135 | 0.041575 |
| 0.293770 | −0.190467 | 0.042467 |
| 0.293770 | −0.139707 | 0.043255 |
| 0.293770 | −0.088946 | 0.043885 |
| 0.293770 | −0.038186 | 0.044304 |
| 0.293770 | 0.012575 | 0.044619 |
| 0.293770 | 0.063335 | 0.044724 |
| 0.293770 | 0.114096 | 0.044619 |
| 0.293770 | 0.164856 | 0.044304 |
| 0.293770 | 0.215616 | 0.043780 |
| 0.293770 | 0.266284 | 0.043045 |
| 0.293770 | 0.317045 | 0.042100 |
| 0.293770 | 0.367805 | 0.040997 |
| 0.293770 | 0.418473 | 0.039738 |
| 0.293770 | 0.469142 | 0.038320 |
| 0.293770 | 0.519902 | 0.036798 |
| 0.293770 | 0.570570 | 0.035118 |
| 0.293770 | 0.621238 | 0.033386 |
| 0.293770 | 0.671814 | 0.031549 |
| 0.293770 | 0.722482 | 0.029659 |
| 0.293770 | 0.773150 | 0.027612 |
| 0.293770 | 0.823725 | 0.025512 |
| 0.293770 | 0.874301 | 0.023255 |
| 0.293770 | 0.924876 | 0.020892 |
| 0.293770 | 0.975452 | 0.018320 |
| 0.293770 | 1.026027 | 0.015643 |
| 0.293770 | 1.076511 | 0.012703 |
| 0.293770 | 1.126994 | 0.009606 |
| 0.293770 | 1.177384 | 0.006299 |
| 0.293770 | 1.227775 | 0.002730 |
| 0.293770 | 1.278073 | −0.001050 |
| 0.293770 | 1.328371 | −0.004987 |
| 0.293770 | 1.378577 | −0.009081 |
| 0.293770 | 1.428783 | −0.013333 |
| 0.293770 | 1.478988 | −0.017743 |
| 0.293770 | 1.529102 | −0.022310 |
| 0.293770 | 1.579215 | −0.026929 |
| 0.293770 | 1.629236 | −0.031654 |
| 0.293770 | 1.679257 | −0.036483 |
| 0.293770 | 1.729277 | −0.041417 |
| 0.293770 | 1.779298 | −0.046404 |
| 0.293770 | 1.829227 | −0.051549 |
| 0.293770 | 1.879155 | −0.056745 |
| 0.293770 | 1.928991 | −0.062152 |
| 0.293770 | 1.978827 | −0.067664 |
| 0.293770 | 2.028570 | −0.073386 |
| 0.293770 | 2.078221 | −0.079265 |
| 0.293770 | 2.127872 | −0.085354 |
| 0.293770 | 2.177431 | −0.091654 |
| 0.293770 | 2.226804 | −0.098163 |
| 0.293770 | 2.276178 | −0.104882 |
| 0.293770 | 2.325459 | −0.111811 |
| 0.293770 | 2.374740 | −0.118898 |
| 0.293770 | 2.423836 | −0.126089 |
| 0.293770 | 2.472932 | −0.133438 |
| 0.293770 | 2.521936 | −0.140945 |
| 0.293770 | 2.570847 | −0.148504 |
| 0.337037 | −1.454949 | −0.021732 |
| 0.337037 | −1.404743 | −0.017585 |
| 0.337037 | −1.354537 | −0.013386 |
| 0.337037 | −1.304332 | −0.009134 |
| 0.337037 | −1.254126 | −0.004934 |
| 0.337037 | −1.203920 | −0.000735 |
| 0.337037 | −1.153715 | 0.003360 |
| 0.337037 | −1.103416 | 0.007349 |
| 0.337037 | −1.053118 | 0.011181 |
| 0.337037 | −1.002728 | 0.014803 |
| 0.337037 | −0.952244 | 0.018163 |
| 0.337037 | −0.901761 | 0.021207 |
| 0.337037 | −0.851186 | 0.023937 |

TABLE 4-continued

| Inner Diameter Flowpath | | |
|---|---|---|
| X/Root_Bx | Y/Root_Pitch | Z/Span |
| 0.337037 | −0.800610 | 0.026299 |
| 0.337037 | −0.749942 | 0.028294 |
| 0.337037 | −0.699274 | 0.030079 |
| 0.337037 | −0.648606 | 0.031654 |
| 0.337037 | −0.597846 | 0.033071 |
| 0.337037 | −0.547178 | 0.034331 |
| 0.337037 | −0.496417 | 0.035538 |
| 0.337037 | −0.445749 | 0.036693 |
| 0.337037 | −0.394989 | 0.037648 |
| 0.337037 | −0.344321 | 0.039055 |
| 0.337037 | −0.293653 | 0.040262 |
| 0.337037 | −0.242892 | 0.041522 |
| 0.337037 | −0.192224 | 0.042677 |
| 0.337037 | −0.141464 | 0.043780 |
| 0.337037 | −0.090703 | 0.044777 |
| 0.337037 | −0.039943 | 0.045617 |
| 0.337037 | 0.010818 | 0.046194 |
| 0.337037 | 0.061578 | 0.046562 |
| 0.337037 | 0.112339 | 0.046614 |
| 0.337037 | 0.163099 | 0.046299 |
| 0.337037 | 0.213952 | 0.045617 |
| 0.337037 | 0.264620 | 0.044672 |
| 0.337037 | 0.315381 | 0.043412 |
| 0.337037 | 0.366141 | 0.041942 |
| 0.337037 | 0.416809 | 0.040367 |
| 0.337037 | 0.467477 | 0.038583 |
| 0.337037 | 0.518145 | 0.036798 |
| 0.337037 | 0.568813 | 0.034961 |
| 0.337037 | 0.619389 | 0.033071 |
| 0.337037 | 0.670057 | 0.031234 |
| 0.337037 | 0.720725 | 0.029449 |
| 0.337037 | 0.771393 | 0.027664 |
| 0.337037 | 0.822061 | 0.025827 |
| 0.337037 | 0.872729 | 0.023937 |
| 0.337037 | 0.923305 | 0.021890 |
| 0.337037 | 0.973973 | 0.019685 |
| 0.337037 | 1.024548 | 0.017323 |
| 0.337037 | 1.075124 | 0.014646 |
| 0.337037 | 1.125607 | 0.011654 |
| 0.337037 | 1.176090 | 0.008346 |
| 0.337037 | 1.226481 | 0.004672 |
| 0.337037 | 1.276686 | 0.000682 |
| 0.337037 | 1.326984 | −0.003570 |
| 0.337037 | 1.377098 | −0.008031 |
| 0.337037 | 1.427211 | −0.012651 |
| 0.337037 | 1.477324 | −0.017375 |
| 0.337037 | 1.527345 | −0.022152 |
| 0.337037 | 1.577366 | −0.027034 |
| 0.337037 | 1.627387 | −0.031864 |
| 0.337037 | 1.677407 | −0.036693 |
| 0.337037 | 1.727521 | −0.041470 |
| 0.337037 | 1.777541 | −0.046247 |
| 0.337037 | 1.827562 | −0.051076 |
| 0.337037 | 1.877583 | −0.056010 |
| 0.337037 | 1.927604 | −0.061050 |
| 0.337037 | 1.977532 | −0.066194 |
| 0.337037 | 2.027461 | −0.071601 |
| 0.337037 | 2.077204 | −0.077270 |
| 0.337037 | 2.126947 | −0.083202 |
| 0.337037 | 2.176506 | −0.089501 |
| 0.337037 | 2.225880 | −0.096168 |
| 0.337037 | 2.275161 | −0.103097 |
| 0.337037 | 2.324349 | −0.110289 |
| 0.337037 | 2.373446 | −0.117743 |
| 0.337037 | 2.422357 | −0.125302 |
| 0.337037 | 2.471361 | −0.132966 |
| 0.337037 | 2.520179 | −0.140735 |
| 0.337037 | 2.569091 | −0.148504 |
| 0.380303 | −1.459664 | −0.023937 |
| 0.380303 | −1.409366 | −0.019948 |
| 0.380303 | −1.359253 | −0.015748 |
| 0.380303 | −1.309047 | −0.011339 |
| 0.380303 | −1.258934 | −0.006772 |
| 0.380303 | −1.208913 | −0.002152 |
| 0.380303 | −1.158707 | 0.002467 |

TABLE 4-continued

| Inner Diameter Flowpath | | |
|---|---|---|
| X/Root_Bx | Y/Root_Pitch | Z/Span |
| 0.380303 | −1.108594 | 0.006982 |
| 0.380303 | −1.058388 | 0.011339 |
| 0.380303 | −1.008090 | 0.015381 |
| 0.380303 | −0.957700 | 0.019108 |
| 0.380303 | −0.907216 | 0.022415 |
| 0.380303 | −0.856641 | 0.025092 |
| 0.380303 | −0.805973 | 0.027297 |
| 0.380303 | −0.755305 | 0.028976 |
| 0.380303 | −0.704544 | 0.030341 |
| 0.380303 | −0.653784 | 0.031391 |
| 0.380303 | −0.603023 | 0.032283 |
| 0.380303 | −0.552263 | 0.033123 |
| 0.380303 | −0.501502 | 0.033911 |
| 0.380303 | −0.450742 | 0.034751 |
| 0.380303 | −0.400074 | 0.035748 |
| 0.380303 | −0.349406 | 0.036955 |
| 0.380303 | −0.298738 | 0.038373 |
| 0.380303 | −0.248070 | 0.039948 |
| 0.380303 | −0.197309 | 0.041575 |
| 0.380303 | −0.146641 | 0.043202 |
| 0.380303 | −0.095881 | 0.044724 |
| 0.380303 | −0.045120 | 0.046037 |
| 0.380303 | 0.005640 | 0.047139 |
| 0.380303 | 0.056401 | 0.047822 |
| 0.380303 | 0.107161 | 0.048084 |
| 0.380303 | 0.158014 | 0.047769 |
| 0.380303 | 0.208774 | 0.046929 |
| 0.380303 | 0.259535 | 0.045617 |
| 0.380303 | 0.310203 | 0.043937 |
| 0.380303 | 0.360871 | 0.041995 |
| 0.380303 | 0.411539 | 0.039895 |
| 0.380303 | 0.462207 | 0.037690 |
| 0.380303 | 0.512783 | 0.035486 |
| 0.380303 | 0.563451 | 0.033333 |
| 0.380303 | 0.614026 | 0.031286 |
| 0.380303 | 0.664694 | 0.029501 |
| 0.380303 | 0.715270 | 0.027874 |
| 0.380303 | 0.766030 | 0.026457 |
| 0.380303 | 0.816698 | 0.025039 |
| 0.380303 | 0.867459 | 0.023622 |
| 0.380303 | 0.918127 | 0.022152 |
| 0.380303 | 0.968887 | 0.020472 |
| 0.380303 | 1.019555 | 0.018530 |
| 0.380303 | 1.070223 | 0.016220 |
| 0.380303 | 1.120799 | 0.013438 |
| 0.380303 | 1.171189 | 0.010131 |
| 0.380303 | 1.221580 | 0.006299 |
| 0.380303 | 1.271786 | 0.001942 |
| 0.380303 | 1.321899 | −0.002730 |
| 0.380303 | 1.371920 | −0.007664 |
| 0.380303 | 1.421941 | −0.012756 |
| 0.380303 | 1.471869 | −0.017953 |
| 0.380303 | 1.521797 | −0.023202 |
| 0.380303 | 1.571726 | −0.028346 |
| 0.380303 | 1.621747 | −0.033333 |
| 0.380303 | 1.671767 | −0.038110 |
| 0.380303 | 1.721788 | −0.042730 |
| 0.380303 | 1.771994 | −0.047192 |
| 0.380303 | 1.822107 | −0.051601 |
| 0.380303 | 1.872313 | −0.056010 |
| 0.380303 | 1.922519 | −0.060472 |
| 0.380303 | 1.972632 | −0.065197 |
| 0.380303 | 2.022653 | −0.070131 |
| 0.380303 | 2.072581 | −0.075433 |
| 0.380303 | 2.122417 | −0.081155 |
| 0.380303 | 2.171975 | −0.087454 |
| 0.380303 | 2.221349 | −0.094278 |
| 0.380303 | 2.270445 | −0.101522 |
| 0.380303 | 2.319449 | −0.109186 |
| 0.380303 | 2.368360 | −0.117060 |
| 0.380303 | 2.417087 | −0.125092 |
| 0.380303 | 2.465813 | −0.133228 |
| 0.380303 | 2.514539 | −0.141365 |
| 0.380303 | 2.563266 | −0.149449 |
| 0.423570 | −1.467708 | −0.028241 |

TABLE 4-continued

| Inner Diameter Flowpath | | |
|---|---|---|
| X/Root_Bx | Y/Root_Pitch | Z/Span |
| 0.423570 | −1.417410 | −0.024409 |
| 0.423570 | −1.367297 | −0.020210 |
| 0.423570 | −1.317276 | −0.015538 |
| 0.423570 | −1.267255 | −0.010551 |
| 0.423570 | −1.217327 | −0.005407 |
| 0.423570 | −1.167399 | −0.000105 |
| 0.423570 | −1.117378 | 0.005092 |
| 0.423570 | −1.067265 | 0.010079 |
| 0.423570 | −1.017151 | 0.014803 |
| 0.423570 | −0.966853 | 0.019003 |
| 0.423570 | −0.916462 | 0.022520 |
| 0.423570 | −0.865887 | 0.025302 |
| 0.423570 | −0.815126 | 0.027244 |
| 0.423570 | −0.764366 | 0.028504 |
| 0.423570 | −0.713513 | 0.029291 |
| 0.423570 | −0.662753 | 0.029711 |
| 0.423570 | −0.611900 | 0.029974 |
| 0.423570 | −0.561047 | 0.030236 |
| 0.423570 | −0.510286 | 0.030499 |
| 0.423570 | −0.459526 | 0.031024 |
| 0.423570 | −0.408858 | 0.031811 |
| 0.423570 | −0.358190 | 0.033018 |
| 0.423570 | −0.307614 | 0.034698 |
| 0.423570 | −0.257039 | 0.036693 |
| 0.423570 | −0.206370 | 0.038845 |
| 0.423570 | −0.155702 | 0.041155 |
| 0.423570 | −0.105034 | 0.043360 |
| 0.423570 | −0.054274 | 0.045354 |
| 0.423570 | −0.003513 | 0.047034 |
| 0.423570 | 0.047247 | 0.048241 |
| 0.423570 | 0.098007 | 0.048766 |
| 0.423570 | 0.148860 | 0.048504 |
| 0.423570 | 0.199621 | 0.047454 |
| 0.423570 | 0.250381 | 0.045669 |
| 0.423570 | 0.301049 | 0.043465 |
| 0.423570 | 0.351717 | 0.040892 |
| 0.423570 | 0.402293 | 0.038110 |
| 0.423570 | 0.452869 | 0.035328 |
| 0.423570 | 0.503444 | 0.032598 |
| 0.423570 | 0.553927 | 0.030079 |
| 0.423570 | 0.604503 | 0.027874 |
| 0.423570 | 0.655078 | 0.026089 |
| 0.423570 | 0.705746 | 0.024724 |
| 0.423570 | 0.756507 | 0.023727 |
| 0.423570 | 0.807267 | 0.022887 |
| 0.423570 | 0.858028 | 0.022100 |
| 0.423570 | 0.908881 | 0.021312 |
| 0.423570 | 0.959641 | 0.020315 |
| 0.423570 | 1.010402 | 0.019003 |
| 0.423570 | 1.061162 | 0.017165 |
| 0.423570 | 1.111830 | 0.014698 |
| 0.423570 | 1.162221 | 0.011391 |
| 0.423570 | 1.212519 | 0.007297 |
| 0.423570 | 1.262725 | 0.002572 |
| 0.423570 | 1.312746 | −0.002677 |
| 0.423570 | 1.362581 | −0.008241 |
| 0.423570 | 1.412417 | −0.013963 |
| 0.423570 | 1.462161 | −0.019738 |
| 0.423570 | 1.511997 | −0.025459 |
| 0.423570 | 1.561740 | −0.030971 |
| 0.423570 | 1.611668 | −0.036168 |
| 0.423570 | 1.661597 | −0.040945 |
| 0.423570 | 1.711803 | −0.045302 |
| 0.423570 | 1.762008 | −0.049344 |
| 0.423570 | 1.812306 | −0.053176 |
| 0.423570 | 1.862697 | −0.056955 |
| 0.423570 | 1.913088 | −0.060735 |
| 0.423570 | 1.963478 | −0.064777 |
| 0.423570 | 2.013684 | −0.069081 |
| 0.423570 | 2.063797 | −0.073911 |
| 0.423570 | 2.113726 | −0.079423 |
| 0.423570 | 2.163284 | −0.085669 |
| 0.423570 | 2.212565 | −0.092703 |
| 0.423570 | 2.261569 | −0.100420 |
| 0.423570 | 2.310295 | −0.108556 |

TABLE 4-continued

| Inner Diameter Flowpath | | |
|---|---|---|
| X/Root_Bx | Y/Root_Pitch | Z/Span |
| 0.423570 | 2.358929 | −0.117060 |
| 0.423570 | 2.407378 | −0.125722 |
| 0.423570 | 2.455827 | −0.134436 |
| 0.423570 | 2.504276 | −0.143097 |
| 0.423570 | 2.552818 | −0.151496 |
| 0.466836 | −1.479913 | −0.033911 |
| 0.466836 | −1.429615 | −0.030341 |
| 0.466836 | −1.379502 | −0.026089 |
| 0.466836 | −1.329573 | −0.021102 |
| 0.466836 | −1.279830 | −0.015643 |
| 0.466836 | −1.230086 | −0.009816 |
| 0.466836 | −1.180251 | −0.003780 |
| 0.466836 | −1.130507 | 0.002257 |
| 0.466836 | −1.080579 | 0.008084 |
| 0.466836 | −1.030558 | 0.013491 |
| 0.466836 | −0.980445 | 0.018268 |
| 0.466836 | −0.930054 | 0.022152 |
| 0.466836 | −0.879479 | 0.024987 |
| 0.466836 | −0.828718 | 0.026614 |
| 0.466836 | −0.777865 | 0.027402 |
| 0.466836 | −0.727012 | 0.027507 |
| 0.466836 | −0.676067 | 0.027244 |
| 0.466836 | −0.625121 | 0.026719 |
| 0.466836 | −0.574268 | 0.026247 |
| 0.466836 | −0.523508 | 0.025984 |
| 0.466836 | −0.472747 | 0.026089 |
| 0.466836 | −0.422079 | 0.026667 |
| 0.466836 | −0.371504 | 0.027927 |
| 0.466836 | −0.320928 | 0.029869 |
| 0.466836 | −0.270353 | 0.032388 |
| 0.466836 | −0.219777 | 0.035223 |
| 0.466836 | −0.169202 | 0.038268 |
| 0.466836 | −0.118626 | 0.041312 |
| 0.466836 | −0.067866 | 0.044147 |
| 0.466836 | −0.017198 | 0.046562 |
| 0.466836 | 0.033655 | 0.048346 |
| 0.466836 | 0.084416 | 0.049239 |
| 0.466836 | 0.135176 | 0.049029 |
| 0.466836 | 0.186029 | 0.047664 |
| 0.466836 | 0.236697 | 0.045407 |
| 0.466836 | 0.287365 | 0.042520 |
| 0.466836 | 0.337941 | 0.039160 |
| 0.466836 | 0.388516 | 0.035696 |
| 0.466836 | 0.439000 | 0.032178 |
| 0.466836 | 0.489483 | 0.028871 |
| 0.466836 | 0.539966 | 0.025932 |
| 0.466836 | 0.590449 | 0.023517 |
| 0.466836 | 0.641024 | 0.021785 |
| 0.466836 | 0.691600 | 0.020735 |
| 0.466836 | 0.742361 | 0.020210 |
| 0.466836 | 0.793213 | 0.020052 |
| 0.466836 | 0.844066 | 0.020105 |
| 0.466836 | 0.895012 | 0.020105 |
| 0.466836 | 0.945865 | 0.019948 |
| 0.466836 | 0.996810 | 0.019318 |
| 0.466836 | 1.047663 | 0.018058 |
| 0.466836 | 1.098331 | 0.015906 |
| 0.466836 | 1.148814 | 0.012703 |
| 0.466836 | 1.199020 | 0.008346 |
| 0.466836 | 1.249041 | 0.003097 |
| 0.466836 | 1.298969 | −0.002782 |
| 0.466836 | 1.348620 | −0.009134 |
| 0.466836 | 1.398271 | −0.015591 |
| 0.466836 | 1.447830 | −0.022047 |
| 0.466836 | 1.497388 | −0.028346 |
| 0.466836 | 1.547039 | −0.034226 |
| 0.466836 | 1.596875 | −0.039633 |
| 0.466836 | 1.646803 | −0.044409 |
| 0.466836 | 1.697009 | −0.048451 |
| 0.466836 | 1.747307 | −0.051969 |
| 0.466836 | 1.797790 | −0.055118 |
| 0.466836 | 1.848458 | −0.058163 |
| 0.466836 | 1.899034 | −0.061155 |
| 0.466836 | 1.949702 | −0.064357 |
| 0.466836 | 2.000185 | −0.067979 |

TABLE 4-continued

| Inner Diameter Flowpath | | |
|---|---|---|
| X/Root_Bx | Y/Root_Pitch | Z/Span |
| 0.466836 | 2.050483 | −0.072231 |
| 0.466836 | 2.100504 | −0.077375 |
| 0.466836 | 2.150155 | −0.083570 |
| 0.466836 | 2.199344 | −0.090866 |
| 0.466836 | 2.248070 | −0.099055 |
| 0.466836 | 2.296611 | −0.107874 |
| 0.466836 | 2.344875 | −0.117113 |
| 0.466836 | 2.393047 | −0.126509 |
| 0.466836 | 2.441126 | −0.135906 |
| 0.466836 | 2.489298 | −0.145039 |
| 0.466836 | 2.537562 | −0.153911 |
| 0.510103 | −1.497018 | −0.040315 |
| 0.510103 | −1.446720 | −0.036955 |
| 0.510103 | −1.396699 | −0.032598 |
| 0.510103 | −1.346956 | −0.027349 |
| 0.510103 | −1.297305 | −0.021312 |
| 0.510103 | −1.247746 | −0.014698 |
| 0.510103 | −1.198280 | −0.007822 |
| 0.510103 | −1.148722 | −0.000892 |
| 0.510103 | −1.098978 | 0.005879 |
| 0.510103 | −1.049235 | 0.012178 |
| 0.510103 | −0.999122 | 0.017585 |
| 0.510103 | −0.948823 | 0.021890 |
| 0.510103 | −0.898340 | 0.024724 |
| 0.510103 | −0.847487 | 0.026089 |
| 0.510103 | −0.796542 | 0.026299 |
| 0.510103 | −0.745504 | 0.025669 |
| 0.510103 | −0.694466 | 0.024514 |
| 0.510103 | −0.643428 | 0.023202 |
| 0.510103 | −0.592575 | 0.021995 |
| 0.510103 | −0.541723 | 0.021102 |
| 0.510103 | −0.490962 | 0.020735 |
| 0.510103 | −0.440294 | 0.021102 |
| 0.510103 | −0.389718 | 0.022415 |
| 0.510103 | −0.339235 | 0.024724 |
| 0.510103 | −0.288845 | 0.027822 |
| 0.510103 | −0.238362 | 0.031391 |
| 0.510103 | −0.187786 | 0.035328 |
| 0.510103 | −0.137210 | 0.039265 |
| 0.510103 | −0.086635 | 0.043045 |
| 0.510103 | −0.035874 | 0.046352 |
| 0.510103 | 0.014886 | 0.048766 |
| 0.510103 | 0.065647 | 0.050079 |
| 0.510103 | 0.116499 | 0.049869 |
| 0.510103 | 0.167260 | 0.048241 |
| 0.510103 | 0.217928 | 0.045407 |
| 0.510103 | 0.268596 | 0.041732 |
| 0.510103 | 0.319172 | 0.037585 |
| 0.510103 | 0.369655 | 0.033281 |
| 0.510103 | 0.420045 | 0.029029 |
| 0.510103 | 0.470436 | 0.025144 |
| 0.510103 | 0.520827 | 0.021732 |
| 0.510103 | 0.571310 | 0.019108 |
| 0.510103 | 0.621793 | 0.017428 |
| 0.510103 | 0.672461 | 0.016693 |
| 0.510103 | 0.723221 | 0.016745 |
| 0.510103 | 0.774074 | 0.017375 |
| 0.510103 | 0.825020 | 0.018215 |
| 0.510103 | 0.876058 | 0.019213 |
| 0.510103 | 0.927095 | 0.019948 |
| 0.510103 | 0.978133 | 0.020210 |
| 0.510103 | 1.029079 | 0.019580 |
| 0.510103 | 1.079839 | 0.017848 |
| 0.510103 | 1.130322 | 0.014698 |
| 0.510103 | 1.180528 | 0.010026 |
| 0.510103 | 1.230456 | 0.004199 |
| 0.510103 | 1.280107 | −0.002415 |
| 0.510103 | 1.329666 | −0.009554 |
| 0.510103 | 1.379039 | −0.016850 |
| 0.510103 | 1.428413 | −0.024094 |
| 0.510103 | 1.477787 | −0.030971 |
| 0.510103 | 1.527345 | −0.037323 |
| 0.510103 | 1.576996 | −0.042940 |
| 0.510103 | 1.626924 | −0.047612 |
| 0.510103 | 1.677130 | −0.051286 |

TABLE 4-continued

| Inner Diameter Flowpath | | |
|---|---|---|
| X/Root_Bx | Y/Root_Pitch | Z/Span |
| 0.510103 | 1.727613 | −0.054278 |
| 0.510103 | 1.778281 | −0.056693 |
| 0.510103 | 1.829134 | −0.058845 |
| 0.510103 | 1.880080 | −0.060892 |
| 0.510103 | 1.931025 | −0.063202 |
| 0.510103 | 1.981785 | −0.065984 |
| 0.510103 | 2.032361 | −0.069606 |
| 0.510103 | 2.082474 | −0.074331 |
| 0.510103 | 2.132125 | −0.080525 |
| 0.510103 | 2.181221 | −0.088084 |
| 0.510103 | 2.229763 | −0.096850 |
| 0.510103 | 2.277934 | −0.106404 |
| 0.510103 | 2.325921 | −0.116430 |
| 0.510103 | 2.373723 | −0.126667 |
| 0.510103 | 2.421432 | −0.136745 |
| 0.510103 | 2.469326 | −0.146509 |
| 0.510103 | 2.517406 | −0.155748 |
| 0.553369 | −1.519763 | −0.047349 |
| 0.553369 | −1.469373 | −0.044199 |
| 0.553369 | −1.419444 | −0.039790 |
| 0.553369 | −1.369793 | −0.034173 |
| 0.553369 | −1.320420 | −0.027507 |
| 0.553369 | −1.271139 | −0.020157 |
| 0.553369 | −1.221858 | −0.012336 |
| 0.553369 | −1.172576 | −0.004357 |
| 0.553369 | −1.123110 | 0.003412 |
| 0.553369 | −1.073459 | 0.010604 |
| 0.553369 | −1.023624 | 0.016745 |
| 0.553369 | −0.973418 | 0.021522 |
| 0.553369 | −0.922842 | 0.024409 |
| 0.553369 | −0.871989 | 0.025459 |
| 0.553369 | −0.820951 | 0.025039 |
| 0.553369 | −0.769729 | 0.023622 |
| 0.553369 | −0.718598 | 0.021575 |
| 0.553369 | −0.667468 | 0.019370 |
| 0.553369 | −0.616430 | 0.017428 |
| 0.553369 | −0.565577 | 0.015906 |
| 0.553369 | −0.514817 | 0.015066 |
| 0.553369 | −0.464241 | 0.015223 |
| 0.553369 | −0.413666 | 0.016640 |
| 0.553369 | −0.363275 | 0.019318 |
| 0.553369 | −0.312884 | 0.022992 |
| 0.553369 | −0.262586 | 0.027402 |
| 0.553369 | −0.212103 | 0.032231 |
| 0.553369 | −0.161620 | 0.037218 |
| 0.553369 | −0.111044 | 0.042047 |
| 0.553369 | −0.060376 | 0.046194 |
| 0.553369 | −0.009616 | 0.049396 |
| 0.553369 | 0.041145 | 0.051129 |
| 0.553369 | 0.091998 | 0.051024 |
| 0.553369 | 0.142758 | 0.049081 |
| 0.553369 | 0.193519 | 0.045617 |
| 0.553369 | 0.244094 | 0.041155 |
| 0.553369 | 0.294670 | 0.036063 |
| 0.553369 | 0.345060 | 0.030866 |
| 0.553369 | 0.395451 | 0.025879 |
| 0.553369 | 0.445749 | 0.021365 |
| 0.553369 | 0.496047 | 0.017533 |
| 0.553369 | 0.546438 | 0.014698 |
| 0.553369 | 0.596921 | 0.013071 |
| 0.553369 | 0.647589 | 0.012756 |
| 0.553369 | 0.698350 | 0.013386 |
| 0.553369 | 0.749203 | 0.014803 |
| 0.553369 | 0.800240 | 0.016640 |
| 0.553369 | 0.851371 | 0.018583 |
| 0.553369 | 0.902594 | 0.020367 |
| 0.553369 | 0.953816 | 0.021522 |
| 0.553369 | 1.004854 | 0.021680 |
| 0.553369 | 1.055707 | 0.020367 |
| 0.553369 | 1.106190 | 0.017270 |
| 0.553369 | 1.156303 | 0.012283 |
| 0.553369 | 1.206139 | 0.005879 |
| 0.553369 | 1.255698 | −0.001575 |
| 0.553369 | 1.304979 | −0.009606 |
| 0.553369 | 1.354168 | −0.017795 |

TABLE 4-continued

| Inner Diameter Flowpath | | |
|---|---|---|
| X/Root_Bx | Y/Root_Pitch | Z/Span |
| 0.553369 | 1.403356 | −0.025774 |
| 0.553369 | 1.452545 | −0.033228 |
| 0.553369 | 1.501919 | −0.040052 |
| 0.553369 | 1.551477 | −0.045827 |
| 0.553369 | 1.601405 | −0.050446 |
| 0.553369 | 1.651611 | −0.053806 |
| 0.553369 | 1.702279 | −0.056115 |
| 0.553369 | 1.753132 | −0.057743 |
| 0.553369 | 1.804262 | −0.059003 |
| 0.553369 | 1.855485 | −0.060052 |
| 0.553369 | 1.906708 | −0.061312 |
| 0.553369 | 1.957838 | −0.063202 |
| 0.553369 | 2.008599 | −0.066089 |
| 0.553369 | 2.058989 | −0.070394 |
| 0.553369 | 2.108640 | −0.076483 |
| 0.553369 | 2.157552 | −0.084409 |
| 0.553369 | 2.205908 | −0.093753 |
| 0.553369 | 2.253802 | −0.104094 |
| 0.553369 | 2.301327 | −0.115013 |
| 0.553369 | 2.348759 | −0.126089 |
| 0.553369 | 2.396191 | −0.136903 |
| 0.553369 | 2.443807 | −0.147297 |
| 0.553369 | 2.491609 | −0.156955 |
| 0.596636 | −1.548426 | −0.055066 |
| 0.596636 | −1.498035 | −0.052073 |
| 0.596636 | −1.448199 | −0.047612 |
| 0.596636 | −1.398733 | −0.041575 |
| 0.596636 | −1.349545 | −0.034331 |
| 0.596636 | −1.300448 | −0.026142 |
| 0.596636 | −1.251537 | −0.017375 |
| 0.596636 | −1.202533 | −0.008346 |
| 0.596636 | −1.153345 | 0.000472 |
| 0.596636 | −1.103971 | 0.008661 |
| 0.596636 | −1.054228 | 0.015591 |
| 0.596636 | −1.004114 | 0.020840 |
| 0.596636 | −0.953539 | 0.023832 |
| 0.596636 | −0.902594 | 0.024567 |
| 0.596636 | −0.851463 | 0.023517 |
| 0.596636 | −0.800148 | 0.021207 |
| 0.596636 | −0.748833 | 0.018268 |
| 0.596636 | −0.697517 | 0.015171 |
| 0.596636 | −0.646480 | 0.012441 |
| 0.596636 | −0.595534 | 0.010341 |
| 0.596636 | −0.544774 | 0.009081 |
| 0.596636 | −0.494198 | 0.009081 |
| 0.596636 | −0.443715 | 0.010551 |
| 0.596636 | −0.393417 | 0.013648 |
| 0.596636 | −0.343119 | 0.017953 |
| 0.596636 | −0.292820 | 0.023150 |
| 0.596636 | −0.242522 | 0.028976 |
| 0.596636 | −0.192132 | 0.035066 |
| 0.596636 | −0.141649 | 0.040892 |
| 0.596636 | −0.090981 | 0.046089 |
| 0.596636 | −0.040313 | 0.050079 |
| 0.596636 | 0.010540 | 0.052283 |
| 0.596636 | 0.061393 | 0.052283 |
| 0.596636 | 0.112154 | 0.049974 |
| 0.596636 | 0.162914 | 0.045879 |
| 0.596636 | 0.213490 | 0.040577 |
| 0.596636 | 0.263973 | 0.034593 |
| 0.596636 | 0.314364 | 0.028504 |
| 0.596636 | 0.364662 | 0.022730 |
| 0.596636 | 0.414960 | 0.017585 |
| 0.596636 | 0.465166 | 0.013386 |
| 0.596636 | 0.515556 | 0.010341 |
| 0.596636 | 0.565947 | 0.008819 |
| 0.596636 | 0.616615 | 0.008871 |
| 0.596636 | 0.667376 | 0.010184 |
| 0.596636 | 0.718321 | 0.012388 |
| 0.596636 | 0.769451 | 0.015223 |
| 0.596636 | 0.820674 | 0.018215 |
| 0.596636 | 0.871989 | 0.021050 |
| 0.596636 | 0.923305 | 0.023202 |
| 0.596636 | 0.974435 | 0.024147 |
| 0.596636 | 1.025380 | 0.023360 |

TABLE 4-continued

| Inner Diameter Flowpath | | |
|---|---|---|
| X/Root_Bx | Y/Root_Pitch | Z/Span |
| 0.596636 | 1.075956 | 0.020367 |
| 0.596636 | 1.126069 | 0.015013 |
| 0.596636 | 1.175720 | 0.007927 |
| 0.596636 | 1.225094 | −0.000367 |
| 0.596636 | 1.274190 | −0.009291 |
| 0.596636 | 1.323194 | −0.018373 |
| 0.596636 | 1.372197 | −0.027087 |
| 0.596636 | 1.421201 | −0.035171 |
| 0.596636 | 1.470390 | −0.042362 |
| 0.596636 | 1.519948 | −0.048346 |
| 0.596636 | 1.569784 | −0.052808 |
| 0.596636 | 1.620175 | −0.055801 |
| 0.596636 | 1.670843 | −0.057480 |
| 0.596636 | 1.721973 | −0.058320 |
| 0.596636 | 1.773288 | −0.058583 |
| 0.596636 | 1.824788 | −0.058583 |
| 0.596636 | 1.876381 | −0.058793 |
| 0.596636 | 1.927789 | −0.059738 |
| 0.596636 | 1.978827 | −0.061837 |
| 0.596636 | 2.029402 | −0.065617 |
| 0.596636 | 2.079146 | −0.071654 |
| 0.596636 | 2.127964 | −0.079895 |
| 0.596636 | 2.176044 | −0.089921 |
| 0.596636 | 2.223568 | −0.101102 |
| 0.596636 | 2.270815 | −0.112913 |
| 0.596636 | 2.317877 | −0.124777 |
| 0.596636 | 2.364939 | −0.136378 |
| 0.596636 | 2.412279 | −0.147349 |
| 0.596636 | 2.459896 | −0.157375 |
| 0.639902 | −1.583468 | −0.063465 |
| 0.639902 | −1.533170 | −0.060630 |
| 0.639902 | −1.483334 | −0.056010 |
| 0.639902 | −1.434053 | −0.049659 |
| 0.639902 | −1.385049 | −0.041732 |
| 0.639902 | −1.336323 | −0.032756 |
| 0.639902 | −1.287597 | −0.023045 |
| 0.639902 | −1.238963 | −0.012966 |
| 0.639902 | −1.190051 | −0.003045 |
| 0.639902 | −1.140955 | 0.006142 |
| 0.639902 | −1.091397 | 0.013911 |
| 0.639902 | −1.041376 | 0.019685 |
| 0.639902 | −0.990893 | 0.022782 |
| 0.639902 | −0.939855 | 0.023150 |
| 0.639902 | −0.888447 | 0.021417 |
| 0.639902 | −0.837039 | 0.018268 |
| 0.639902 | −0.785539 | 0.014436 |
| 0.639902 | −0.734132 | 0.010499 |
| 0.639902 | −0.683001 | 0.007034 |
| 0.639902 | −0.631963 | 0.004409 |
| 0.639902 | −0.581203 | 0.002835 |
| 0.639902 | −0.530627 | 0.002677 |
| 0.639902 | −0.480237 | 0.004304 |
| 0.639902 | −0.430031 | 0.007717 |
| 0.639902 | −0.379825 | 0.012651 |
| 0.639902 | −0.329712 | 0.018688 |
| 0.639902 | −0.279506 | 0.025512 |
| 0.639902 | −0.229208 | 0.032598 |
| 0.639902 | −0.178817 | 0.039580 |
| 0.639902 | −0.128242 | 0.045774 |
| 0.639902 | −0.077574 | 0.050604 |
| 0.639902 | −0.026813 | 0.053333 |
| 0.639902 | 0.024040 | 0.053438 |
| 0.639902 | 0.074893 | 0.050814 |
| 0.639902 | 0.125653 | 0.046037 |
| 0.639902 | 0.176229 | 0.039843 |
| 0.639902 | 0.226712 | 0.032913 |
| 0.639902 | 0.277102 | 0.025984 |
| 0.639902 | 0.327400 | 0.019528 |
| 0.639902 | 0.377606 | 0.013858 |
| 0.639902 | 0.427812 | 0.009291 |
| 0.639902 | 0.478110 | 0.006142 |
| 0.639902 | 0.528501 | 0.004724 |
| 0.639902 | 0.579076 | 0.005197 |
| 0.639902 | 0.629837 | 0.007087 |
| 0.639902 | 0.680875 | 0.010131 |

TABLE 4-continued

| Inner Diameter Flowpath | | |
|---|---|---|
| X/Root_Bx | Y/Root_Pitch | Z/Span |
| 0.639902 | 0.732005 | 0.013911 |
| 0.639902 | 0.783320 | 0.018005 |
| 0.639902 | 0.834728 | 0.021995 |
| 0.639902 | 0.886228 | 0.025144 |
| 0.639902 | 0.937451 | 0.026877 |
| 0.639902 | 0.988489 | 0.026614 |
| 0.639902 | 1.039064 | 0.023727 |
| 0.639902 | 1.089085 | 0.018058 |
| 0.639902 | 1.138736 | 0.010289 |
| 0.639902 | 1.187925 | 0.001155 |
| 0.639902 | 1.236836 | −0.008714 |
| 0.639902 | 1.285655 | −0.018635 |
| 0.639902 | 1.334474 | −0.028031 |
| 0.639902 | 1.383385 | −0.036640 |
| 0.639902 | 1.432481 | −0.044199 |
| 0.639902 | 1.481947 | −0.050289 |
| 0.639902 | 1.531783 | −0.054646 |
| 0.639902 | 1.582174 | −0.057218 |
| 0.639902 | 1.633027 | −0.058320 |
| 0.639902 | 1.684249 | −0.058320 |
| 0.639902 | 1.735842 | −0.057638 |
| 0.639902 | 1.787712 | −0.056588 |
| 0.639902 | 1.839582 | −0.055696 |
| 0.639902 | 1.891267 | −0.055591 |
| 0.639902 | 1.942582 | −0.056903 |
| 0.639902 | 1.993250 | −0.060210 |
| 0.639902 | 2.043086 | −0.066089 |
| 0.639902 | 2.091813 | −0.074698 |
| 0.639902 | 2.139707 | −0.085354 |
| 0.639902 | 2.186954 | −0.097375 |
| 0.639902 | 2.233739 | −0.110079 |
| 0.639902 | 2.280523 | −0.122835 |
| 0.639902 | 2.327308 | −0.135066 |
| 0.639902 | 2.374370 | −0.146562 |
| 0.639902 | 2.421802 | −0.156955 |
| 0.683168 | −1.625353 | −0.072598 |
| 0.683168 | −1.575054 | −0.069816 |
| 0.683168 | −1.525311 | −0.065092 |
| 0.683168 | −1.476215 | −0.058320 |
| 0.683168 | −1.427396 | −0.049869 |
| 0.683168 | −1.378947 | −0.040105 |
| 0.683168 | −1.330590 | −0.029449 |
| 0.683168 | −1.282234 | −0.018320 |
| 0.683168 | −1.233692 | −0.007297 |
| 0.683168 | −1.184874 | 0.002835 |
| 0.683168 | −1.135500 | 0.011444 |
| 0.683168 | −1.085664 | 0.017743 |
| 0.683168 | −1.035089 | 0.020997 |
| 0.683168 | −0.984051 | 0.021050 |
| 0.683168 | −0.932551 | 0.018688 |
| 0.683168 | −0.880865 | 0.014698 |
| 0.683168 | −0.829180 | 0.009921 |
| 0.683168 | −0.777680 | 0.005249 |
| 0.683168 | −0.726365 | 0.001155 |
| 0.683168 | −0.675327 | −0.001942 |
| 0.683168 | −0.624567 | −0.003780 |
| 0.683168 | −0.573991 | −0.003990 |
| 0.683168 | −0.523693 | −0.002257 |
| 0.683168 | −0.473487 | 0.001575 |
| 0.683168 | −0.423466 | 0.007139 |
| 0.683168 | −0.373446 | 0.013963 |
| 0.683168 | −0.323425 | 0.021680 |
| 0.683168 | −0.273311 | 0.029869 |
| 0.683168 | −0.223013 | 0.037900 |
| 0.683168 | −0.172530 | 0.045144 |
| 0.683168 | −0.121862 | 0.050761 |
| 0.683168 | −0.071102 | 0.054068 |
| 0.683168 | −0.020249 | 0.054278 |
| 0.683168 | 0.030604 | 0.051339 |
| 0.683168 | 0.081365 | 0.045879 |
| 0.683168 | 0.131940 | 0.038845 |
| 0.683168 | 0.182516 | 0.031076 |
| 0.683168 | 0.232814 | 0.023360 |
| 0.683168 | 0.283112 | 0.016273 |
| 0.683168 | 0.333318 | 0.010131 |

TABLE 4-continued

| Inner Diameter Flowpath | | |
|---|---|---|
| X/Root_Bx | Y/Root_Pitch | Z/Span |
| 0.683168 | 0.383524 | 0.005302 |
| 0.683168 | 0.433729 | 0.002100 |
| 0.683168 | 0.484120 | 0.000840 |
| 0.683168 | 0.534696 | 0.001680 |
| 0.683168 | 0.585456 | 0.004199 |
| 0.683168 | 0.636401 | 0.008031 |
| 0.683168 | 0.687624 | 0.012703 |
| 0.683168 | 0.739032 | 0.017900 |
| 0.683168 | 0.790532 | 0.022940 |
| 0.683168 | 0.842032 | 0.027087 |
| 0.683168 | 0.893440 | 0.029711 |
| 0.683168 | 0.944478 | 0.029974 |
| 0.683168 | 0.995146 | 0.027192 |
| 0.683168 | 1.045167 | 0.021207 |
| 0.683168 | 1.094633 | 0.012808 |
| 0.683168 | 1.143729 | 0.002782 |
| 0.683168 | 1.192548 | −0.007927 |
| 0.683168 | 1.241182 | −0.018635 |
| 0.683168 | 1.289816 | −0.028661 |
| 0.683168 | 1.338634 | −0.037743 |
| 0.683168 | 1.387731 | −0.045512 |
| 0.683168 | 1.437012 | −0.051654 |
| 0.683168 | 1.486940 | −0.055906 |
| 0.683168 | 1.537331 | −0.058110 |
| 0.683168 | 1.588276 | −0.058583 |
| 0.683168 | 1.639684 | −0.057795 |
| 0.683168 | 1.691554 | −0.056168 |
| 0.683168 | 1.743516 | −0.054068 |
| 0.683168 | 1.795664 | −0.052126 |
| 0.683168 | 1.847719 | −0.051024 |
| 0.683168 | 1.899311 | −0.051496 |
| 0.683168 | 1.950164 | −0.054278 |
| 0.683168 | 2.000000 | −0.060052 |
| 0.683168 | 2.048634 | −0.068976 |
| 0.683168 | 2.096343 | −0.080262 |
| 0.683168 | 2.143313 | −0.093123 |
| 0.683168 | 2.189820 | −0.106667 |
| 0.683168 | 2.236235 | −0.120210 |
| 0.683168 | 2.282835 | −0.133071 |
| 0.683168 | 2.329712 | −0.144987 |
| 0.683168 | 2.377051 | −0.155643 |
| 0.726435 | −1.673801 | −0.082415 |
| 0.726435 | −1.623503 | −0.079633 |
| 0.726435 | −1.573852 | −0.074751 |
| 0.726435 | −1.524849 | −0.067612 |
| 0.726435 | −1.476400 | −0.058635 |
| 0.726435 | −1.428228 | −0.048136 |
| 0.726435 | −1.380149 | −0.036640 |
| 0.726435 | −1.332070 | −0.024567 |
| 0.726435 | −1.283898 | −0.012493 |
| 0.726435 | −1.235357 | −0.001365 |
| 0.726435 | −1.186260 | 0.008084 |
| 0.726435 | −1.136517 | 0.014908 |
| 0.726435 | −1.086034 | 0.018320 |
| 0.726435 | −1.034811 | 0.018058 |
| 0.726435 | −0.983219 | 0.015066 |
| 0.726435 | −0.931349 | 0.010289 |
| 0.726435 | −0.879479 | 0.004724 |
| 0.726435 | −0.827793 | −0.000682 |
| 0.726435 | −0.776386 | −0.005249 |
| 0.726435 | −0.725255 | −0.008661 |
| 0.726435 | −0.674495 | −0.010656 |
| 0.726435 | −0.623919 | −0.010866 |
| 0.726435 | −0.573714 | −0.008976 |
| 0.726435 | −0.523693 | −0.004777 |
| 0.726435 | −0.473765 | 0.001312 |
| 0.726435 | −0.423929 | 0.008871 |
| 0.726435 | −0.374000 | 0.017428 |
| 0.726435 | −0.324072 | 0.026614 |
| 0.726435 | −0.273866 | 0.035748 |
| 0.726435 | −0.223568 | 0.043937 |
| 0.726435 | −0.172992 | 0.050394 |
| 0.726435 | −0.122324 | 0.054226 |
| 0.726435 | −0.071471 | 0.054646 |
| 0.726435 | −0.020526 | 0.051339 |

TABLE 4-continued

| Inner Diameter Flowpath | | |
|---|---|---|
| X/Root_Bx | Y/Root_Pitch | Z/Span |
| 0.726435 | 0.030234 | 0.045302 |
| 0.726435 | 0.080995 | 0.037480 |
| 0.726435 | 0.131478 | 0.028871 |
| 0.726435 | 0.181869 | 0.020420 |
| 0.726435 | 0.232167 | 0.012861 |
| 0.726435 | 0.282373 | 0.006404 |
| 0.726435 | 0.332578 | 0.001417 |
| 0.726435 | 0.382784 | −0.001785 |
| 0.726435 | 0.433082 | −0.002887 |
| 0.726435 | 0.483658 | −0.001680 |
| 0.726435 | 0.534326 | 0.001417 |
| 0.726435 | 0.585364 | 0.005932 |
| 0.726435 | 0.636494 | 0.011549 |
| 0.726435 | 0.687902 | 0.017690 |
| 0.726435 | 0.739494 | 0.023780 |
| 0.726435 | 0.791087 | 0.028976 |
| 0.726435 | 0.842495 | 0.032388 |
| 0.726435 | 0.893717 | 0.033176 |
| 0.726435 | 0.944293 | 0.030551 |
| 0.726435 | 0.994314 | 0.024252 |
| 0.726435 | 1.043780 | 0.015223 |
| 0.726435 | 1.092691 | 0.004462 |
| 0.726435 | 1.141417 | −0.007139 |
| 0.726435 | 1.189959 | −0.018478 |
| 0.726435 | 1.238593 | −0.029029 |
| 0.726435 | 1.287319 | −0.038425 |
| 0.726435 | 1.336323 | −0.046352 |
| 0.726435 | 1.385604 | −0.052493 |
| 0.726435 | 1.435532 | −0.056588 |
| 0.726435 | 1.485923 | −0.058425 |
| 0.726435 | 1.536961 | −0.058320 |
| 0.726435 | 1.588553 | −0.056850 |
| 0.726435 | 1.640516 | −0.054331 |
| 0.726435 | 1.692756 | −0.051286 |
| 0.726435 | 1.745088 | −0.048241 |
| 0.726435 | 1.797328 | −0.046194 |
| 0.726435 | 1.849198 | −0.045827 |
| 0.726435 | 1.900236 | −0.048031 |
| 0.726435 | 1.950072 | −0.053701 |
| 0.726435 | 1.998613 | −0.062887 |
| 0.726435 | 2.046137 | −0.074803 |
| 0.726435 | 2.092830 | −0.088451 |
| 0.726435 | 2.139152 | −0.102835 |
| 0.726435 | 2.185382 | −0.117008 |
| 0.726435 | 2.231704 | −0.130394 |
| 0.726435 | 2.278489 | −0.142625 |
| 0.726435 | 2.325736 | −0.153386 |
| 0.769701 | −1.727983 | −0.092808 |
| 0.769701 | −1.677777 | −0.089921 |
| 0.769701 | −1.628219 | −0.084934 |
| 0.769701 | −1.579400 | −0.077480 |
| 0.769701 | −1.531136 | −0.067979 |
| 0.769701 | −1.483149 | −0.056903 |
| 0.769701 | −1.435440 | −0.044672 |
| 0.769701 | −1.387823 | −0.031706 |
| 0.769701 | −1.339929 | −0.018688 |
| 0.769701 | −1.291665 | −0.006614 |
| 0.769701 | −1.242846 | 0.003622 |
| 0.769701 | −1.193287 | 0.010971 |
| 0.769701 | −1.142804 | 0.014541 |
| 0.769701 | −1.091489 | 0.014016 |
| 0.769701 | −1.039712 | 0.010446 |
| 0.769701 | −0.987657 | 0.004934 |
| 0.769701 | −0.935602 | −0.001312 |
| 0.769701 | −0.883732 | −0.007297 |
| 0.769701 | −0.832232 | −0.012231 |
| 0.769701 | −0.781101 | −0.015801 |
| 0.769701 | −0.730341 | −0.017795 |
| 0.769701 | −0.679765 | −0.017900 |
| 0.769701 | −0.629652 | −0.015853 |
| 0.769701 | −0.579724 | −0.011339 |
| 0.769701 | −0.529980 | −0.004777 |
| 0.769701 | −0.480237 | 0.003412 |
| 0.769701 | −0.430493 | 0.012756 |
| 0.769701 | −0.380750 | 0.022835 |

TABLE 4-continued

| Inner Diameter Flowpath | | |
|---|---|---|
| X/Root_Bx | Y/Root_Pitch | Z/Span |
| 0.769701 | −0.330729 | 0.032913 |
| 0.769701 | −0.280523 | 0.042100 |
| 0.769701 | −0.230133 | 0.049344 |
| 0.769701 | −0.179465 | 0.053701 |
| 0.769701 | −0.128612 | 0.054278 |
| 0.769701 | −0.077666 | 0.050709 |
| 0.769701 | −0.026813 | 0.044042 |
| 0.769701 | 0.023947 | 0.035538 |
| 0.769701 | 0.074615 | 0.026194 |
| 0.769701 | 0.125006 | 0.017165 |
| 0.769701 | 0.175304 | 0.009239 |
| 0.769701 | 0.225510 | 0.002625 |
| 0.769701 | 0.275715 | −0.002362 |
| 0.769701 | 0.325921 | −0.005459 |
| 0.769701 | 0.376219 | −0.006404 |
| 0.769701 | 0.426702 | −0.004882 |
| 0.769701 | 0.477370 | −0.001312 |
| 0.769701 | 0.528316 | 0.003885 |
| 0.769701 | 0.579446 | 0.010184 |
| 0.769701 | 0.630854 | 0.017270 |
| 0.769701 | 0.682446 | 0.024357 |
| 0.769701 | 0.734039 | 0.030499 |
| 0.769701 | 0.785539 | 0.034698 |
| 0.769701 | 0.836762 | 0.036063 |
| 0.769701 | 0.887430 | 0.033596 |
| 0.769701 | 0.937358 | 0.027034 |
| 0.769701 | 0.986824 | 0.017375 |
| 0.769701 | 1.035736 | 0.005879 |
| 0.769701 | 1.084277 | −0.006404 |
| 0.769701 | 1.132819 | −0.018373 |
| 0.769701 | 1.181360 | −0.029239 |
| 0.769701 | 1.230086 | −0.038793 |
| 0.769701 | 1.279090 | −0.046719 |
| 0.769701 | 1.328464 | −0.052808 |
| 0.769701 | 1.378300 | −0.056693 |
| 0.769701 | 1.428783 | −0.058215 |
| 0.769701 | 1.479821 | −0.057690 |
| 0.769701 | 1.531413 | −0.055538 |
| 0.769701 | 1.583468 | −0.052231 |
| 0.769701 | 1.635893 | −0.048294 |
| 0.769701 | 1.688503 | −0.044304 |
| 0.769701 | 1.740927 | −0.041260 |
| 0.769701 | 1.792890 | −0.040105 |
| 0.769701 | 1.844113 | −0.041837 |
| 0.769701 | 1.894041 | −0.047297 |
| 0.769701 | 1.942490 | −0.056798 |
| 0.769701 | 1.989922 | −0.069291 |
| 0.769701 | 2.036429 | −0.083622 |
| 0.769701 | 2.082474 | −0.098740 |
| 0.769701 | 2.128519 | −0.113491 |
| 0.769701 | 2.174842 | −0.127192 |
| 0.769701 | 2.221534 | −0.139580 |
| 0.769701 | 2.268781 | −0.150394 |
| 0.812968 | −1.788544 | −0.103937 |
| 0.812968 | −1.738431 | −0.100892 |
| 0.812968 | −1.688965 | −0.095643 |
| 0.812968 | −1.640331 | −0.087979 |
| 0.812968 | −1.592252 | −0.078110 |
| 0.812968 | −1.544635 | −0.066509 |
| 0.812968 | −1.497203 | −0.053648 |
| 0.812968 | −1.449864 | −0.039895 |
| 0.812968 | −1.402339 | −0.026037 |
| 0.812968 | −1.354445 | −0.013071 |
| 0.812968 | −1.305904 | −0.002152 |
| 0.812968 | −1.256530 | 0.005774 |
| 0.812968 | −1.206047 | 0.009501 |
| 0.812968 | −1.154639 | 0.008714 |
| 0.812968 | −1.102677 | 0.004672 |
| 0.812968 | −1.050437 | −0.001470 |
| 0.812968 | −0.998197 | −0.008346 |
| 0.812968 | −0.946235 | −0.014698 |
| 0.812968 | −0.894642 | −0.019790 |
| 0.812968 | −0.843419 | −0.023412 |
| 0.812968 | −0.792659 | −0.025249 |
| 0.812968 | −0.742176 | −0.025197 |

TABLE 4-continued

| Inner Diameter Flowpath | | |
|---|---|---|
| X/Root_Bx | Y/Root_Pitch | Z/Span |
| 0.812968 | −0.692062 | −0.022940 |
| 0.812968 | −0.642226 | −0.018163 |
| 0.812968 | −0.592575 | −0.011181 |
| 0.812968 | −0.543109 | −0.002520 |
| 0.812968 | −0.493551 | 0.007507 |
| 0.812968 | −0.443992 | 0.018373 |
| 0.812968 | −0.394157 | 0.029344 |
| 0.812968 | −0.344136 | 0.039370 |
| 0.812968 | −0.293838 | 0.047349 |
| 0.812968 | −0.243262 | 0.052283 |
| 0.812968 | −0.192409 | 0.052966 |
| 0.812968 | −0.141464 | 0.049186 |
| 0.812968 | −0.090518 | 0.042047 |
| 0.812968 | −0.039573 | 0.032861 |
| 0.812968 | 0.011095 | 0.022887 |
| 0.812968 | 0.061578 | 0.013491 |
| 0.812968 | 0.111969 | 0.005354 |
| 0.812968 | 0.162175 | −0.001260 |
| 0.812968 | 0.212380 | −0.006089 |
| 0.812968 | 0.262586 | −0.009029 |
| 0.812968 | 0.312792 | −0.009764 |
| 0.812968 | 0.363275 | −0.007979 |
| 0.812968 | 0.413850 | −0.003990 |
| 0.812968 | 0.464703 | 0.001732 |
| 0.812968 | 0.515834 | 0.008714 |
| 0.812968 | 0.567149 | 0.016588 |
| 0.812968 | 0.618649 | 0.024514 |
| 0.812968 | 0.670242 | 0.031549 |
| 0.812968 | 0.721742 | 0.036535 |
| 0.812968 | 0.772965 | 0.038373 |
| 0.812968 | 0.823725 | 0.036115 |
| 0.812968 | 0.873654 | 0.029291 |
| 0.812968 | 0.923027 | 0.019160 |
| 0.812968 | 0.971938 | 0.006982 |
| 0.812968 | 1.020572 | −0.005879 |
| 0.812968 | 1.069021 | −0.018268 |
| 0.812968 | 1.117655 | −0.029344 |
| 0.812968 | 1.166382 | −0.038898 |
| 0.812968 | 1.215385 | −0.046719 |
| 0.812968 | 1.264759 | −0.052598 |
| 0.812968 | 1.314595 | −0.056273 |
| 0.812968 | 1.365078 | −0.057480 |
| 0.812968 | 1.416208 | −0.056535 |
| 0.812968 | 1.467801 | −0.053911 |
| 0.812968 | 1.519948 | −0.049974 |
| 0.812968 | 1.572373 | −0.045197 |
| 0.812968 | 1.625075 | −0.040315 |
| 0.812968 | 1.677685 | −0.036430 |
| 0.812968 | 1.729832 | −0.034541 |
| 0.812968 | 1.781147 | −0.035696 |
| 0.812968 | 1.831076 | −0.040997 |
| 0.812968 | 1.879617 | −0.050761 |
| 0.812968 | 1.926864 | −0.063727 |
| 0.812968 | 1.973187 | −0.078740 |
| 0.812968 | 2.019139 | −0.094436 |
| 0.812968 | 2.065092 | −0.109606 |
| 0.812968 | 2.111414 | −0.123517 |
| 0.812968 | 2.158106 | −0.135906 |
| 0.812968 | 2.205446 | −0.146562 |
| 0.856234 | −1.856225 | −0.115906 |
| 0.856234 | −1.806204 | −0.112546 |
| 0.856234 | −1.756923 | −0.107139 |
| 0.856234 | −1.708381 | −0.099160 |
| 0.856234 | −1.660487 | −0.089029 |
| 0.856234 | −1.613148 | −0.077060 |
| 0.856234 | −1.565993 | −0.063727 |
| 0.856234 | −1.518931 | −0.049344 |
| 0.856234 | −1.471869 | −0.034698 |
| 0.856234 | −1.424252 | −0.020997 |
| 0.856234 | −1.375988 | −0.009396 |
| 0.856234 | −1.326800 | −0.001050 |
| 0.856234 | −1.276409 | 0.002887 |
| 0.856234 | −1.225001 | 0.001995 |
| 0.856234 | −1.172761 | −0.002520 |
| 0.856234 | −1.120244 | −0.009134 |

TABLE 4-continued

| Inner Diameter Flowpath | | |
|---|---|---|
| X/Root_Bx | Y/Root_Pitch | Z/Span |
| 0.856234 | −1.067819 | −0.016483 |
| 0.856234 | −1.015764 | −0.023097 |
| 0.856234 | −0.964079 | −0.028136 |
| 0.856234 | −0.912949 | −0.031549 |
| 0.856234 | −0.862096 | −0.033123 |
| 0.856234 | −0.811705 | −0.032756 |
| 0.856234 | −0.761685 | −0.030289 |
| 0.856234 | −0.711941 | −0.025249 |
| 0.856234 | −0.662475 | −0.018005 |
| 0.856234 | −0.613194 | −0.008924 |
| 0.856234 | −0.563820 | 0.001575 |
| 0.856234 | −0.514447 | 0.013071 |
| 0.856234 | −0.464888 | 0.024777 |
| 0.856234 | −0.415052 | 0.035591 |
| 0.856234 | −0.364939 | 0.044304 |
| 0.856234 | −0.314456 | 0.049711 |
| 0.856234 | −0.263603 | 0.050604 |
| 0.856234 | −0.212565 | 0.046614 |
| 0.856234 | −0.161527 | 0.039055 |
| 0.856234 | −0.110490 | 0.029344 |
| 0.856234 | −0.059729 | 0.018950 |
| 0.856234 | −0.009154 | 0.009291 |
| 0.856234 | 0.041330 | 0.001207 |
| 0.856234 | 0.091535 | −0.005197 |
| 0.856234 | 0.141833 | −0.009816 |
| 0.856234 | 0.191947 | −0.012441 |
| 0.856234 | 0.242245 | −0.012966 |
| 0.856234 | 0.292543 | −0.010919 |
| 0.856234 | 0.343119 | −0.006614 |
| 0.856234 | 0.393879 | −0.000525 |
| 0.856234 | 0.444825 | 0.006982 |
| 0.856234 | 0.496047 | 0.015486 |
| 0.856234 | 0.547548 | 0.024252 |
| 0.856234 | 0.599048 | 0.032021 |
| 0.856234 | 0.650548 | 0.037690 |
| 0.856234 | 0.701771 | 0.040052 |
| 0.856234 | 0.752439 | 0.037953 |
| 0.856234 | 0.802459 | 0.030971 |
| 0.856234 | 0.851833 | 0.020420 |
| 0.856234 | 0.900744 | 0.007717 |
| 0.856234 | 0.949378 | −0.005617 |
| 0.856234 | 0.997920 | −0.018215 |
| 0.856234 | 1.046554 | −0.029291 |
| 0.856234 | 1.095372 | −0.038635 |
| 0.856234 | 1.144469 | −0.046194 |
| 0.856234 | 1.193935 | −0.051811 |
| 0.856234 | 1.243771 | −0.055276 |
| 0.856234 | 1.294254 | −0.056220 |
| 0.856234 | 1.345291 | −0.054961 |
| 0.856234 | 1.396884 | −0.051916 |
| 0.856234 | 1.449031 | −0.047454 |
| 0.856234 | 1.501549 | −0.042047 |
| 0.856234 | 1.554343 | −0.036430 |
| 0.856234 | 1.606953 | −0.031706 |
| 0.856234 | 1.659193 | −0.029134 |
| 0.856234 | 1.710601 | −0.029816 |
| 0.856234 | 1.760621 | −0.034908 |
| 0.856234 | 1.809070 | −0.044829 |
| 0.856234 | 1.856225 | −0.058268 |
| 0.856234 | 1.902547 | −0.073806 |
| 0.856234 | 1.948500 | −0.089921 |
| 0.856234 | 1.994452 | −0.105354 |
| 0.856234 | 2.040775 | −0.119265 |
| 0.856234 | 2.087560 | −0.131444 |
| 0.856234 | 2.134991 | −0.141890 |
| 0.899501 | −1.930285 | −0.128661 |
| 0.899501 | −1.880357 | −0.124934 |
| 0.899501 | −1.831168 | −0.119265 |
| 0.899501 | −1.782719 | −0.111129 |
| 0.899501 | −1.735102 | −0.100787 |
| 0.899501 | −1.687855 | −0.088609 |
| 0.899501 | −1.640978 | −0.074856 |
| 0.899501 | −1.594286 | −0.060000 |
| 0.899501 | −1.547594 | −0.044829 |
| 0.899501 | −1.500347 | −0.030499 |

TABLE 4-continued

| Inner Diameter Flowpath | | |
|---|---|---|
| X/Root_Bx | Y/Root_Pitch | Z/Span |
| 0.899501 | −1.452360 | −0.018268 |
| 0.899501 | −1.403356 | −0.009449 |
| 0.899501 | −1.353058 | −0.005302 |
| 0.899501 | −1.301465 | −0.006352 |
| 0.899501 | −1.249133 | −0.011129 |
| 0.899501 | −1.196431 | −0.018163 |
| 0.899501 | −1.143821 | −0.025774 |
| 0.899501 | −1.091582 | −0.032388 |
| 0.899501 | −1.039989 | −0.037270 |
| 0.899501 | −0.988766 | −0.040262 |
| 0.899501 | −0.938006 | −0.041417 |
| 0.899501 | −0.887707 | −0.040682 |
| 0.899501 | −0.837779 | −0.037953 |
| 0.899501 | −0.788128 | −0.032703 |
| 0.899501 | −0.738647 | −0.025302 |
| 0.899501 | −0.689658 | −0.015958 |
| 0.899501 | −0.640470 | −0.005092 |
| 0.899501 | −0.591373 | 0.006929 |
| 0.899501 | −0.542000 | 0.019265 |
| 0.899501 | −0.492441 | 0.030709 |
| 0.899501 | −0.442421 | 0.040000 |
| 0.899501 | −0.392122 | 0.045879 |
| 0.899501 | −0.341269 | 0.047034 |
| 0.899501 | −0.290232 | 0.042940 |
| 0.899501 | −0.239009 | 0.035013 |
| 0.899501 | −0.187971 | 0.024934 |
| 0.899501 | −0.137026 | 0.014226 |
| 0.899501 | −0.086265 | 0.004567 |
| 0.899501 | −0.035782 | −0.003360 |
| 0.899501 | 0.014516 | −0.009396 |
| 0.899501 | 0.064814 | −0.013543 |
| 0.899501 | 0.114928 | −0.015801 |
| 0.899501 | 0.165133 | −0.016010 |
| 0.899501 | 0.215432 | −0.013806 |
| 0.899501 | 0.265915 | −0.009344 |
| 0.899501 | 0.316490 | −0.002940 |
| 0.899501 | 0.367343 | 0.004934 |
| 0.899501 | 0.418473 | 0.013963 |
| 0.899501 | 0.469789 | 0.023307 |
| 0.899501 | 0.521196 | 0.031759 |
| 0.899501 | 0.572604 | 0.038005 |
| 0.899501 | 0.623827 | 0.040892 |
| 0.899501 | 0.674495 | 0.039003 |
| 0.899501 | 0.724608 | 0.031864 |
| 0.899501 | 0.773982 | 0.020997 |
| 0.899501 | 0.822986 | 0.007927 |
| 0.899501 | 0.871712 | −0.005722 |
| 0.899501 | 0.920346 | −0.018373 |
| 0.899501 | 0.969072 | −0.029239 |
| 0.899501 | 1.017983 | −0.038215 |
| 0.899501 | 1.067265 | −0.045302 |
| 0.899501 | 1.116731 | −0.050551 |
| 0.899501 | 1.166567 | −0.053753 |
| 0.899501 | 1.217050 | −0.054541 |
| 0.899501 | 1.267995 | −0.053071 |
| 0.899501 | 1.319588 | −0.049764 |
| 0.899501 | 1.371550 | −0.044934 |
| 0.899501 | 1.424067 | −0.039003 |
| 0.899501 | 1.476769 | −0.032703 |
| 0.899501 | 1.529564 | −0.027402 |
| 0.899501 | 1.581804 | −0.024199 |
| 0.899501 | 1.633212 | −0.024409 |
| 0.899501 | 1.683325 | −0.029291 |
| 0.899501 | 1.731774 | −0.039318 |
| 0.899501 | 1.778928 | −0.053071 |
| 0.899501 | 1.825251 | −0.068976 |
| 0.899501 | 1.871111 | −0.085459 |
| 0.899501 | 1.917156 | −0.100892 |
| 0.899501 | 1.963663 | −0.114593 |
| 0.899501 | 2.010725 | −0.126457 |
| 0.899501 | 2.058342 | −0.136430 |
| 0.942767 | −2.009338 | −0.142100 |
| 0.942767 | −1.959595 | −0.137900 |
| 0.942767 | −1.910591 | −0.131969 |
| 0.942767 | −1.862327 | −0.123727 |

TABLE 4-continued

| Inner Diameter Flowpath | | |
|---|---|---|
| X/Root_Bx | Y/Root_Pitch | Z/Span |
| 0.942767 | −1.814803 | −0.113281 |
| 0.942767 | −1.767741 | −0.100997 |
| 0.942767 | −1.721141 | −0.087139 |
| 0.942767 | −1.674726 | −0.071969 |
| 0.942767 | −1.628311 | −0.056273 |
| 0.942767 | −1.581434 | −0.041470 |
| 0.942767 | −1.533725 | −0.028766 |
| 0.942767 | −1.484906 | −0.019528 |
| 0.942767 | −1.434700 | −0.015171 |
| 0.942767 | −1.383108 | −0.016220 |
| 0.942767 | −1.330590 | −0.021260 |
| 0.942767 | −1.277703 | −0.028504 |
| 0.942767 | −1.224909 | −0.036168 |
| 0.942767 | −1.172669 | −0.042677 |
| 0.942767 | −1.120984 | −0.047087 |
| 0.942767 | −1.069853 | −0.049501 |
| 0.942767 | −1.019185 | −0.050079 |
| 0.942767 | −0.968980 | −0.048871 |
| 0.942767 | −0.919051 | −0.045879 |
| 0.942767 | −0.869585 | −0.040525 |
| 0.942767 | −0.820397 | −0.033018 |
| 0.942767 | −0.771393 | −0.023570 |
| 0.942767 | −0.722389 | −0.012493 |
| 0.942767 | −0.673478 | −0.000210 |
| 0.942767 | −0.624474 | 0.012651 |
| 0.942767 | −0.575101 | 0.024619 |
| 0.942767 | −0.525265 | 0.034436 |
| 0.942767 | −0.475059 | 0.040682 |
| 0.942767 | −0.424298 | 0.042047 |
| 0.942767 | −0.373168 | 0.037900 |
| 0.942767 | −0.321853 | 0.029816 |
| 0.942767 | −0.270630 | 0.019475 |
| 0.942767 | −0.219592 | 0.008714 |
| 0.942767 | −0.168739 | −0.000840 |
| 0.942767 | −0.118164 | −0.008346 |
| 0.942767 | −0.067866 | −0.013806 |
| 0.942767 | −0.017567 | −0.017323 |
| 0.942767 | 0.032638 | −0.019108 |
| 0.942767 | 0.082752 | −0.019108 |
| 0.942767 | 0.133050 | −0.016745 |
| 0.942767 | 0.183348 | −0.012126 |
| 0.942767 | 0.233831 | −0.005669 |
| 0.942767 | 0.284499 | 0.002415 |
| 0.942767 | 0.335445 | 0.011759 |
| 0.942767 | 0.386575 | 0.021575 |
| 0.942767 | 0.437890 | 0.030604 |
| 0.942767 | 0.489205 | 0.037375 |
| 0.942767 | 0.540336 | 0.040630 |
| 0.942767 | 0.591004 | 0.039003 |
| 0.942767 | 0.641117 | 0.031811 |
| 0.942767 | 0.690675 | 0.020735 |
| 0.942767 | 0.739772 | 0.007402 |
| 0.942767 | 0.788498 | −0.006352 |
| 0.942767 | 0.837317 | −0.018845 |
| 0.942767 | 0.886228 | −0.029291 |
| 0.942767 | 0.935324 | −0.037690 |
| 0.942767 | 0.984605 | −0.044252 |
| 0.942767 | 1.034256 | −0.048976 |
| 0.942767 | 1.084092 | −0.051916 |
| 0.942767 | 1.134483 | −0.052546 |
| 0.942767 | 1.185428 | −0.050971 |
| 0.942767 | 1.236836 | −0.047559 |
| 0.942767 | 1.288706 | −0.042520 |
| 0.942767 | 1.341131 | −0.036220 |
| 0.942767 | 1.393740 | −0.029501 |
| 0.942767 | 1.446443 | −0.023570 |
| 0.942767 | 1.498682 | −0.019895 |
| 0.942767 | 1.550183 | −0.019685 |
| 0.942767 | 1.600296 | −0.024304 |
| 0.942767 | 1.648745 | −0.034383 |
| 0.942767 | 1.695992 | −0.048399 |
| 0.942767 | 1.742314 | −0.064514 |
| 0.942767 | 1.788359 | −0.081102 |
| 0.942767 | 1.834589 | −0.096483 |
| 0.942767 | 1.881281 | −0.109711 |

TABLE 4-continued

| Inner Diameter Flowpath | | |
|---|---|---|
| X/Root_Bx | Y/Root_Pitch | Z/Span |
| 0.942767 | 1.928529 | −0.120997 |
| 0.942767 | 1.976423 | −0.130446 |
| 0.986034 | −2.091350 | −0.155433 |
| 0.986034 | −2.041977 | −0.150184 |
| 0.986034 | −1.993066 | −0.143990 |
| 0.986034 | −1.944709 | −0.136168 |
| 0.986034 | −1.896907 | −0.126614 |
| 0.986034 | −1.849660 | −0.115381 |
| 0.986034 | −1.802968 | −0.102362 |
| 0.986034 | −1.756646 | −0.087612 |
| 0.986034 | −1.710508 | −0.071864 |
| 0.986034 | −1.664001 | −0.056588 |
| 0.986034 | −1.616661 | −0.043360 |
| 0.986034 | −1.568120 | −0.033596 |
| 0.986034 | −1.518007 | −0.029029 |
| 0.986034 | −1.466321 | −0.030236 |
| 0.986034 | −1.413712 | −0.035486 |
| 0.986034 | −1.360640 | −0.042887 |
| 0.986034 | −1.307845 | −0.050289 |
| 0.986034 | −1.255698 | −0.055906 |
| 0.986034 | −1.204290 | −0.058845 |
| 0.986034 | −1.153530 | −0.059528 |
| 0.986034 | −1.103231 | −0.058530 |
| 0.986034 | −1.053211 | −0.056220 |
| 0.986034 | −1.003375 | −0.052913 |
| 0.986034 | −0.953816 | −0.048031 |
| 0.986034 | −0.904535 | −0.041365 |
| 0.986034 | −0.855531 | −0.032966 |
| 0.986034 | −0.806620 | −0.022782 |
| 0.986034 | −0.757894 | −0.010866 |
| 0.986034 | −0.709075 | 0.002047 |
| 0.986034 | −0.659979 | 0.014436 |
| 0.986034 | −0.610420 | 0.024829 |
| 0.986034 | −0.560399 | 0.031601 |
| 0.986034 | −0.509731 | 0.033228 |
| 0.986034 | −0.458601 | 0.028924 |
| 0.986034 | −0.407193 | 0.020577 |
| 0.986034 | −0.355786 | 0.010079 |
| 0.986034 | −0.304655 | −0.000420 |
| 0.986034 | −0.253802 | −0.009081 |
| 0.986034 | −0.203227 | −0.015066 |
| 0.986034 | −0.152836 | −0.018793 |
| 0.986034 | −0.102630 | −0.020735 |
| 0.986034 | −0.052425 | −0.021417 |
| 0.986034 | −0.002311 | −0.021102 |
| 0.986034 | 0.047894 | −0.019160 |
| 0.986034 | 0.098100 | −0.015486 |
| 0.986034 | 0.148398 | −0.010026 |
| 0.986034 | 0.198881 | −0.002835 |
| 0.986034 | 0.249642 | 0.006142 |
| 0.986034 | 0.300495 | 0.016115 |
| 0.986034 | 0.351625 | 0.025512 |
| 0.986034 | 0.402755 | 0.032913 |
| 0.986034 | 0.453793 | 0.036693 |
| 0.986034 | 0.504461 | 0.035276 |
| 0.986034 | 0.554574 | 0.027979 |
| 0.986034 | 0.604133 | 0.016588 |
| 0.986034 | 0.653322 | 0.003150 |
| 0.986034 | 0.702233 | −0.010394 |
| 0.986034 | 0.751237 | −0.021995 |
| 0.986034 | 0.800425 | −0.030919 |
| 0.986034 | 0.849799 | −0.037638 |
| 0.986034 | 0.899450 | −0.042572 |
| 0.986034 | 0.949193 | −0.046194 |
| 0.986034 | 0.999122 | −0.048871 |
| 0.986034 | 1.049420 | −0.049921 |
| 0.986034 | 1.099995 | −0.049239 |
| 0.986034 | 1.151033 | −0.046824 |
| 0.986034 | 1.202626 | −0.042625 |
| 0.986034 | 1.254681 | −0.036745 |
| 0.986034 | 1.307106 | −0.029869 |
| 0.986034 | 1.359715 | −0.023517 |
| 0.986034 | 1.411955 | −0.019213 |
| 0.986034 | 1.463363 | −0.018478 |
| 0.986034 | 1.513476 | −0.022887 |

TABLE 4-continued

| Inner Diameter Flowpath | | |
|---|---|---|
| X/Root_Bx | Y/Root_Pitch | Z/Span |
| 0.986034 | 1.562017 | −0.033123 |
| 0.986034 | 1.609172 | −0.047349 |
| 0.986034 | 1.655587 | −0.063675 |
| 0.986034 | 1.701817 | −0.080000 |
| 0.986034 | 1.748417 | −0.094488 |
| 0.986034 | 1.795664 | −0.106299 |
| 0.986034 | 1.843558 | −0.115906 |
| 0.986034 | 1.892007 | −0.123727 |
| 1.029300 | −2.174379 | −0.167507 |
| 1.029300 | −2.125930 | −0.160210 |
| 1.029300 | −2.077112 | −0.153648 |
| 1.029300 | −2.028385 | −0.146772 |
| 1.029300 | −1.980029 | −0.139003 |
| 1.029300 | −1.932134 | −0.129816 |
| 1.029300 | −1.884795 | −0.118793 |
| 1.029300 | −1.838195 | −0.105512 |
| 1.029300 | −1.792058 | −0.090604 |
| 1.029300 | −1.745643 | −0.075696 |
| 1.029300 | −1.698581 | −0.062467 |
| 1.029300 | −1.650224 | −0.052493 |
| 1.029300 | −1.600296 | −0.047769 |
| 1.029300 | −1.548518 | −0.049291 |
| 1.029300 | −1.495724 | −0.055013 |
| 1.029300 | −1.442559 | −0.062415 |
| 1.029300 | −1.389857 | −0.069134 |
| 1.029300 | −1.338172 | −0.072756 |
| 1.029300 | −1.287597 | −0.072598 |
| 1.029300 | −1.237576 | −0.069816 |
| 1.029300 | −1.188017 | −0.065564 |
| 1.029300 | −1.138459 | −0.061207 |
| 1.029300 | −1.088715 | −0.057533 |
| 1.029300 | −1.038972 | −0.053596 |
| 1.029300 | −0.989413 | −0.048714 |
| 1.029300 | −0.940132 | −0.042415 |
| 1.029300 | −0.891036 | −0.034278 |
| 1.029300 | −0.842310 | −0.023885 |
| 1.029300 | −0.793583 | −0.011811 |
| 1.029300 | −0.744672 | 0.000262 |
| 1.029300 | −0.695391 | 0.010656 |
| 1.029300 | −0.645555 | 0.017690 |
| 1.029300 | −0.595072 | 0.019475 |
| 1.029300 | −0.543849 | 0.014856 |
| 1.029300 | −0.492349 | 0.006037 |
| 1.029300 | −0.440849 | −0.004514 |
| 1.029300 | −0.389718 | −0.014278 |
| 1.029300 | −0.338958 | −0.020945 |
| 1.029300 | −0.288567 | −0.023780 |
| 1.029300 | −0.238362 | −0.023990 |
| 1.029300 | −0.188248 | −0.022730 |
| 1.029300 | −0.138135 | −0.021312 |
| 1.029300 | −0.088022 | −0.020630 |
| 1.029300 | −0.037909 | −0.019685 |
| 1.029300 | 0.012297 | −0.017743 |
| 1.029300 | 0.062503 | −0.014436 |
| 1.029300 | 0.112801 | −0.009239 |
| 1.029300 | 0.163284 | −0.001785 |
| 1.029300 | 0.213860 | 0.007349 |
| 1.029300 | 0.264713 | 0.016430 |
| 1.029300 | 0.315658 | 0.023885 |
| 1.029300 | 0.366511 | 0.027874 |
| 1.029300 | 0.417087 | 0.026614 |
| 1.029300 | 0.467200 | 0.019055 |
| 1.029300 | 0.516758 | 0.007244 |
| 1.029300 | 0.566039 | −0.006299 |
| 1.029300 | 0.615043 | −0.019108 |
| 1.029300 | 0.664324 | −0.028714 |
| 1.029300 | 0.713975 | −0.034541 |
| 1.029300 | 0.763811 | −0.037743 |
| 1.029300 | 0.813832 | −0.039475 |
| 1.029300 | 0.863945 | −0.040997 |
| 1.029300 | 0.913966 | −0.043307 |
| 1.029300 | 0.963987 | −0.045354 |
| 1.029300 | 1.014285 | −0.046404 |
| 1.029300 | 1.064768 | −0.046089 |
| 1.029300 | 1.115806 | −0.043885 |

TABLE 4-continued

| Inner Diameter Flowpath | | |
|---|---|---|
| X/Root_Bx | Y/Root_Pitch | Z/Span |
| 1.029300 | 1.167306 | −0.039475 |
| 1.029300 | 1.219361 | −0.033438 |
| 1.029300 | 1.271601 | −0.027349 |
| 1.029300 | 1.323656 | −0.022992 |
| 1.029300 | 1.374971 | −0.022047 |
| 1.029300 | 1.424992 | −0.026299 |
| 1.029300 | 1.473441 | −0.036798 |
| 1.029300 | 1.520595 | −0.051496 |
| 1.029300 | 1.567010 | −0.067874 |
| 1.029300 | 1.613518 | −0.083517 |
| 1.029300 | 1.660672 | −0.096010 |
| 1.029300 | 1.708936 | −0.104777 |
| 1.029300 | 1.757940 | −0.110866 |
| 1.029300 | 1.807406 | −0.115538 |
| 1.072566 | −2.257871 | −0.177060 |
| 1.072566 | −2.210161 | −0.167769 |
| 1.072566 | −2.161527 | −0.160787 |
| 1.072566 | −2.112616 | −0.154331 |
| 1.072566 | −2.063797 | −0.147559 |
| 1.072566 | −2.015441 | −0.139843 |
| 1.072566 | −1.967547 | −0.130709 |
| 1.072566 | −1.920300 | −0.119580 |
| 1.072566 | −1.873422 | −0.106929 |
| 1.072566 | −1.826545 | −0.094016 |
| 1.072566 | −1.779206 | −0.082310 |
| 1.072566 | −1.730849 | −0.073176 |
| 1.072566 | −1.681013 | −0.068346 |
| 1.072566 | −1.629328 | −0.069659 |
| 1.072566 | −1.576626 | −0.074908 |
| 1.072566 | −1.523647 | −0.081417 |
| 1.072566 | −1.471314 | −0.086457 |
| 1.072566 | −1.420369 | −0.087402 |
| 1.072566 | −1.370625 | −0.083832 |
| 1.072566 | −1.321622 | −0.077428 |
| 1.072566 | −1.272803 | −0.070079 |
| 1.072566 | −1.223614 | −0.063675 |
| 1.072566 | −1.173963 | −0.059633 |
| 1.072566 | −1.124127 | −0.056115 |
| 1.072566 | −1.074384 | −0.052283 |
| 1.072566 | −1.024825 | −0.047507 |
| 1.072566 | −0.975452 | −0.041207 |
| 1.072566 | −0.926448 | −0.032966 |
| 1.072566 | −0.877537 | −0.023150 |
| 1.072566 | −0.828626 | −0.013123 |
| 1.072566 | −0.779252 | −0.004304 |
| 1.072566 | −0.729509 | 0.001890 |
| 1.072566 | −0.679118 | 0.003727 |
| 1.072566 | −0.627895 | −0.000630 |
| 1.072566 | −0.576395 | −0.008976 |
| 1.072566 | −0.524987 | −0.018583 |
| 1.072566 | −0.473949 | −0.026667 |
| 1.072566 | −0.423374 | −0.030656 |
| 1.072566 | −0.373261 | −0.030026 |
| 1.072566 | −0.323332 | −0.026614 |
| 1.072566 | −0.273404 | −0.022205 |
| 1.072566 | −0.223383 | −0.018740 |
| 1.072566 | −0.173177 | −0.017638 |
| 1.072566 | −0.122972 | −0.017113 |
| 1.072566 | −0.072858 | −0.016220 |
| 1.072566 | −0.022653 | −0.014436 |
| 1.072566 | 0.027553 | −0.011129 |
| 1.072566 | 0.077851 | −0.005827 |
| 1.072566 | 0.128242 | 0.000997 |
| 1.072566 | 0.178817 | 0.008084 |
| 1.072566 | 0.229485 | 0.013963 |
| 1.072566 | 0.280153 | 0.017165 |
| 1.072566 | 0.330637 | 0.016010 |
| 1.072566 | 0.380657 | 0.008661 |
| 1.072566 | 0.430401 | −0.002730 |
| 1.072566 | 0.479774 | −0.015328 |
| 1.072566 | 0.529056 | −0.026457 |
| 1.072566 | 0.578614 | −0.033386 |
| 1.072566 | 0.628542 | −0.035748 |
| 1.072566 | 0.678841 | −0.035276 |
| 1.072566 | 0.729324 | −0.033858 |

TABLE 4-continued

| Inner Diameter Flowpath | | |
|---|---|---|
| X/Root_Bx | Y/Root_Pitch | Z/Span |
| 1.072566 | 0.779714 | −0.033386 |
| 1.072566 | 0.829828 | −0.035276 |
| 1.072566 | 0.879848 | −0.037743 |
| 1.072566 | 0.929869 | −0.039843 |
| 1.072566 | 0.980167 | −0.040997 |
| 1.072566 | 1.030650 | −0.040735 |
| 1.072566 | 1.081688 | −0.038425 |
| 1.072566 | 1.133096 | −0.034593 |
| 1.072566 | 1.184689 | −0.030604 |
| 1.072566 | 1.236096 | −0.027769 |
| 1.072566 | 1.287042 | −0.027559 |
| 1.072566 | 1.337063 | −0.031706 |
| 1.072566 | 1.385512 | −0.041995 |
| 1.072566 | 1.432851 | −0.056273 |
| 1.072566 | 1.479636 | −0.071759 |
| 1.072566 | 1.526605 | −0.085722 |
| 1.072566 | 1.574592 | −0.095591 |
| 1.072566 | 1.623873 | −0.100892 |
| 1.072566 | 1.673986 | −0.103412 |
| 1.072566 | 1.724377 | −0.104987 |
| 1.115833 | −2.341085 | −0.183570 |
| 1.115833 | −2.293375 | −0.174331 |
| 1.115833 | −2.244741 | −0.167139 |
| 1.115833 | −2.195830 | −0.160630 |
| 1.115833 | −2.146919 | −0.154121 |
| 1.115833 | −2.098192 | −0.147139 |
| 1.115833 | −2.049743 | −0.139423 |
| 1.115833 | −2.001757 | −0.130499 |
| 1.115833 | −1.954047 | −0.120630 |
| 1.115833 | −1.906246 | −0.110604 |
| 1.115833 | −1.858259 | −0.101312 |
| 1.115833 | −1.809533 | −0.093543 |
| 1.115833 | −1.759974 | −0.088451 |
| 1.115833 | −1.709029 | −0.087454 |
| 1.115833 | −1.657251 | −0.089186 |
| 1.115833 | −1.605474 | −0.091654 |
| 1.115833 | −1.554158 | −0.092913 |
| 1.115833 | −1.503860 | −0.091129 |
| 1.115833 | −1.454487 | −0.086089 |
| 1.115833 | −1.405575 | −0.079108 |
| 1.115833 | −1.356757 | −0.071654 |
| 1.115833 | −1.307660 | −0.065302 |
| 1.115833 | −1.257917 | −0.061050 |
| 1.115833 | −1.208081 | −0.057480 |
| 1.115833 | −1.158245 | −0.053858 |
| 1.115833 | −1.108502 | −0.049869 |
| 1.115833 | −1.058943 | −0.045039 |
| 1.115833 | −1.009570 | −0.039003 |
| 1.115833 | −0.960288 | −0.032021 |
| 1.115833 | −0.910915 | −0.024934 |
| 1.115833 | −0.861356 | −0.018530 |
| 1.115833 | −0.811521 | −0.013648 |
| 1.115833 | −0.761315 | −0.011496 |
| 1.115833 | −0.710462 | −0.013596 |
| 1.115833 | −0.659332 | −0.018373 |
| 1.115833 | −0.608201 | −0.023885 |
| 1.115833 | −0.557441 | −0.028189 |
| 1.115833 | −0.507050 | −0.029396 |
| 1.115833 | −0.457029 | −0.027297 |
| 1.115833 | −0.407101 | −0.023255 |
| 1.115833 | −0.357265 | −0.018793 |
| 1.115833 | −0.307152 | −0.015328 |
| 1.115833 | −0.257039 | −0.014068 |
| 1.115833 | −0.206740 | −0.013491 |
| 1.115833 | −0.156535 | −0.012861 |
| 1.115833 | −0.106329 | −0.011811 |
| 1.115833 | −0.056123 | −0.009974 |
| 1.115833 | −0.005917 | −0.006877 |
| 1.115833 | 0.044381 | −0.002887 |
| 1.115833 | 0.094771 | 0.001260 |
| 1.115833 | 0.145254 | 0.004672 |
| 1.115833 | 0.195645 | 0.006562 |
| 1.115833 | 0.246036 | 0.005722 |
| 1.115833 | 0.296242 | 0.000630 |
| 1.115833 | 0.346262 | −0.007139 |

TABLE 4-continued

| Inner Diameter Flowpath | | |
|---|---|---|
| X/Root_Bx | Y/Root_Pitch | Z/Span |
| 1.115833 | 0.396006 | −0.015643 |
| 1.115833 | 0.445749 | −0.022940 |
| 1.115833 | 0.495585 | −0.027192 |
| 1.115833 | 0.545791 | −0.028031 |
| 1.115833 | 0.596089 | −0.026982 |
| 1.115833 | 0.646572 | −0.025512 |
| 1.115833 | 0.696963 | −0.025039 |
| 1.115833 | 0.747076 | −0.026772 |
| 1.115833 | 0.797189 | −0.029134 |
| 1.115833 | 0.847210 | −0.031496 |
| 1.115833 | 0.897416 | −0.033438 |
| 1.115833 | 0.947621 | −0.034593 |
| 1.115833 | 0.998197 | −0.034541 |
| 1.115833 | 1.048958 | −0.033543 |
| 1.115833 | 1.099810 | −0.032388 |
| 1.115833 | 1.150571 | −0.031969 |
| 1.115833 | 1.201147 | −0.033123 |
| 1.115833 | 1.251075 | −0.036955 |
| 1.115833 | 1.300079 | −0.044987 |
| 1.115833 | 1.348343 | −0.055696 |
| 1.115833 | 1.396237 | −0.067087 |
| 1.115833 | 1.444316 | −0.077323 |
| 1.115833 | 1.493227 | −0.084462 |
| 1.115833 | 1.542878 | −0.088294 |
| 1.115833 | 1.593176 | −0.090236 |
| 1.115833 | 1.643660 | −0.091759 |
| 1.159099 | −2.421340 | −0.189764 |
| 1.159099 | −2.373168 | −0.181575 |
| 1.159099 | −2.324534 | −0.174383 |
| 1.159099 | −2.275715 | −0.167559 |
| 1.159099 | −2.226804 | −0.160787 |
| 1.159099 | −2.177985 | −0.154068 |
| 1.159099 | −2.129259 | −0.147087 |
| 1.159099 | −2.080533 | −0.139843 |
| 1.159099 | −2.031991 | −0.132336 |
| 1.159099 | −1.983357 | −0.124882 |
| 1.159099 | −1.934631 | −0.117690 |
| 1.159099 | −1.885535 | −0.111181 |
| 1.159099 | −1.836161 | −0.105669 |
| 1.159099 | −1.786233 | −0.101785 |
| 1.159099 | −1.735935 | −0.099003 |
| 1.159099 | −1.685636 | −0.096535 |
| 1.159099 | −1.635523 | −0.093648 |
| 1.159099 | −1.585687 | −0.089711 |
| 1.159099 | −1.536314 | −0.084567 |
| 1.159099 | −1.487032 | −0.078845 |
| 1.159099 | −1.437751 | −0.073018 |
| 1.159099 | −1.388285 | −0.067769 |
| 1.159099 | −1.338634 | −0.063465 |
| 1.159099 | −1.288798 | −0.059580 |
| 1.159099 | −1.238963 | −0.055801 |
| 1.159099 | −1.189127 | −0.051969 |
| 1.159099 | −1.139383 | −0.047979 |
| 1.159099 | −1.089640 | −0.043622 |
| 1.159099 | −1.039896 | −0.039055 |
| 1.159099 | −0.990153 | −0.034488 |
| 1.159099 | −0.940317 | −0.030289 |
| 1.159099 | −0.890389 | −0.026667 |
| 1.159099 | −0.840276 | −0.024147 |
| 1.159099 | −0.789885 | −0.023255 |
| 1.159099 | −0.739402 | −0.023412 |
| 1.159099 | −0.688919 | −0.023990 |
| 1.159099 | −0.638436 | −0.024094 |
| 1.159099 | −0.588230 | −0.023150 |
| 1.159099 | −0.538117 | −0.020945 |
| 1.159099 | −0.488096 | −0.018163 |
| 1.159099 | −0.437983 | −0.015328 |
| 1.159099 | −0.387869 | −0.013018 |
| 1.159099 | −0.337664 | −0.011706 |
| 1.159099 | −0.287365 | −0.010814 |
| 1.159099 | −0.237160 | −0.009974 |
| 1.159099 | −0.186861 | −0.009134 |
| 1.159099 | −0.136656 | −0.008084 |
| 1.159099 | −0.086358 | −0.006719 |
| 1.159099 | −0.036059 | −0.005144 |

TABLE 4-continued

| Inner Diameter Flowpath | | |
|---|---|---|
| X/Root_Bx | Y/Root_Pitch | Z/Span |
| 1.159099 | 0.014239 | −0.003570 |
| 1.159099 | 0.064537 | −0.002310 |
| 1.159099 | 0.114835 | −0.001732 |
| 1.159099 | 0.165226 | −0.002152 |
| 1.159099 | 0.215432 | −0.004252 |
| 1.159099 | 0.265637 | −0.007454 |
| 1.159099 | 0.315751 | −0.010971 |
| 1.159099 | 0.365864 | −0.014121 |
| 1.159099 | 0.416070 | −0.016115 |
| 1.159099 | 0.466275 | −0.016955 |
| 1.159099 | 0.516573 | −0.017113 |
| 1.159099 | 0.566872 | −0.017270 |
| 1.159099 | 0.617170 | −0.017953 |
| 1.159099 | 0.667376 | −0.019633 |
| 1.159099 | 0.717489 | −0.021680 |
| 1.159099 | 0.767602 | −0.023885 |
| 1.159099 | 0.817715 | −0.026037 |
| 1.159099 | 0.867921 | −0.027979 |
| 1.159099 | 0.918127 | −0.029606 |
| 1.159099 | 0.968425 | −0.030971 |
| 1.159099 | 1.018723 | −0.032388 |
| 1.159099 | 1.069021 | −0.034173 |
| 1.159099 | 1.119227 | −0.036535 |
| 1.159099 | 1.169155 | −0.039948 |
| 1.159099 | 1.218806 | −0.045039 |
| 1.159099 | 1.268087 | −0.051181 |
| 1.159099 | 1.317369 | −0.057690 |
| 1.159099 | 1.366557 | −0.063780 |
| 1.159099 | 1.416116 | −0.068766 |
| 1.159099 | 1.465859 | −0.072546 |
| 1.159099 | 1.515880 | −0.075696 |
| 1.159099 | 1.565901 | −0.078845 |
| 1.202366 | −2.494198 | −0.197848 |
| 1.202366 | −2.445657 | −0.190341 |
| 1.202366 | −2.397115 | −0.183045 |
| 1.202366 | −2.348389 | −0.175906 |
| 1.202366 | −2.299570 | −0.168924 |
| 1.202366 | −2.250751 | −0.162047 |
| 1.202366 | −2.201932 | −0.155328 |
| 1.202366 | −2.153021 | −0.148714 |
| 1.202366 | −2.104017 | −0.142257 |
| 1.202366 | −2.054921 | −0.135958 |
| 1.202366 | −2.005825 | −0.129764 |
| 1.202366 | −1.956636 | −0.123780 |
| 1.202366 | −1.907448 | −0.117900 |
| 1.202366 | −1.858167 | −0.112283 |
| 1.202366 | −1.808793 | −0.106824 |
| 1.202366 | −1.759327 | −0.101522 |
| 1.202366 | −1.709861 | −0.096378 |
| 1.202366 | −1.660395 | −0.091286 |
| 1.202366 | −1.610836 | −0.086299 |
| 1.202366 | −1.561278 | −0.081470 |
| 1.202366 | −1.511719 | −0.076745 |
| 1.202366 | −1.462068 | −0.072178 |
| 1.202366 | −1.412325 | −0.067822 |
| 1.202366 | −1.362581 | −0.063622 |
| 1.202366 | −1.312838 | −0.059528 |
| 1.202366 | −1.263002 | −0.055591 |
| 1.202366 | −1.213166 | −0.051811 |
| 1.202366 | −1.163238 | −0.048189 |
| 1.202366 | −1.113402 | −0.044619 |
| 1.202366 | −1.063381 | −0.041260 |
| 1.202366 | −1.013453 | −0.038058 |
| 1.202366 | −0.963432 | −0.034961 |
| 1.202366 | −0.913411 | −0.032126 |
| 1.202366 | −0.863298 | −0.029449 |
| 1.202366 | −0.813185 | −0.026929 |
| 1.202366 | −0.763072 | −0.024567 |
| 1.202366 | −0.712958 | −0.022362 |
| 1.202366 | −0.662753 | −0.020262 |
| 1.202366 | −0.612639 | −0.018268 |
| 1.202366 | −0.562434 | −0.016378 |
| 1.202366 | −0.512228 | −0.014646 |
| 1.202366 | −0.462022 | −0.013071 |
| 1.202366 | −0.411816 | −0.011654 |

TABLE 4-continued

| Inner Diameter Flowpath | | |
|---|---|---|
| X/Root_Bx | Y/Root_Pitch | Z/Span |
| 1.202366 | −0.361518 | −0.010394 |
| 1.202366 | −0.311312 | −0.009344 |
| 1.202366 | −0.261014 | −0.008399 |
| 1.202366 | −0.210716 | −0.007559 |
| 1.202366 | −0.160418 | −0.006877 |
| 1.202366 | −0.110212 | −0.006352 |
| 1.202366 | −0.059914 | −0.005932 |
| 1.202366 | −0.009616 | −0.005722 |
| 1.202366 | 0.040682 | −0.005617 |
| 1.202366 | 0.090981 | −0.005722 |
| 1.202366 | 0.141279 | −0.006037 |
| 1.202366 | 0.191577 | −0.006562 |
| 1.202366 | 0.241875 | −0.007192 |
| 1.202366 | 0.292173 | −0.007979 |
| 1.202366 | 0.342379 | −0.008819 |
| 1.202366 | 0.392677 | −0.009816 |
| 1.202366 | 0.442883 | −0.010919 |
| 1.202366 | 0.493181 | −0.012178 |
| 1.202366 | 0.543387 | −0.013596 |
| 1.202366 | 0.593593 | −0.015171 |
| 1.202366 | 0.643798 | −0.016903 |
| 1.202366 | 0.694004 | −0.018845 |
| 1.202366 | 0.744210 | −0.020840 |
| 1.202366 | 0.794323 | −0.023045 |
| 1.202366 | 0.844436 | −0.025354 |
| 1.202366 | 0.894549 | −0.027769 |
| 1.202366 | 0.944663 | −0.030394 |
| 1.202366 | 0.994684 | −0.033123 |
| 1.202366 | 1.044704 | −0.036063 |
| 1.202366 | 1.094725 | −0.039108 |
| 1.202366 | 1.144746 | −0.042415 |
| 1.202366 | 1.194674 | −0.045879 |
| 1.202366 | 1.244510 | −0.049501 |
| 1.202366 | 1.294346 | −0.053281 |
| 1.202366 | 1.344182 | −0.057113 |
| 1.202366 | 1.394018 | −0.061102 |
| 1.202366 | 1.443761 | −0.065197 |
| 1.202366 | 1.493505 | −0.069396 |
| 1.245632 | −2.557071 | −0.207559 |
| 1.245632 | −2.508622 | −0.199948 |
| 1.245632 | −2.460080 | −0.192493 |
| 1.245632 | −2.411447 | −0.185144 |
| 1.245632 | −2.362813 | −0.177953 |
| 1.245632 | −2.314086 | −0.170919 |
| 1.245632 | −2.265267 | −0.163990 |
| 1.245632 | −2.216356 | −0.157270 |
| 1.245632 | −2.167445 | −0.150656 |
| 1.245632 | −2.118441 | −0.144147 |
| 1.245632 | −2.069437 | −0.137848 |
| 1.245632 | −2.020341 | −0.131654 |
| 1.245632 | −1.971153 | −0.125669 |
| 1.245632 | −1.921984 | −0.119790 |
| 1.245632 | −1.872683 | −0.114016 |
| 1.245632 | −1.823309 | −0.108451 |
| 1.245632 | −1.773936 | −0.102992 |
| 1.245632 | −1.724562 | −0.097690 |
| 1.245632 | −1.675096 | −0.092546 |
| 1.245632 | −1.625537 | −0.087559 |
| 1.245632 | −1.575979 | −0.082730 |
| 1.245632 | −1.526420 | −0.078005 |
| 1.245632 | −1.476769 | −0.073438 |
| 1.245632 | −1.427026 | −0.069029 |
| 1.245632 | −1.377283 | −0.064777 |
| 1.245632 | −1.327539 | −0.060682 |
| 1.245632 | −1.277703 | −0.056693 |
| 1.245632 | −1.227867 | −0.052861 |
| 1.245632 | −1.178032 | −0.049186 |
| 1.245632 | −1.128103 | −0.045669 |
| 1.245632 | −1.078175 | −0.042310 |
| 1.245632 | −1.028154 | −0.039055 |
| 1.245632 | −0.978226 | −0.036010 |
| 1.245632 | −0.928112 | −0.033071 |
| 1.245632 | −0.878092 | −0.030289 |
| 1.245632 | −0.827978 | −0.027664 |
| 1.245632 | −0.777865 | −0.025197 |

TABLE 4-continued

| Inner Diameter Flowpath | | |
|---|---|---|
| X/Root_Bx | Y/Root_Pitch | Z/Span |
| 1.245632 | −0.727752 | −0.022835 |
| 1.245632 | −0.677639 | −0.020682 |
| 1.245632 | −0.627433 | −0.018635 |
| 1.245632 | −0.577320 | −0.016745 |
| 1.245632 | −0.527114 | −0.015013 |
| 1.245632 | −0.476908 | −0.013438 |
| 1.245632 | −0.426610 | −0.011969 |
| 1.245632 | −0.376404 | −0.010709 |
| 1.245632 | −0.326106 | −0.009554 |
| 1.245632 | −0.275900 | −0.008556 |
| 1.245632 | −0.225602 | −0.007717 |
| 1.245632 | −0.175304 | −0.007034 |
| 1.245632 | −0.125006 | −0.006509 |
| 1.245632 | −0.074708 | −0.006089 |
| 1.245632 | −0.024409 | −0.005879 |
| 1.245632 | 0.025889 | −0.005774 |
| 1.245632 | 0.076187 | −0.005827 |
| 1.245632 | 0.126485 | −0.006037 |
| 1.245632 | 0.176691 | −0.006404 |
| 1.245632 | 0.226989 | −0.006877 |
| 1.245632 | 0.277287 | −0.007559 |
| 1.245632 | 0.327585 | −0.008346 |
| 1.245632 | 0.377884 | −0.009291 |
| 1.245632 | 0.428089 | −0.010394 |
| 1.245632 | 0.478387 | −0.011654 |
| 1.245632 | 0.528593 | −0.013071 |
| 1.245632 | 0.578799 | −0.014646 |
| 1.245632 | 0.629005 | −0.016325 |
| 1.245632 | 0.679210 | −0.018163 |
| 1.245632 | 0.729324 | −0.020157 |
| 1.245632 | 0.779529 | −0.022310 |
| 1.245632 | 0.829643 | −0.024619 |
| 1.245632 | 0.879756 | −0.027087 |
| 1.245632 | 0.929869 | −0.029659 |
| 1.245632 | 0.979890 | −0.032388 |
| 1.245632 | 1.029911 | −0.035276 |
| 1.245632 | 1.079932 | −0.038320 |
| 1.245632 | 1.129952 | −0.041522 |
| 1.245632 | 1.179881 | −0.044882 |
| 1.245632 | 1.229809 | −0.048346 |
| 1.245632 | 1.279737 | −0.051969 |
| 1.245632 | 1.329573 | −0.055748 |
| 1.245632 | 1.379317 | −0.059685 |
| 1.245632 | 1.429153 | −0.063780 |
| 1.288899 | −2.611992 | −0.216378 |
| 1.288899 | −2.563543 | −0.208609 |
| 1.288899 | −2.515094 | −0.200945 |
| 1.288899 | −2.466553 | −0.193491 |
| 1.288899 | −2.418011 | −0.186089 |
| 1.288899 | −2.369285 | −0.178898 |
| 1.288899 | −2.320558 | −0.171864 |
| 1.288899 | −2.271832 | −0.164934 |
| 1.288899 | −2.222921 | −0.158163 |
| 1.288899 | −2.174010 | −0.151496 |
| 1.288899 | −2.125006 | −0.145039 |
| 1.288899 | −2.076002 | −0.138688 |
| 1.288899 | −2.026906 | −0.132493 |
| 1.288899 | −1.977717 | −0.128457 |
| 1.288899 | −1.928529 | −0.120525 |
| 1.288899 | −1.879247 | −0.114803 |
| 1.288899 | −1.829966 | −0.109186 |
| 1.288899 | −1.780593 | −0.103727 |
| 1.288899 | −1.731127 | −0.098425 |
| 1.288899 | −1.681661 | −0.093228 |
| 1.288899 | −1.632195 | −0.088241 |
| 1.288899 | −1.582636 | −0.083360 |
| 1.288899 | −1.532985 | −0.078635 |
| 1.288899 | −1.483427 | −0.074068 |
| 1.288899 | −1.433683 | −0.069606 |
| 1.288899 | −1.383940 | −0.065354 |
| 1.288899 | −1.334196 | −0.061207 |
| 1.288899 | −1.284360 | −0.057218 |
| 1.288899 | −1.234525 | −0.053386 |
| 1.288899 | −1.184689 | −0.049711 |
| 1.288899 | −1.134760 | −0.046142 |

TABLE 4-continued

| Inner Diameter Flowpath | | |
|---|---|---|
| X/Root_Bx | Y/Root_Pitch | Z/Span |
| 1.288899 | −1.084832 | −0.042730 |
| 1.288899 | −1.034904 | −0.039528 |
| 1.288899 | −0.984883 | −0.036430 |
| 1.288899 | −0.934862 | −0.033438 |
| 1.288899 | −0.884841 | −0.030656 |
| 1.288899 | −0.834728 | −0.028031 |
| 1.288899 | −0.784615 | −0.025512 |
| 1.288899 | −0.734501 | −0.023150 |
| 1.288899 | −0.684388 | −0.020945 |
| 1.288899 | −0.634182 | −0.018898 |
| 1.288899 | −0.583977 | −0.017008 |
| 1.288899 | −0.533771 | −0.015223 |
| 1.288899 | −0.483565 | −0.013648 |
| 1.288899 | −0.433360 | −0.012178 |
| 1.288899 | −0.383154 | −0.010866 |
| 1.288899 | −0.332856 | −0.009711 |
| 1.288899 | −0.282557 | −0.008714 |
| 1.288899 | −0.232352 | −0.007822 |
| 1.288899 | −0.182054 | −0.007139 |
| 1.288899 | −0.131755 | −0.006562 |
| 1.288899 | −0.081457 | −0.006142 |
| 1.288899 | −0.031159 | −0.005879 |
| 1.288899 | 0.019139 | −0.005774 |
| 1.288899 | 0.069437 | −0.005827 |
| 1.288899 | 0.119736 | −0.005984 |
| 1.288899 | 0.170034 | −0.006352 |
| 1.288899 | 0.220239 | −0.006824 |
| 1.288899 | 0.270538 | −0.007454 |
| 1.288899 | 0.320836 | −0.008241 |
| 1.288899 | 0.371134 | −0.009186 |
| 1.288899 | 0.421340 | −0.010236 |
| 1.288899 | 0.471638 | −0.011496 |
| 1.288899 | 0.521844 | −0.012861 |
| 1.288899 | 0.572049 | −0.014383 |
| 1.288899 | 0.622255 | −0.016063 |
| 1.288899 | 0.672461 | −0.017900 |
| 1.288899 | 0.722667 | −0.019895 |
| 1.288899 | 0.772780 | −0.022047 |
| 1.288899 | 0.822986 | −0.024304 |
| 1.288899 | 0.873099 | −0.026719 |
| 1.288899 | 0.923120 | −0.029291 |
| 1.288899 | 0.973233 | −0.032021 |
| 1.288899 | 1.023254 | −0.034908 |
| 1.288899 | 1.073274 | −0.037900 |
| 1.288899 | 1.123203 | −0.041102 |
| 1.288899 | 1.173224 | −0.044409 |
| 1.288899 | 1.223152 | −0.047874 |
| 1.288899 | 1.272988 | −0.051496 |
| 1.288899 | 1.322916 | −0.055276 |
| 1.288899 | 1.372660 | −0.059160 |
| 1.332165 | −2.661273 | −0.224462 |
| 1.332165 | −2.612917 | −0.216535 |
| 1.332165 | −2.564560 | −0.208766 |
| 1.332165 | −2.516111 | −0.201102 |
| 1.332165 | −2.467570 | −0.193596 |
| 1.332165 | −2.418936 | −0.186247 |
| 1.332165 | −2.370302 | −0.179055 |
| 1.332165 | −2.321576 | −0.171969 |
| 1.332165 | −2.272757 | −0.165039 |
| 1.332165 | −2.223938 | −0.158268 |
| 1.332165 | −2.174934 | −0.151654 |
| 1.332165 | −2.126023 | −0.145144 |
| 1.332165 | −2.076927 | −0.138793 |
| 1.332165 | −2.027830 | −0.132598 |
| 1.332165 | −1.978734 | −0.126562 |
| 1.332165 | −1.929453 | −0.120682 |
| 1.332165 | −1.880264 | −0.114908 |
| 1.332165 | −1.830891 | −0.109291 |
| 1.332165 | −1.781517 | −0.103832 |
| 1.332165 | −1.732144 | −0.098530 |
| 1.332165 | −1.682678 | −0.093333 |
| 1.332165 | −1.633212 | −0.088346 |
| 1.332165 | −1.583653 | −0.083465 |
| 1.332165 | −1.534002 | −0.078740 |
| 1.332165 | −1.484351 | −0.074121 |

TABLE 4-continued

| Inner Diameter Flowpath | | |
|---|---|---|
| X/Root_Bx | Y/Root_Pitch | Z/Span |
| 1.332165 | −1.434700 | −0.069711 |
| 1.332165 | −1.384957 | −0.065407 |
| 1.332165 | −1.335213 | −0.061260 |
| 1.332165 | −1.285377 | −0.057270 |
| 1.332165 | −1.235542 | −0.053438 |
| 1.332165 | −1.185706 | −0.049764 |
| 1.332165 | −1.135777 | −0.046194 |
| 1.332165 | −1.085849 | −0.042835 |
| 1.332165 | −1.035828 | −0.039580 |
| 1.332165 | −0.985900 | −0.036483 |
| 1.332165 | −0.935879 | −0.033491 |
| 1.332165 | −0.885766 | −0.030709 |
| 1.332165 | −0.835745 | −0.028084 |
| 1.332165 | −0.785632 | −0.025564 |
| 1.332165 | −0.735518 | −0.023202 |
| 1.332165 | −0.685313 | −0.020997 |
| 1.332165 | −0.635199 | −0.018950 |
| 1.332165 | −0.584994 | −0.017008 |
| 1.332165 | −0.534788 | −0.015276 |
| 1.332165 | −0.484582 | −0.013648 |
| 1.332165 | −0.434377 | −0.012178 |
| 1.332165 | −0.384078 | −0.010866 |
| 1.332165 | −0.333873 | −0.009711 |
| 1.332165 | −0.283574 | −0.008714 |
| 1.332165 | −0.233276 | −0.007874 |
| 1.332165 | −0.183071 | −0.007139 |
| 1.332165 | −0.132772 | −0.006562 |
| 1.332165 | −0.082474 | −0.006142 |
| 1.332165 | −0.032176 | −0.005879 |
| 1.332165 | 0.018122 | −0.005774 |
| 1.332165 | 0.068420 | −0.005827 |
| 1.332165 | 0.118719 | −0.005984 |
| 1.332165 | 0.169017 | −0.006352 |
| 1.332165 | 0.219315 | −0.006824 |
| 1.332165 | 0.269613 | −0.007454 |
| 1.332165 | 0.319819 | −0.008241 |
| 1.332165 | 0.370117 | −0.009134 |
| 1.332165 | 0.420415 | −0.010236 |
| 1.332165 | 0.470621 | −0.011444 |
| 1.332165 | 0.520827 | −0.012861 |
| 1.332165 | 0.571125 | −0.014383 |
| 1.332165 | 0.621330 | −0.016063 |
| 1.332165 | 0.671444 | −0.017900 |
| 1.332165 | 0.721649 | −0.019843 |
| 1.332165 | 0.771855 | −0.021995 |
| 1.332165 | 0.821968 | −0.024252 |
| 1.332165 | 0.872082 | −0.026667 |
| 1.332165 | 0.922195 | −0.029239 |
| 1.332165 | 0.972216 | −0.031969 |
| 1.332165 | 1.022237 | −0.034856 |
| 1.332165 | 1.072257 | −0.037848 |
| 1.332165 | 1.122278 | −0.041050 |
| 1.332165 | 1.172207 | −0.044357 |
| 1.332165 | 1.222135 | −0.047822 |
| 1.332165 | 1.272063 | −0.051444 |
| 1.332165 | 1.321899 | −0.055171 |
| 1.375432 | −2.706671 | −0.232073 |
| 1.375432 | −2.658499 | −0.224042 |
| 1.375432 | −2.610143 | −0.216115 |
| 1.375432 | −2.561786 | −0.208346 |
| 1.375432 | −2.513245 | −0.200682 |
| 1.375432 | −2.464796 | −0.193176 |
| 1.375432 | −2.416162 | −0.185827 |
| 1.375432 | −2.367528 | −0.178635 |
| 1.375432 | −2.318709 | −0.171601 |
| 1.375432 | −2.269983 | −0.164672 |
| 1.375432 | −2.221072 | −0.157900 |
| 1.375432 | −2.172160 | −0.151286 |
| 1.375432 | −2.123157 | −0.144777 |
| 1.375432 | −2.074153 | −0.138478 |
| 1.375432 | −2.025057 | −0.132283 |
| 1.375432 | −1.975868 | −0.126247 |
| 1.375432 | −1.926679 | −0.120315 |
| 1.375432 | −1.877398 | −0.114593 |
| 1.375432 | −1.828117 | −0.108976 |

TABLE 4-continued

| Inner Diameter Flowpath | | |
|---|---|---|
| X/Root_Bx | Y/Root_Pitch | Z/Span |
| 1.375432 | −1.778743 | −0.103517 |
| 1.375432 | −1.729277 | −0.098215 |
| 1.375432 | −1.679811 | −0.093071 |
| 1.375432 | −1.630345 | −0.088031 |
| 1.375432 | −1.580787 | −0.083150 |
| 1.375432 | −1.531136 | −0.078425 |
| 1.375432 | −1.481485 | −0.073858 |
| 1.375432 | −1.431834 | −0.069449 |
| 1.375432 | −1.382091 | −0.065197 |
| 1.375432 | −1.332347 | −0.061050 |
| 1.375432 | −1.282511 | −0.057060 |
| 1.375432 | −1.232675 | −0.053228 |
| 1.375432 | −1.182839 | −0.049554 |
| 1.375432 | −1.132911 | −0.046037 |
| 1.375432 | −1.082983 | −0.042625 |
| 1.375432 | −1.032962 | −0.039370 |
| 1.375432 | −0.983034 | −0.036273 |
| 1.375432 | −0.933013 | −0.033333 |
| 1.375432 | −0.882900 | −0.030551 |
| 1.375432 | −0.832879 | −0.027927 |
| 1.375432 | −0.782765 | −0.025407 |
| 1.375432 | −0.732652 | −0.023045 |
| 1.375432 | −0.682446 | −0.020892 |
| 1.375432 | −0.632333 | −0.018845 |
| 1.375432 | −0.582128 | −0.016903 |
| 1.375432 | −0.531922 | −0.015171 |
| 1.375432 | −0.481716 | −0.013596 |
| 1.375432 | −0.431510 | −0.012126 |
| 1.375432 | −0.381212 | −0.010814 |
| 1.375432 | −0.331006 | −0.009659 |
| 1.375432 | −0.280708 | −0.008661 |
| 1.375432 | −0.230410 | −0.007822 |
| 1.375432 | −0.180112 | −0.007087 |
| 1.375432 | −0.129906 | −0.006562 |
| 1.375432 | −0.079608 | −0.006142 |
| 1.375432 | −0.029310 | −0.005879 |
| 1.375432 | 0.020988 | −0.005774 |
| 1.375432 | 0.071287 | −0.005827 |
| 1.375432 | 0.121585 | −0.006037 |
| 1.375432 | 0.171883 | −0.006352 |
| 1.375432 | 0.222181 | −0.006824 |
| 1.375432 | 0.272479 | −0.007507 |
| 1.375432 | 0.322777 | −0.008294 |
| 1.375432 | 0.372983 | −0.009239 |
| 1.375432 | 0.423281 | −0.010289 |
| 1.375432 | 0.473487 | −0.011549 |
| 1.375432 | 0.523785 | −0.012913 |
| 1.375432 | 0.573991 | −0.014488 |
| 1.375432 | 0.624197 | −0.016168 |
| 1.375432 | 0.674402 | −0.018005 |
| 1.375432 | 0.724516 | −0.020000 |
| 1.375432 | 0.774721 | −0.022100 |
| 1.375432 | 0.824835 | −0.024409 |
| 1.375432 | 0.874948 | −0.026824 |
| 1.375432 | 0.925061 | −0.029396 |
| 1.375432 | 0.975082 | −0.032126 |
| 1.375432 | 1.025103 | −0.035013 |
| 1.375432 | 1.075124 | −0.038058 |
| 1.375432 | 1.125144 | −0.041207 |
| 1.375432 | 1.175073 | −0.044514 |
| 1.375432 | 1.225001 | −0.048031 |
| 1.375432 | 1.274929 | −0.051654 |
| 1.418698 | −2.749387 | −0.239370 |
| 1.418698 | −2.701216 | −0.231181 |
| 1.418698 | −2.652952 | −0.223097 |
| 1.418698 | −2.604595 | −0.215223 |
| 1.418698 | −2.556239 | −0.207454 |
| 1.418698 | −2.507790 | −0.199843 |
| 1.418698 | −2.459248 | −0.192336 |
| 1.418698 | −2.410614 | −0.185039 |
| 1.418698 | −2.361980 | −0.177848 |
| 1.418698 | −2.313162 | −0.170761 |
| 1.418698 | −2.264435 | −0.163885 |
| 1.418698 | −2.215524 | −0.157113 |
| 1.418698 | −2.166613 | −0.150499 |

TABLE 4-continued

| Inner Diameter Flowpath | | |
|---|---|---|
| X/Root_Bx | Y/Root_Pitch | Z/Span |
| 1.418698 | −2.117609 | −0.144042 |
| 1.418698 | −2.068513 | −0.137743 |
| 1.418698 | −2.019417 | −0.131549 |
| 1.418698 | −1.970320 | −0.125564 |
| 1.418698 | −1.921039 | −0.119685 |
| 1.418698 | −1.871758 | −0.113911 |
| 1.418698 | −1.822477 | −0.108346 |
| 1.418698 | −1.773103 | −0.102887 |
| 1.418698 | −1.723637 | −0.097638 |
| 1.418698 | −1.674171 | −0.092493 |
| 1.418698 | −1.624705 | −0.087454 |
| 1.418698 | −1.575147 | −0.082625 |
| 1.418698 | −1.525496 | −0.077900 |
| 1.418698 | −1.475845 | −0.073386 |
| 1.418698 | −1.426194 | −0.068976 |
| 1.418698 | −1.376450 | −0.064724 |
| 1.418698 | −1.326707 | −0.060577 |
| 1.418698 | −1.276871 | −0.056640 |
| 1.418698 | −1.227035 | −0.052808 |
| 1.418698 | −1.177107 | −0.049134 |
| 1.418698 | −1.127271 | −0.045617 |
| 1.418698 | −1.077250 | −0.042257 |
| 1.418698 | −1.027322 | −0.039003 |
| 1.418698 | −0.977301 | −0.035958 |
| 1.418698 | −0.927280 | −0.033018 |
| 1.418698 | −0.877259 | −0.030236 |
| 1.418698 | −0.827146 | −0.027612 |
| 1.418698 | −0.777033 | −0.025144 |
| 1.418698 | −0.726920 | −0.022835 |
| 1.418698 | −0.676714 | −0.020630 |
| 1.418698 | −0.626601 | −0.018583 |
| 1.418698 | −0.576395 | −0.016693 |
| 1.418698 | −0.526189 | −0.014961 |
| 1.418698 | −0.475984 | −0.013386 |
| 1.418698 | −0.425778 | −0.011969 |
| 1.418698 | −0.375480 | −0.010656 |
| 1.418698 | −0.325274 | −0.009554 |
| 1.418698 | −0.274976 | −0.008556 |
| 1.418698 | −0.224678 | −0.007717 |
| 1.418698 | −0.174472 | −0.007034 |
| 1.418698 | −0.124174 | −0.006509 |
| 1.418698 | −0.073875 | −0.006089 |
| 1.418698 | −0.023577 | −0.005879 |
| 1.418698 | 0.026721 | −0.005774 |
| 1.418698 | 0.077019 | −0.005827 |
| 1.418698 | 0.127317 | −0.006037 |
| 1.418698 | 0.177615 | −0.006404 |
| 1.418698 | 0.227914 | −0.006929 |
| 1.418698 | 0.278212 | −0.007559 |
| 1.418698 | 0.328418 | −0.008399 |
| 1.418698 | 0.378716 | −0.009344 |
| 1.418698 | 0.429014 | −0.010446 |
| 1.418698 | 0.479220 | −0.011706 |
| 1.418698 | 0.529425 | −0.013123 |
| 1.418698 | 0.579724 | −0.014646 |
| 1.418698 | 0.629837 | −0.016378 |
| 1.418698 | 0.680043 | −0.018215 |
| 1.418698 | 0.730248 | −0.020210 |
| 1.418698 | 0.780362 | −0.022362 |
| 1.418698 | 0.830567 | −0.024672 |
| 1.418698 | 0.880681 | −0.027087 |
| 1.418698 | 0.930701 | −0.029711 |
| 1.418698 | 0.980815 | −0.032441 |
| 1.418698 | 1.030835 | −0.035328 |
| 1.418698 | 1.080856 | −0.038373 |
| 1.418698 | 1.130785 | −0.041575 |
| 1.418698 | 1.180713 | −0.044934 |
| 1.418698 | 1.230641 | −0.048399 |
| 1.461964 | −2.789885 | −0.246352 |
| 1.461964 | −2.741713 | −0.238058 |
| 1.461964 | −2.693542 | −0.229869 |
| 1.461964 | −2.645278 | −0.221837 |
| 1.461964 | −2.596921 | −0.213963 |
| 1.461964 | −2.548565 | −0.206247 |
| 1.461964 | −2.500023 | −0.198635 |

TABLE 4-continued

| Inner Diameter Flowpath | | |
|---|---|---|
| X/Root_Bx | Y/Root_Pitch | Z/Span |
| 1.461964 | −2.451482 | −0.191181 |
| 1.461964 | −2.402848 | −0.183885 |
| 1.461964 | −2.354214 | −0.176693 |
| 1.461964 | −2.305395 | −0.169659 |
| 1.461964 | −2.256576 | −0.162782 |
| 1.461964 | −2.207757 | −0.156063 |
| 1.461964 | −2.158846 | −0.149501 |
| 1.461964 | −2.109842 | −0.143045 |
| 1.461964 | −2.060746 | −0.136745 |
| 1.461964 | −2.011650 | −0.130604 |
| 1.461964 | −1.962461 | −0.124619 |
| 1.461964 | −1.913273 | −0.118740 |
| 1.461964 | −1.863991 | −0.113018 |
| 1.461964 | −1.814618 | −0.107454 |
| 1.461964 | −1.765244 | −0.102047 |
| 1.461964 | −1.715778 | −0.096798 |
| 1.461964 | −1.666312 | −0.091654 |
| 1.461964 | −1.616846 | −0.086719 |
| 1.461964 | −1.567195 | −0.081890 |
| 1.461964 | −1.517637 | −0.077165 |
| 1.461964 | −1.467986 | −0.072651 |
| 1.461964 | −1.418242 | −0.068294 |
| 1.461964 | −1.368499 | −0.064042 |
| 1.461964 | −1.318755 | −0.059948 |
| 1.461964 | −1.268920 | −0.056010 |
| 1.461964 | −1.219084 | −0.052231 |
| 1.461964 | −1.169155 | −0.048556 |
| 1.461964 | −1.119319 | −0.045092 |
| 1.461964 | −1.069299 | −0.041732 |
| 1.461964 | −1.019370 | −0.038530 |
| 1.461964 | −0.969350 | −0.035486 |
| 1.461964 | −0.919329 | −0.032598 |
| 1.461964 | −0.869215 | −0.029816 |
| 1.461964 | −0.819195 | −0.027192 |
| 1.461964 | −0.769081 | −0.024777 |
| 1.461964 | −0.718968 | −0.022467 |
| 1.461964 | −0.668762 | −0.020315 |
| 1.461964 | −0.618649 | −0.018268 |
| 1.461964 | −0.568443 | −0.016430 |
| 1.461964 | −0.518238 | −0.014698 |
| 1.461964 | −0.468032 | −0.013176 |
| 1.461964 | −0.417734 | −0.011759 |
| 1.461964 | −0.367528 | −0.010499 |
| 1.461964 | −0.317230 | −0.009396 |
| 1.461964 | −0.267024 | −0.008399 |
| 1.461964 | −0.216726 | −0.007612 |
| 1.461964 | −0.166428 | −0.006929 |
| 1.461964 | −0.116130 | −0.006404 |
| 1.461964 | −0.065831 | −0.006037 |
| 1.461964 | −0.015533 | −0.005827 |
| 1.461964 | 0.034765 | −0.005774 |
| 1.461964 | 0.085063 | −0.005879 |
| 1.461964 | 0.135361 | −0.006089 |
| 1.461964 | 0.185659 | −0.006457 |
| 1.461964 | 0.235865 | −0.006982 |
| 1.461964 | 0.286163 | −0.007664 |
| 1.461964 | 0.336462 | −0.008504 |
| 1.461964 | 0.386760 | −0.009501 |
| 1.461964 | 0.436965 | −0.010604 |
| 1.461964 | 0.487264 | −0.011916 |
| 1.461964 | 0.537469 | −0.013333 |
| 1.461964 | 0.587675 | −0.014908 |
| 1.461964 | 0.637881 | −0.016640 |
| 1.461964 | 0.688087 | −0.018530 |
| 1.461964 | 0.738200 | −0.020525 |
| 1.461964 | 0.788406 | −0.022730 |
| 1.461964 | 0.838519 | −0.025039 |
| 1.461964 | 0.888632 | −0.027507 |
| 1.461964 | 0.938653 | −0.030131 |
| 1.461964 | 0.988766 | −0.032913 |
| 1.461964 | 1.038787 | −0.035801 |
| 1.461964 | 1.088808 | −0.038898 |
| 1.461964 | 1.138736 | −0.042100 |
| 1.461964 | 1.188664 | −0.045459 |
| 1.505231 | −2.828348 | −0.253123 |

TABLE 4-continued

| Inner Diameter Flowpath | | |
|---|---|---|
| X/Root_Bx | Y/Root_Pitch | Z/Span |
| 1.505231 | −2.780269 | −0.244724 |
| 1.505231 | −2.732190 | −0.236430 |
| 1.505231 | −2.683926 | −0.228294 |
| 1.505231 | −2.635662 | −0.220262 |
| 1.505231 | −2.587305 | −0.212388 |
| 1.505231 | −2.538856 | −0.204724 |
| 1.505231 | −2.490407 | −0.197113 |
| 1.505231 | −2.441866 | −0.189711 |
| 1.505231 | −2.393232 | −0.182415 |
| 1.505231 | −2.344506 | −0.175276 |
| 1.505231 | −2.295687 | −0.168294 |
| 1.505231 | −2.246868 | −0.161470 |
| 1.505231 | −2.198049 | −0.154751 |
| 1.505231 | −2.149045 | −0.148189 |
| 1.505231 | −2.100042 | −0.141785 |
| 1.505231 | −2.050945 | −0.135538 |
| 1.505231 | −2.001849 | −0.129396 |
| 1.505231 | −1.952661 | −0.123412 |
| 1.505231 | −1.903472 | −0.117585 |
| 1.505231 | −1.854098 | −0.111916 |
| 1.505231 | −1.804817 | −0.106404 |
| 1.505231 | −1.755444 | −0.100997 |
| 1.505231 | −1.705978 | −0.095748 |
| 1.505231 | −1.656511 | −0.090656 |
| 1.505231 | −1.606953 | −0.085722 |
| 1.505231 | −1.557394 | −0.080945 |
| 1.505231 | −1.507744 | −0.076273 |
| 1.505231 | −1.458093 | −0.071759 |
| 1.505231 | −1.408349 | −0.067402 |
| 1.505231 | −1.358606 | −0.063202 |
| 1.505231 | −1.308862 | −0.059160 |
| 1.505231 | −1.259026 | −0.055223 |
| 1.505231 | −1.209191 | −0.051496 |
| 1.505231 | −1.159262 | −0.047874 |
| 1.505231 | −1.109334 | −0.044409 |
| 1.505231 | −1.059405 | −0.041102 |
| 1.505231 | −1.009385 | −0.037900 |
| 1.505231 | −0.959364 | −0.034908 |
| 1.505231 | −0.909343 | −0.032021 |
| 1.505231 | −0.859322 | −0.029291 |
| 1.505231 | −0.809209 | −0.026719 |
| 1.505231 | −0.759096 | −0.024304 |
| 1.505231 | −0.708982 | −0.021995 |
| 1.505231 | −0.658777 | −0.019895 |
| 1.505231 | −0.608663 | −0.017900 |
| 1.505231 | −0.558458 | −0.016063 |
| 1.505231 | −0.508252 | −0.014383 |
| 1.505231 | −0.457954 | −0.012861 |
| 1.505231 | −0.407748 | −0.011496 |
| 1.505231 | −0.357542 | −0.010236 |
| 1.505231 | −0.307244 | −0.009186 |
| 1.505231 | −0.256946 | −0.008241 |
| 1.505231 | −0.206740 | −0.007454 |
| 1.505231 | −0.156442 | −0.006824 |
| 1.505231 | −0.106144 | −0.006352 |
| 1.505231 | −0.055846 | −0.005984 |
| 1.505231 | −0.005548 | −0.005827 |
| 1.505231 | 0.044751 | −0.005774 |
| 1.505231 | 0.095049 | −0.005879 |
| 1.505231 | 0.145347 | −0.006142 |
| 1.505231 | 0.195645 | −0.006562 |
| 1.505231 | 0.245943 | −0.007139 |
| 1.505231 | 0.296149 | −0.007822 |
| 1.505231 | 0.346447 | −0.008714 |
| 1.505231 | 0.396745 | −0.009711 |
| 1.505231 | 0.446951 | −0.010866 |
| 1.505231 | 0.497249 | −0.012178 |
| 1.505231 | 0.547455 | −0.013648 |
| 1.505231 | 0.597661 | −0.015223 |
| 1.505231 | 0.647866 | −0.017008 |
| 1.505231 | 0.698072 | −0.018898 |
| 1.505231 | 0.748185 | −0.020945 |
| 1.505231 | 0.798391 | −0.023150 |
| 1.505231 | 0.848504 | −0.025512 |
| 1.505231 | 0.898618 | −0.028031 |

TABLE 4-continued

| Inner Diameter Flowpath | | |
|---|---|---|
| X/Root_Bx | Y/Root_Pitch | Z/Span |
| 1.505231 | 0.948639 | −0.030656 |
| 1.505231 | 0.998752 | −0.033491 |
| 1.505231 | 1.048773 | −0.036430 |
| 1.505231 | 1.098701 | −0.039528 |
| 1.505231 | 1.148722 | −0.042782 |
| 1.548497 | −2.864962 | −0.259685 |
| 1.548497 | −2.816976 | −0.251129 |
| 1.548497 | −2.768896 | −0.242730 |
| 1.548497 | −2.720817 | −0.234488 |
| 1.548497 | −2.672553 | −0.226352 |
| 1.548497 | −2.624289 | −0.218425 |
| 1.548497 | −2.575933 | −0.210604 |
| 1.548497 | −2.527484 | −0.202887 |
| 1.548497 | −2.478942 | −0.195381 |
| 1.548497 | −2.430401 | −0.187979 |
| 1.548497 | −2.381674 | −0.180735 |
| 1.548497 | −2.333041 | −0.173648 |
| 1.548497 | −2.284222 | −0.166667 |
| 1.548497 | −2.235403 | −0.159843 |
| 1.548497 | −2.186492 | −0.153176 |
| 1.548497 | −2.137488 | −0.146667 |
| 1.548497 | −2.088484 | −0.140315 |
| 1.548497 | −2.039388 | −0.134068 |
| 1.548497 | −1.990292 | −0.127979 |
| 1.548497 | −1.941103 | −0.122047 |
| 1.548497 | −1.891822 | −0.116220 |
| 1.548497 | −1.842541 | −0.110604 |
| 1.548497 | −1.793167 | −0.105092 |
| 1.548497 | −1.743794 | −0.099738 |
| 1.548497 | −1.694328 | −0.094541 |
| 1.548497 | −1.644769 | −0.089501 |
| 1.548497 | −1.595303 | −0.084567 |
| 1.548497 | −1.545652 | −0.079790 |
| 1.548497 | −1.496001 | −0.075223 |
| 1.548497 | −1.446350 | −0.070709 |
| 1.548497 | −1.396607 | −0.066404 |
| 1.548497 | −1.346863 | −0.062257 |
| 1.548497 | −1.297120 | −0.058215 |
| 1.548497 | −1.247284 | −0.054331 |
| 1.548497 | −1.197356 | −0.050604 |
| 1.548497 | −1.147520 | −0.047034 |
| 1.548497 | −1.097591 | −0.043622 |
| 1.548497 | −1.047571 | −0.040315 |
| 1.548497 | −0.997642 | −0.037165 |
| 1.548497 | −0.947621 | −0.034173 |
| 1.548497 | −0.897508 | −0.031339 |
| 1.548497 | −0.847487 | −0.028661 |
| 1.548497 | −0.797374 | −0.026142 |
| 1.548497 | −0.747261 | −0.023727 |
| 1.548497 | −0.697148 | −0.021522 |
| 1.548497 | −0.646942 | −0.019423 |
| 1.548497 | −0.596829 | −0.017480 |
| 1.548497 | −0.546623 | −0.015696 |
| 1.548497 | −0.496417 | −0.014016 |
| 1.548497 | −0.446119 | −0.012546 |
| 1.548497 | −0.395913 | −0.011181 |
| 1.548497 | −0.345708 | −0.009974 |
| 1.548497 | −0.295409 | −0.008924 |
| 1.548497 | −0.245111 | −0.008031 |
| 1.548497 | −0.194813 | −0.007297 |
| 1.548497 | −0.144607 | −0.006719 |
| 1.548497 | −0.094309 | −0.006247 |
| 1.548497 | −0.044011 | −0.005932 |
| 1.548497 | 0.006287 | −0.005774 |
| 1.548497 | 0.056585 | −0.005774 |
| 1.548497 | 0.106884 | −0.005932 |
| 1.548497 | 0.157182 | −0.006247 |
| 1.548497 | 0.207480 | −0.006667 |
| 1.548497 | 0.257778 | −0.007297 |
| 1.548497 | 0.308076 | −0.008031 |
| 1.548497 | 0.358282 | −0.008924 |
| 1.548497 | 0.408580 | −0.009974 |
| 1.548497 | 0.458786 | −0.011181 |
| 1.548497 | 0.509084 | −0.012493 |
| 1.548497 | 0.559290 | −0.014016 |

TABLE 4-continued

| Inner Diameter Flowpath | | |
|---|---|---|
| X/Root_Bx | Y/Root_Pitch | Z/Span |
| 1.548497 | 0.609496 | −0.015643 |
| 1.548497 | 0.659701 | −0.017428 |
| 1.548497 | 0.709907 | −0.019370 |
| 1.548497 | 0.760020 | −0.021470 |
| 1.548497 | 0.810134 | −0.023727 |
| 1.548497 | 0.860247 | −0.026089 |
| 1.548497 | 0.910360 | −0.028609 |
| 1.548497 | 0.960473 | −0.031339 |
| 1.548497 | 1.010494 | −0.034173 |
| 1.548497 | 1.060515 | −0.037113 |
| 1.548497 | 1.110536 | −0.040262 |

The normalized coordinates for any of the sections of blade 10 shown in FIG. 6, and for the ring platform surface 14, set out in the foregoing tables can be converted to the coordinates for a selected blade size and platform surface in absolute dimension space using the normalization equations given below. The conversion for use in converting normalized blade or airfoil surface coordinates for sections of the blade to absolute blade or airfoil coordinates are provided by the following equations beginning with the axial coordinates equation $$x_{absolute} = \left(\frac{x_{local}}{Bx_{local}}\right)\left(\frac{Bx_{local}}{Bx_{root}}\right)(Bx_{root}) + \left(\frac{x\text{Offset}_{local}}{Bx_{root}}\right)(Bx_{root})$$

where $x_{local}/Bx_{local}$ is the normalized airfoil coordinate from Table 1, $Bx_{local}/Bx_{root}$ is obtained from the Axial Chord Distribution from Table 2, and $\text{XOffset}_{local}/Bx_{root}$ is obtained from the Radial Stacking Distribution from Table 3.

Similarly, the tangential coordinates can be found using $$y_{absolute} = \left(\frac{y_{local}}{Bx_{local}}\right)\left(\frac{Bx_{local}}{Bx_{root}}\right)(Bx_{root}) + \left(\frac{y\text{Offset}_{local}}{\text{Pitch}_{root}}\right)(\text{Pitch}_{root})$$

where $\text{yOffset}_{local}/\text{Pitch}_{root}$ is obtained from the Radial Stacking Distribution from Table 3.

The absolute radius of any section can be found through $$R_{absolute} = (\text{SpanFraction})(h) + R_{root}$$

where h is the airfoil span, and $R_{root}$ is the reference root section radius relative to the engine centerline.

The ring platform surface, or inner diameter flowpath, can also be converted from normalized to absolute coordinates using the following normalization equations $$x_{absolute} = \left(\frac{x_{local}}{Bx_{root}}\right)(Bx_{root}),$$

$$y_{absolute} = \left(\frac{y_{local}}{\text{Pitch}_{root}}\right)(\text{Pitch}_{root}), \text{ and}$$

$$R_{absolute} = (Z/\text{Span})(h) + R_{root}.$$

Once determined in absolute space relative to the root section leading edge, the entire airfoil can then be shifted to any other location in space.

The airfoil geometry includes tolerances due to manufacturing, surface finish and coating variability of about ±0.0500 in. In addition, the airfoil as described can be rotated about its radial axis ±20° depending on the particular turbine application.

Although the present invention has been described with reference to preferred embodiments, workers skilled in the art will recognize that changes may be made in form and detail without departing from the spirit and scope of the invention.

The invention claimed is:

1. A turbine blade system including a blade airfoil having an airfoil shape, the blade airfoil having a nominal profile substantially in accordance with normalized Cartesian coordinate values of X, Y and Z set forth in Table 1 herein and which values are dimensionless values that are convertible to corresponding absolute distance values through manipulating them in accord with corresponding normalization equations, and wherein X and Y absolute distance values, when connected by smooth continuing arcs, define nominal airfoil profile sections at each Z absolute distance value, and the nominal airfoil profile sections, when joined smoothly with adjacent ones thereof in accord with Tables 2 and 3 herein, form a complete nominal airfoil shape that is substantially matched by the airfoil shape of the blade airfoil.

2. The turbine blade system of claim 1 further comprising a platform ring on which the blade airfoil is supported along with a plurality of similar blade airfoils positioned about the circumference of the ring platform.

3. The turbine blade system of claim 1 wherein the normalization equations allow the X, Y and Z absolute distance values to be scaled as a function of selected parameters to thereby provide a nominal airfoil shape that is scaleable over ranges of absolute distance values for providing a selection of alternative sizes for corresponding blade airfoils.

4. The turbine blade system of claim 1 wherein the blade airfoil has an airfoil shape that occurs anywhere in a spatial region about a nominal airfoil shape that is bounded by being within ±0.050 inches in directions normal to any locations on the nominal airfoil shape.

5. The turbine blade system of claim 1 wherein the height of the blade airfoil from root to tip is 1.905000 inches.

6. The turbine blade system of claim 1 wherein the normalization equations depend on the normalization parameters blade root axial chord represented as $Bx_{root}$, the blade span (form the ID section to the OD section) represented as h, the blade root pitch represented as $\text{Pitch}_{root}$, and the blade root radius represented as $R_{root}$.

7. The turbine blade system of claim 2 wherein the ring platform has a support surface with a support surface shape in the vicinity of the location at which the blade airfoil is supported thereon with that support surface smoothly joining with the airfoil shape, the support surface having a nominal profile substantially in accordance with normalized Cartesian coordinate values of X, Y and Z set forth in Table 4 herein and which values are dimensionless values that are convertible to corresponding absolute distance values through manipulating them in accord with corresponding normalization equations, and wherein X and Y absolute distance values at various Z absolute distance values, when connected by smooth continuing arcs, form a nominal support surface shape substantially matched by the support surface shape of the support surface.

8. The turbine blade system of claim 2 wherein a corresponding radius of the ring platform extends through each of the blade airfoils and each of the blade airfoils is positioned selectively rotated within ±10° with respect the radius corresponding thereto from the position set forth therefore in Tables 1 and 4 as converted to absolute distance values.

9. The turbine blade system of claim 7 wherein the support surface has a support surface shape that occurs anywhere in a spatial region about a nominal support surface shape that is bounded by being within ±0.050 inches in directions normal to any locations on the nominal support surface shape.

10. A ring platform for a turbine blade system on which a plurality of blade airfoils are supported positioned about the circumference of the ring platform, the ring platform having a support surface with a support surface shape in the vicinity of the location at which a blade airfoil is supported thereon with that support surface smoothly joining with the airfoil shape of that blade airfoil, the support surface having a nominal profile substantially in accordance with normalized Cartesian coordinate values of X, Y and Z set forth in Table 4 and which values are dimensionless values that are convertible to corresponding absolute distance values through manipulating them in accord with corresponding normalization equations, and wherein X and Y absolute distance values at various Z absolute distance values, when connected by smooth continuing arcs, form a nominal support surface shape substantially matched by the support surface shape of the support surface.

11. The turbine blade system of claim 10 wherein the support surface has a support surface shape that occurs anywhere in a spatial region about a nominal support surface shape that is bounded by being within ±0.050 inches in directions normal to any locations on the nominal support surface shape.

* * * * *